US012680737B2

(12) United States Patent
Sugimura et al.

(10) Patent No.: US 12,680,737 B2
(45) Date of Patent: Jul. 14, 2026

(54) HEAT PUMP CYCLE DEVICE

(71) Applicant: DENSO CORPORATION, Kariya-city (JP)

(72) Inventors: Kengo Sugimura, Kariya-city (JP); Yuichi Kami, Kariya-city (JP); Kota Takeichi, Kariya-city (JP)

(73) Assignee: DENSO CORPORATION, Kariya-city (JP)

( * ) Notice: Subject to any disclaimer, the term of this patent is extended or adjusted under 35 U.S.C. 154(b) by 101 days.

(21) Appl. No.: 18/732,258

(22) Filed: Jun. 3, 2024

(65) Prior Publication Data

US 2024/0361050 A1 Oct. 31, 2024

Related U.S. Application Data

(63) Continuation of application No. PCT/JP2022/041641, filed on Nov. 9, 2022.

(30) Foreign Application Priority Data

Dec. 6, 2021 (JP) ..... 2021-197801

(51) Int. Cl.
*F25B 30/02* (2006.01)
*F25B 49/02* (2006.01)

(52) U.S. Cl.
CPC ..... *F25B 30/02* (2013.01); *F25B 49/02* (2013.01); *F25B 2400/04* (2013.01)

(58) Field of Classification Search
CPC ..... F25B 30/02; F25B 49/02; F25B 2400/04
See application file for complete search history.

(56) References Cited

U.S. PATENT DOCUMENTS

2009/0095005 A1* 4/2009 Dietrich ..... B60H 1/00907 62/238.1
2022/0275982 A1 9/2022 Mieda et al.

FOREIGN PATENT DOCUMENTS

DE 102011118162 A1 * 5/2013
JP 2021156567 A 10/2021

OTHER PUBLICATIONS

Dirk et al., Combination Structure of Refrigeration Apparatus and Heat Pump . . . , May 16, 2013, DE102011118162A1, Whole Document (Year: 2013).*

* cited by examiner

*Primary Examiner* — Larry L Furdge
(74) *Attorney, Agent, or Firm* — Harness, Dickey & Pierce, P.L.C.

(57) ABSTRACT

A heat pump cycle device includes a compressor, a branch portion, a heating unit, a heating-unit side decompression unit, a bypass passage, a bypass-side flow-rate regulating unit, a mixing portion, and a target temperature determination unit. When a regulating performance determination unit determines that a flow rate regulating performance of one of the heating-unit side decompression unit or the bypass-side flow-rate regulating unit is equal to or less than the reference regulating performance, a throttle opening of the other of the heating-unit side decompression unit or the bypass-side flow-rate regulating unit is set to be equal to or less than an upper limit opening.

8 Claims, 14 Drawing Sheets

HOT-GAS AIR-HEATING MODE

HOT-GAS AIR-HEATING MODE

HOT-GAS DEHUMIDIFICATION AND AIR-HEATING MODE

HOT-GAS DEHUMIDIFICATION AND AIR-HEATING MODE

HOT-GAS SERIES DEHUMIDIFICATION AND AIR-HEATING MODE

HOT-GAS SERIES DEHUMIDIFICATION AND AIR-HEATING MODE

HEAT PUMP CYCLE DEVICE

CROSS REFERENCE TO RELATED APPLICATION

The present application is a continuation application of International Patent Application No. PCT/JP2022/041641 filed on Nov. 9, 2022, which designated the U.S. and claims the benefit of priority from Japanese Patent Application No. 2021-197801 filed on Dec. 6, 2021. The entire disclosures of all of the above applications are incorporated herein by reference.

FIELD OF THE INVENTION

The present disclosure relates to a heat pump cycle device which is configured to mix refrigerants with different enthalpies and to suck the mixed refrigerant into a compressor.

BACKGROUND

Conventionally, a heat pump cycle device may be applied to a vehicle air conditioner. In the heat pump cycle device for the vehicle air conditioner, an operation in a hot-gas air-heating mode is performed in order to heat air in a vehicle cabin at the time of an extremely low outside air temperature.

SUMMARY

A heat pump cycle device according to an aspect of the present disclosure includes a compressor, a branch portion, a heating unit, a heating-unit side decompression unit, a bypass passage, a bypass-side flow-rate regulating unit, a mixing portion, a target temperature determination unit, and a regulating performance determination unit.

An operation of at least one of the heating-unit side decompression unit or the bypass-side flow-rate regulating unit is controlled in a manner that an object temperature approaches a target temperature and a quality of a suction refrigerant sucked into the compressor approaches a predetermined reference quality, or the object temperature approaches the target temperature and a degree of superheating of the suction refrigerant approaches a predetermined reference degree of superheating.

Alternatively, an opening ratio of a throttle opening of the heating-unit side decompression unit is regulated to a throttle opening of the bypass-side flow-rate regulating unit in a manner that a quality of a suction refrigerant sucked into the compressor approaches a predetermined reference quality or a degree of superheating of the suction refrigerant approaches a predetermined reference degree of superheating.

BRIEF DESCRIPTION OF DRAWINGS

The foregoing and other objects, features, and advantages of the present disclosure will become more apparent from the following detailed description with reference to the accompanying drawings. In the drawings.

DESCRIPTION OF EMBODIMENTS

Figure 1:
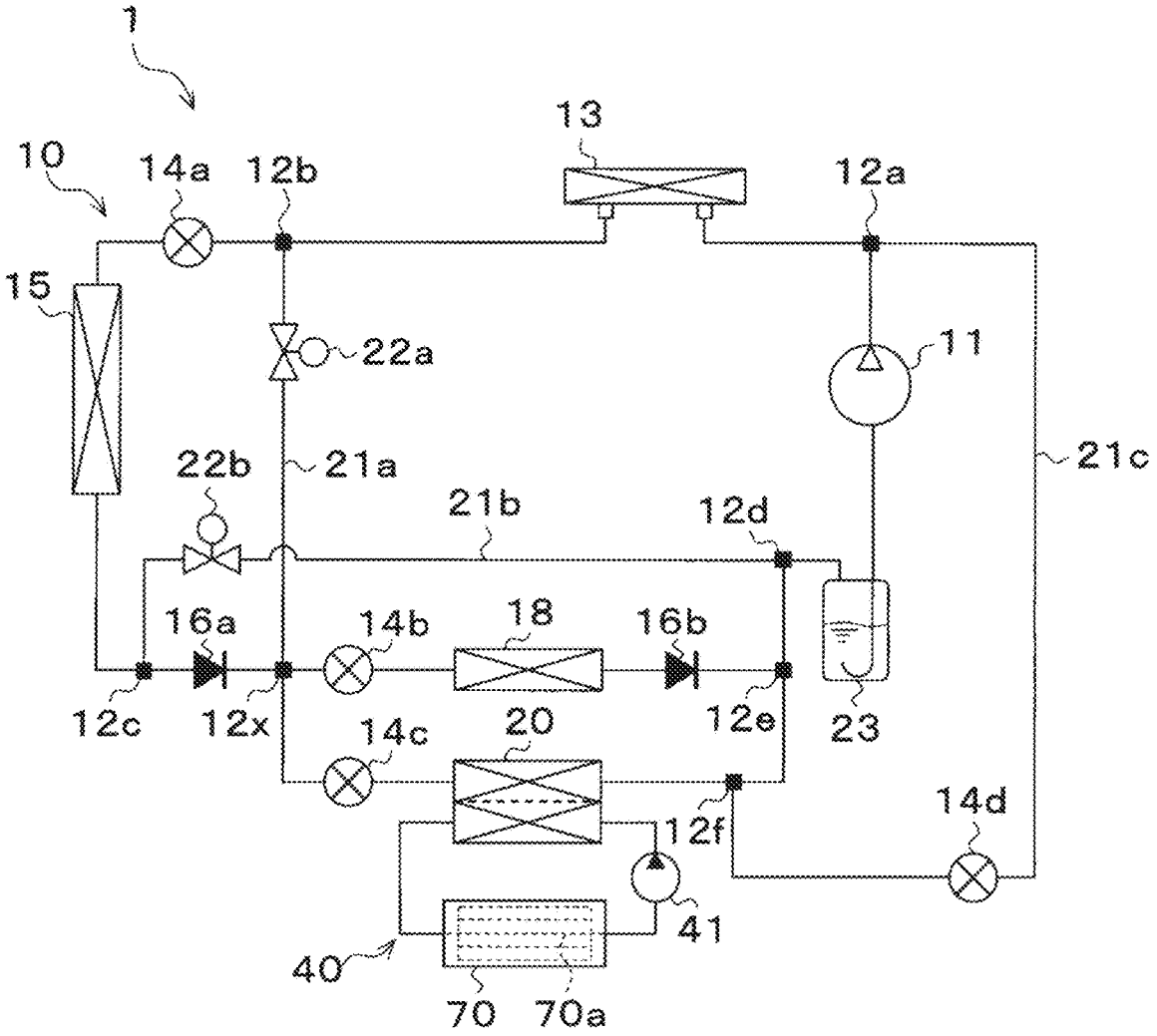
FIG. 1 is a schematic overall configuration diagram of a vehicle air conditioner according to a first embodiment.

A heat pump cycle device for a vehicle air conditioner is provided with a branch portion. In a hot-gas air-heating mode of the heat pump cycle device, a discharge refrigerant discharged from a compressor flows into the branch portion. One of the refrigerants branched at the branch portion is then caused to flow into a heating unit. The heating unit heats ventilation air by heat exchange between the refrigerant and the ventilation air blown into the vehicle cabin. Furthermore, the refrigerant flowing out of the heating unit is decompressed by a heating-unit side decompression unit.

The other refrigerant branched at the branch portion is caused to flow into a bypass passage. Furthermore, the refrigerant flowing into the bypass passage is decompressed by a bypass-side flow-rate regulating valve. The refrigerant decompressed by the heating-unit side decompression unit and the refrigerant decompressed by the bypass-side flow-rate regulating valve are mixed by a mixing portion and sucked into the compressor.

That is, in the heat pump cycle device, when the operation in the hot-gas air-heating mode is performed, a refrigerant circuit is switched in which refrigerants with different enthalpies are mixed and sucked into the compressor.

In the refrigerant circuit of the hot-gas air-heating mode describe in the above, it is necessary to appropriately regulate the workload of the compressor in order to appropriately heat the air in the vehicle cabin. At the same time, it is necessary to appropriately regulate the throttle openings of the heating-unit side decompression unit and the bypass-side flow-rate regulating valve in a manner that the state of the suction refrigerant sucked into the compressor is in an appropriate state. This is because if the state of the suction refrigerant is not maintained in an appropriate state, the durable life of the compressor is adversely affected.

In the hot-gas air-heating mode of the heat pump cycle device, the operations of the heating-unit side decompression unit and the bypass-side flow-rate regulating valve are controlled in a manner that the degree of superheating of the suction refrigerant approaches a predetermined reference degree of superheating.

However, in the actual heat pump cycle device, the flow rate regulation range of the refrigerant in the heating-unit side decompression unit is different from the flow rate regulation range of the refrigerant in the bypass-side flow-rate regulating valve. Therefore, if the throttle opening of one of the heating-unit side decompression unit or the bypass-side flow-rate regulating valve approaches a fully open state and the flow rate regulating performance decreases, there is a possibility that the state of the suction refrigerant cannot be maintained in an appropriate state.

Therefore, in the heat pump cycle device of the above example, there is a possibility that the compressor cannot be reliably protected in the hot-gas air-heating mode.

In view of the above, an object of the present disclosure is to provide a heat pump cycle device capable of reliably protecting a compressor even when refrigerants with different enthalpies are mixed and sucked into the compressor.

A heat pump cycle device according to a first aspect of the present disclosure includes a compressor, a branch portion, a heating unit, a heating-unit side decompression unit, a bypass passage, a bypass-side flow-rate regulating unit, a mixing portion, a target temperature determination unit, and a regulating performance determination unit.

The compressor is configured to compress and discharge a refrigerant. The branch portion is configured to branch a flow of the refrigerant discharged from the compressor. The heating unit is configured to heat a heating object using one refrigerant branched at the branch portion as a heat source. The heating-unit side decompression unit is configured to decompress the refrigerant flowing out of the heating unit. The bypass passage guides the other refrigerant branched at the branch portion to a suction port side of the compressor. The bypass-side flow-rate regulating unit is configured to regulate a flow rate of the refrigerant flowing through the bypass passage. The mixing portion is configured to mix the refrigerant flowing out of the bypass-side flow-rate regulating unit with the refrigerant flowing out of the heating-unit side decompression unit, and to cause a mixed refrigerant to flow to the suction port side of the compressor. The target temperature determination unit is configured to determine a target temperature that is a target value of an object temperature of the heating object to be heated by the heating unit. The regulating performance determination unit is configured to determine that a flow rate regulating performance of one of the heating-unit side decompression unit or the bypass-side flow-rate regulating unit becomes equal to or less than a predetermined reference regulating performance.

An operation of at least one of the heating-unit side decompression unit or the bypass-side flow-rate regulating unit is controlled in a manner that the object temperature approaches the target temperature and a quality of a suction refrigerant sucked into the compressor approaches a predetermined reference quality, or the object temperature approaches the target temperature and a degree of superheating of the suction refrigerant approaches a predetermined reference degree of superheating.

Furthermore, when the regulating performance determination unit determines that the flow rate regulating performance of one of the heating-unit side decompression unit or the bypass-side flow-rate regulating unit is equal to or less than the reference regulating performance, a throttle opening of the other of the heating-unit side decompression unit or the bypass-side flow-rate regulating unit is reduced.

According to this, when the regulating performance determination unit determines that the flow rate regulating performance of the one of the heating-unit side decompression unit or the bypass-side flow-rate regulating unit is equal to or less than the reference regulating performance, the throttle opening of the other one of the heating-unit side decompression unit or the bypass-side flow-rate regulating unit is set to be equal to or less than the upper limit opening.

If it is difficult to increase the flow rate of the refrigerant flowing from one of the heating-unit side decompression unit or the bypass-side flow-rate regulating unit into the mixing portion, the flow rate of the refrigerant flowing from the other of the heating-unit side decompression unit or the bypass-side flow-rate regulating unit into the mixing portion can be limited.

As a result, it is possible to prevent the state of the suction refrigerant from becoming a gas-liquid two-phase refrigerant with a quality lower than necessary and from becoming a gas-phase refrigerant with a degree of superheating higher than necessary. That is, even in the heat pump cycle device in which refrigerants with different enthalpies are mixed by the mixing portion and sucked into the compressor, the compressor can be reliably protected.

Here, the flow rate regulating performance can be defined by a ratio of a change amount of the flow rate to a change amount of the throttle opening.

A heat pump cycle device according to a second aspect of the present disclosure includes a compressor, a branch portion, a heating unit, a heating-unit side decompression unit, a bypass passage, a bypass-side flow-rate regulating unit and a mixing portion.

The compressor is configured to compress and discharge a refrigerant. The branch portion is configured to branch a flow of a discharge refrigerant discharged from the compressor. The heating unit is configured to heat a heating object using one discharge refrigerant branched at the branch portion as a heat source. The heating-unit side decompression unit is configured to decompress the refrigerant flowing out of the heating unit. The bypass passage guides other discharge refrigerant branched at the branch portion to a suction port side of the compressor. The bypass-side flow-rate regulating unit is configured to regulate a flow rate of the refrigerant flowing through the bypass passage. The mixing portion is configured to mix the refrigerant flowing out of the bypass-side flow-rate regulating unit with the refrigerant flowing out of the heating-unit side decompression unit, and to cause a mixed refrigerant to flow to the suction port side of the compressor.

Furthermore, an opening ratio of a throttle opening of the heating-unit side decompression unit is regulated to a throttle opening of the bypass-side flow-rate regulating unit in a manner that a quality of a suction refrigerant sucked into the compressor approaches a predetermined reference quality or a degree of superheating of the suction refrigerant approaches a predetermined reference degree of superheating.

According to this, the opening ratio is regulated in a manner that the quality of the suction refrigerant approaches the reference quality or the degree of superheating of the suction refrigerant approaches the reference degree of superheating. Therefore, the throttle opening of the heating-unit side decompression unit and the throttle opening of the bypass-side flow-rate regulating unit can be changed within a range in which the state of the suction refrigerant is in an appropriate state regardless of the refrigerant discharge performance of the compressor.

As a result, it is possible to prevent the state of the suction refrigerant from becoming a gas-liquid two-phase refrigerant with a quality lower than necessary and from becoming a gas-phase refrigerant with a degree of superheating higher than necessary. That is, even in the heat pump cycle device in which refrigerants with different enthalpies are mixed by the mixing portion and sucked into the compressor, the compressor can be reliably protected.

Next, a plurality of embodiments for carrying out the present disclosure will be described below with reference to the drawings. In each embodiment, parts corresponding to matters described in the preceding embodiment are denoted by the same reference numerals, and redundant description may be omitted. In a case where only a part of the configuration is described in each embodiment, other embodiments described above can be used for other parts of the configuration. It is possible not only to combine parts that can be explicitly combined in the embodiments, but also to partially combine the embodiments even if not explicitly specified if there is no trouble with the combination.

First Embodiment

A first embodiment of a heat pump cycle device according to the present disclosure will be described with reference to FIGS. 1 to 12. In the present embodiment, the heat pump cycle device according to the present disclosure is applied to a vehicle air conditioner 1 mounted on an electric vehicle. The electric vehicle is a vehicle that obtains driving force for traveling from an electric motor. The vehicle air conditioner 1 performs air conditioning in a vehicle cabin that is a space to be air conditioned, and also regulates the temperature of an in-vehicle device. Therefore, the vehicle air conditioner 1 can be referred to as an air conditioner with an in-vehicle device temperature regulation function or an in-vehicle device temperature regulation device with an air conditioning function.

Specifically, the vehicle air conditioner 1 regulates the temperature of a battery 70 as an in-vehicle device. The battery 70 is a secondary battery that stores electric power supplied to a plurality of in-vehicle devices operated by electricity. The battery 70 is an assembled battery formed by electrically connecting a plurality of battery cells arranged in a stacked manner in series or in parallel. The battery cell of the present embodiment is a lithium ion battery.

The battery 70 generates heat during operation (that is, at the time of charging and discharging). The output of the battery 70 is likely to decrease at a low temperature, and the battery is likely to deteriorate at a high temperature. Therefore, the temperature of the battery 70 needs to be maintained within an appropriate temperature range (in the present embodiment, equal to or higher than 15° C. and equal to or lower than 55° C.). Therefore, in the electric vehicle of the present embodiment, the temperature of the battery 70 is regulated using the vehicle air conditioner 1. It is needless to mention that the in-vehicle device whose temperature is to be regulated by the vehicle air conditioner 1 is not limited to the battery 70.

The vehicle air conditioner 1 includes a heat pump cycle 10, a low-temperature side heat medium circuit 40, an inside air conditioning unit 50, a control device 60, and the like.

First, the heat pump cycle 10 will be described with reference to FIG. 1. The heat pump cycle 10 is a vapor compression refrigeration cycle that regulates the temperature of ventilation air supplied into the vehicle cabin and a low-temperature side heat medium circulating in the low-temperature side heat medium circuit 40. The heat pump cycle 10 is configured to be able to switch a refrigerant circuit based on various operation modes to be described later in order to perform air conditioning in the vehicle cabin and temperature regulation of the in-vehicle device.

The heat pump cycle 10 uses, as a refrigerant, an HFO refrigerant (specifically, R1234yf). The heat pump cycle 10 configures a subcritical refrigeration cycle in which the refrigerant pressure on a high pressure side does not exceed the critical pressure of the refrigerant. Refrigerant oil for lubricating a compressor 11 is mixed with the refrigerant. The refrigerant oil is a PAG oil (that is, polyalkylene glycol oil) compatible with a liquid-phase refrigerant. A part of the refrigerant oil circulates in the heat pump cycle 10 together with the refrigerant.

The compressor 11 sucks, compresses, and discharges the refrigerant in the heat pump cycle 10. The compressor 11 is an electric compressor in which a fixed capacity type compression mechanism with a fixed discharge capacity is rotationally driven by an electric motor. The refrigerant discharge performance (that is, the rotation speed) of the compressor 11 is controlled by a control signal output from the control device 60 to be described later.

The compressor 11 is disposed in a drive unit chamber formed on the front side of the vehicle cabin. The drive unit chamber forms a space in which at least a part of a device (for example, a traveling electric motor) used for generating or regulating driving force for vehicle traveling is disposed.

An inlet port side of a first three-way joint 12*a* is connected to a discharge port of the compressor 11. The first three-way joint 12*a* has three inlet and outlet ports communicating with each other. As the first three-way joint 12*a*, a joint formed by joining a plurality of pipes or a joint formed by providing a plurality of refrigerant passages in a metal block or a resin block can be used.

As described later, the heat pump cycle 10 further includes a second three-way joint 12*b* to a sixth three-way joint 12*f*. The basic configurations of the second three-way joint 12*b* to the sixth three-way joint 12*f* are similar to that of the first three-way joint 12*a*. The basic configuration of each three-way joint described in the embodiments to be described later is also similar to that of the first three-way joint 12*a*.

In these three-way joints, when one of the three inlet and outlet ports is used as an inlet port and the remaining two are used as outlet ports, the flow of the refrigerant is branched. When two of the three inlet and outlet ports are used as the inlet ports and the remaining one is used as the outlet port, the flows of the refrigerant are joined. Therefore, the first three-way joint 12*a* is a branch portion that branches the flow of the discharge refrigerant discharged from the compressor 11.

An inlet port side of a refrigerant passage in an inside condenser 13 is connected to one outlet port of the first three-way joint 12*a*. One inlet port side of the sixth three-way joint 12*f* is connected to the other outlet port of the first three-way joint 12*a*. The refrigerant passage from the other outlet port of the first three-way joint 12*a* to one inlet port of the sixth three-way joint 12*f* is a bypass passage 21*c*. A bypass-side flow-rate regulating valve 14*d* is disposed in the bypass passage 21*c*.

The bypass-side flow-rate regulating valve 14*d* is a decompression unit on a bypass passage side that decompresses the discharge refrigerant (that is, the other discharge refrigerant branched at the first three-way joint 12*a*) flowing out of the other outlet port of the first three-way joint 12*a* in a hot-gas air-heating mode or the like to be described later. The bypass-side flow-rate regulating valve 14*d* is a bypass-side flow-rate regulating unit that regulates the flow rate (the mass flow rate) of the refrigerant flowing through the bypass passage 21*c*.

The bypass-side flow-rate regulating valve 14*d* is an electric variable throttle mechanism including a valve body that changes the throttle opening and an electric actuator (specifically, a stepping motor) as a drive unit that displaces the valve body. The operation of the bypass-side flow-rate regulating valve 14*d* is controlled by a control pulse output from the control device 60.

The bypass-side flow-rate regulating valve 14*d* has a full-open function of functioning as a simple refrigerant passage without exhibiting a refrigerant decompression action and a flow-rate regulating action by setting the throttle opening in a fully open state. The bypass-side flow-rate regulating valve 14*d* has a full-close function of closing the refrigerant passage by setting the throttle opening in a fully closed state.

The heat pump cycle 10 further includes an air-heating expansion valve 14*a*, an air-cooling expansion valve 14*b*, and a cooling expansion valve 14*c* as described later. The basic configurations of the air-heating expansion valve 14*a*, the air-cooling expansion valve 14*b*, and the cooling expansion valve 14*c* are similar to that of the bypass-side flow-rate regulating valve 14*d*.

The air-heating expansion valve 14*a*, the air-cooling expansion valve 14*b*, the cooling expansion valve 14*c*, and the bypass-side flow-rate regulating valve 14*d* can switch the refrigerant circuit by exhibiting the full-close function. Therefore, the air-heating expansion valve 14*a*, the air-cooling expansion valve 14*b*, the cooling expansion valve 14*c*, and the bypass-side flow-rate regulating valve 14*d* also function as a refrigerant circuit switching unit.

It is needless to mention that the air-heating expansion valve 14*a*, the air-cooling expansion valve 14*b*, the cooling expansion valve 14*c*, and the bypass-side flow-rate regulating valve 14*d* may be formed by combining a variable throttle mechanism that does not have a full-close function and an on-off valve that opens and closes a throttle passage. In this case, each on-off valve serves as a refrigerant circuit switching unit.

The inside condenser 13 is disposed in an air conditioning casing 51 of the inside air conditioning unit 50 to be described later. The inside condenser 13 is a heating heat exchange unit that exchanges heat between the discharge refrigerant discharged from one outlet port of the first three-way joint 12*a* (that is, one discharge refrigerant branched at the first three-way joint 12*a*) and the ventilation air having passed through an inside evaporator 18 to be described later. The inside condenser 13 radiates heat of the discharge refrigerant to the ventilation air to heat the ventilation air.

Therefore, the inside condenser 13 is a heating unit that heats the ventilation air as a heating object using one discharge refrigerant branched at the first three-way joint 12*a* as a heat source.

An inlet port side of the second three-way joint 12*b* is connected to an outlet port of the refrigerant passage in the inside condenser 13. An inlet port side of the air-heating expansion valve 14*a* is connected to one outlet port of the second three-way joint 12*b*. One inlet port side of a four-way joint 12*x* is connected to the other outlet port of the second three-way joint 12*b*. The refrigerant passage from the other outlet port of the second three-way joint 12*b* to one inlet port of the four-way joint 12*x* is a dehumidifying passage 21*a*.

A dehumidifying on-off valve 22*a* is disposed in the dehumidifying passage 21*a*. The dehumidifying on-off valve 22*a* is an on-off valve that opens and closes the dehumidifying passage 21*a*. The dehumidifying on-off valve 22*a* is an electromagnetic valve whose opening and closing operation is controlled by a control voltage output from the control device 60. The dehumidifying on-off valve 22*a* can switch the refrigerant circuit by opening and closing the dehumidifying passage 21*a*. Therefore, the dehumidifying on-off valve 22*a* is a refrigerant circuit switching unit.

The four-way joint 12*x* is a joint having four inlet and outlet ports communicating with each other. As the four-way joint 12*x*, a joint formed in a similar manner to the three-way joint can be used. As the four-way joint 12*x*, a joint formed by combining two three-way joints may be used.

The air-heating expansion valve 14*a* is a decompression unit on the outside heat exchanger side that decompresses the refrigerant flowing into an outside heat exchanger 15 in an air-heating mode or the like to be described later. The air-heating expansion valve 14*a* is also a flow-rate regulating unit on the outside heat exchanger side that regulates the flow rate (the mass flow rate) of the refrigerant flowing into the outside heat exchanger 15.

A refrigerant inlet port side of the outside heat exchanger 15 is connected to an outlet port of the air-heating expansion valve 14*a*. The outside heat exchanger 15 is an outside heat exchange unit that exchanges heat between the refrigerant flowing out of the air-heating expansion valve 14*a* and outside air supplied by an outside air fan (not illustrated). The outside heat exchanger 15 is disposed on the front side of the drive unit chamber. As a result, during traveling of the vehicle, traveling air flowing into the drive unit chamber through a grill can be applied to the outside heat exchanger 15.

An inlet port side of the third three-way joint 12*c* is connected to a refrigerant outlet port of the outside heat exchanger 15. One inlet port side of the four-way joint 12*x* is connected to one outlet port of the third three-way joint 12*c* via a first check valve 16*a*. One inlet port side of the fourth three-way joint 12*d* is connected to the other outlet port of the third three-way joint 12*c*. The refrigerant passage from the other outlet port of the third three-way joint 12*c* to one inlet port of the fourth three-way joint 12*d* is an air-heating passage 21*b*.

An air-heating on-off valve 22*b* is disposed in the air-heating passage 21*b*. The air-heating on-off valve 22*b* is an on-off valve that opens and closes the air-heating passage 21*b*. The basic configuration of the air-heating on-off valve 22*b* is similar to that of the dehumidifying on-off valve 22*a*. Therefore, the air-heating on-off valve 22*b* is a refrigerant circuit switching unit. The basic configuration of each on-off valve described in the embodiments to be described later is also similar to that of the dehumidifying on-off valve 22*a*.

The first check valve 16*a* allows the refrigerant to flow from the side of the third three-way joint 12*c* to the side of the four-way joint 12*x*, and prohibits the refrigerant from flowing from the side of the four-way joint 12*x* to the side of the third three-way joint 12*c*.

A refrigerant inlet port side of the inside evaporator 18 is connected to one outlet port of the four-way joint 12*x* via the air-cooling expansion valve 14*b*. The air-cooling expansion valve 14*b* is a decompression unit on the inside evaporator side that decompresses the refrigerant flowing into the inside evaporator 18 in an air-cooling mode or the like to be described later. The air-cooling expansion valve 14*b* is also a flow-rate regulating unit on the inside evaporator side that regulates the flow rate (the mass flow rate) of the refrigerant flowing into the inside evaporator 18.

The inside evaporator 18 is disposed in the air conditioning casing 51 of the inside air conditioning unit 50 to be described later. The inside evaporator 18 is a heat exchange unit that exchanges heat between the low-pressure refrigerant decompressed by the air-cooling expansion valve 14*b* and the ventilation air supplied by an interior blower 52 toward the vehicle cabin. The inside evaporator 18 cools the ventilation air by evaporating the low-pressure refrigerant and exhibiting a heat absorbing action.

One inlet port side of the fifth three-way joint 12*e* is connected to a refrigerant outlet port of the inside evaporator 18 via a second check valve 16*b*. The second check valve 16*b* allows the refrigerant to flow from the refrigerant outlet port side of the inside evaporator 18 to the side of the fifth three-way joint 12*e*, and prohibits the refrigerant from flowing from the side of the fifth three-way joint 12*e* to the refrigerant outlet port side of the inside evaporator 18.

An inlet port side of a refrigerant passage in a chiller 20 is connected to another outlet port of the four-way joint 12*x* via the cooling expansion valve 14*c*. The cooling expansion valve 14*c* is a chiller-side decompression unit that decompresses the refrigerant flowing into the chiller 20 in a cooling and air-cooling mode, the hot-gas air-heating mode, or the like to be described later. The cooling expansion valve 14*c* is also a chiller-side flow-rate regulating unit that regulates the flow rate (the mass flow rate) of the refrigerant flowing into the chiller 20.

The chiller 20 is a heat exchange unit that exchanges heat between the low-pressure refrigerant decompressed by the cooling expansion valve 14*c* and the low-temperature side heat medium circulating in the low-temperature side heat medium circuit 40. The chiller 20 can cool the low-temperature side heat medium by evaporating the low-pressure refrigerant and exhibiting the heat absorbing action. In addition, the chiller can heat the low-temperature side heat medium by radiating heat of the low-pressure refrigerant to the low-temperature side heat medium.

The other inlet port side of the sixth three-way joint 12*f* is connected to an outlet port of the refrigerant passage in the chiller 20. The other inlet port side of the fifth three-way joint 12*e* is connected to an outlet port of the sixth three-way joint 12*f*. The other inlet port side of the fourth three-way joint 12*d* is connected to an outlet port of the fifth three-way joint 12*e*.

An inlet port side of an accumulator 23 is connected to an outlet port of the fourth three-way joint 12*d*. The accumulator 23 is a low-pressure side gas-liquid separator that separates the refrigerant flowing into the accumulator into gas and liquid and stores an excess liquid-phase refrigerant in the cycle. A gas-phase refrigerant outlet port of the accumulator 23 is connected to a suction port side of the compressor 11. The accumulator 23 has an oil return hole for returning the refrigerant oil contained in the separated liquid-phase refrigerant to the compressor 11 together with the gas-phase refrigerant.

Next, the low-temperature side heat medium circuit 40 will be described. The low-temperature side heat medium circuit 40 is a heat medium circuit that circulates a low-temperature side heat medium. In the present embodiment, as the low-temperature side heat medium, an ethylene glycol aqueous solution is used. In the low-temperature side heat medium circuit 40, a low-temperature side pump 41, a cooling water passage 70*a* of the battery 70, a heat medium passage of the chiller 20, and the like are connected.

The low-temperature side pump 41 is a low-temperature side heat medium pumping unit that pumps the low-temperature side heat medium flowing out of the cooling water passage 70*a* of the battery 70 to the inlet port side of the heat medium passage in the chiller 20. The low-temperature side pump 41 is an electric pump whose rotation speed (that is, pumping performance) is controlled by a control voltage output from the control device 60. An inlet port side of the cooling water passage 70*a* in the battery 70 is connected to an outlet port side of the heat medium passage in the chiller 20.

The cooling water passage 70*a* of the battery 70 is a cooling water passage formed to cool the battery 70 by circulating the low-temperature side heat medium cooled by the chiller 20. The cooling water passage 70*a* is formed inside a dedicated battery case that houses a plurality of battery cells arranged in a stacked manner. The cooling water passage 70*a* has a passage configuration in which a plurality of passages are connected in parallel inside the dedicated battery case. As a result, the cooling water passage 70*a* can uniformly cool all the battery cells. A suction port side of the low-temperature side pump 41 is connected to an outlet port of the cooling water passage 70*a*.

Figure 2:
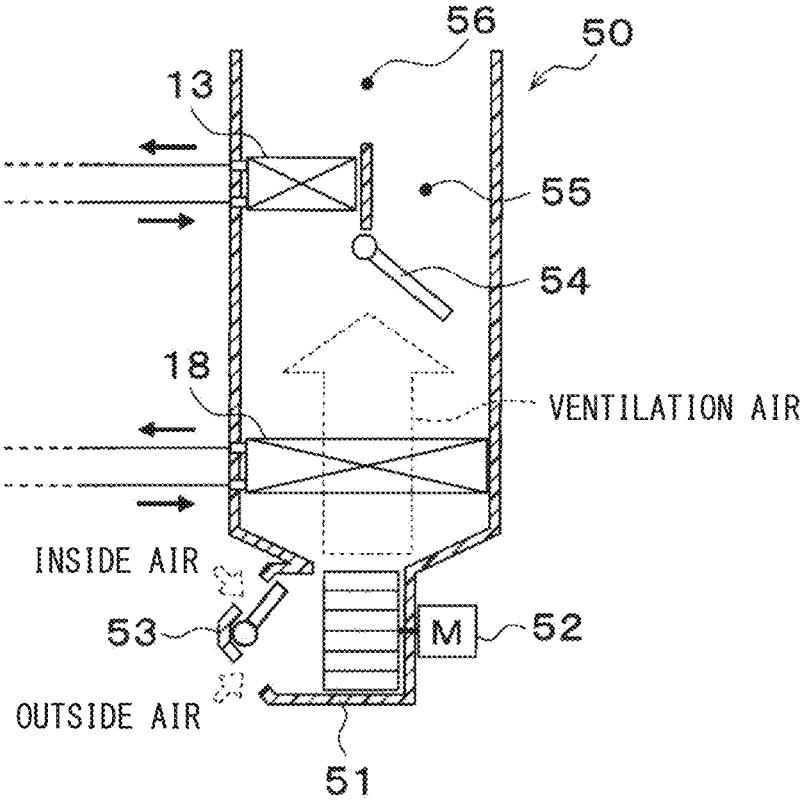
FIG. 2 is a schematic configuration diagram of an inside air conditioning unit according to the first embodiment.

Next, the inside air conditioning unit 50 will be described with reference to FIG. 2. The inside air conditioning unit 50 is a unit in which a plurality of constituent devices are integrated in order to blow ventilation air regulated to an appropriate temperature for air conditioning in the vehicle cabin to an appropriate location in the vehicle cabin. The inside air conditioning unit 50 is disposed inside a dashboard (i.e., instrument panel) at the foremost of the vehicle cabin.

The inside air conditioning unit 50 is formed by housing the interior blower 52, the inside evaporator 18, the inside condenser 13, and the like in the air conditioning casing 51 forming an air passage for ventilation air. The air conditioning casing 51 is formed of resin (for example, polypropylene) that has a certain degree of elasticity and excellent strength.

An inside-air and outside-air switching device 53 is disposed on the most upstream side in a ventilation air flow of the air conditioning casing 51. The inside-air and outside-air switching device 53 switches inside air (that is, air inside the vehicle cabin) and outside air (that is, air outside the vehicle cabin), and introduces the air into the air conditioning casing 51. The operation of the inside-air and outside-air switching device 53 is controlled by a control signal output from the control device 60.

The interior blower 52 is disposed on the downstream side in the ventilation air flow of the inside-air and outside-air switching device 53. The interior blower 52 is a ventilation unit that supplies air sucked through the inside-air and outside-air switching device 53 to the vehicle cabin. The rotation speed (that is, the ventilation performance) of the interior blower 52 is controlled by a control voltage output from the control device 60.

The inside evaporator 18 and the inside condenser 13 are arranged on the downstream side in the ventilation air flow of the interior blower 52. The inside evaporator 18 is disposed on the upstream side in the ventilation air flow of the inside condenser 13. A cold air bypass passage 55 in which the ventilation air after passing through the inside evaporator 18 flows while bypassing the inside condenser 13 is formed in the air conditioning casing 51.

An air mix door 54 is disposed on the downstream side in the ventilation air flow of the inside evaporator 18 and on the upstream side in the ventilation air flow of the inside condenser 13 and the cold air bypass passage 55 in the air conditioning casing 51.

The air mix door 54 regulates an air volume ratio between the volume of the ventilation air passing through the side of the inside condenser 13 and the volume of the ventilation air passing through the cold air bypass passage 55 in the ventilation air after passing through the inside evaporator 18. The operation of an actuator for driving the air mix door 54 is controlled by a control signal output from the control device 60.

A mixing space 56 is disposed on the downstream side in the ventilation air flow of the inside condenser 13 and the cold air bypass passage 55. The mixing space 56 is a space for mixing the ventilation air heated by the inside condenser 13 and the ventilation air passing through the cold air bypass passage 55 and not heated.

Therefore, in the inside air conditioning unit 50, the temperature of the ventilation air (that is, the conditioned air) mixed in the mixing space 56 and blown into the vehicle cabin can be regulated by regulating the opening of the air mix door 54. The air mix door 54 of the present embodiment is an air flow-rate regulating unit that regulates the flow rate of ventilation air subjected to heat exchange in the inside condenser 13.

A plurality of opening holes (not illustrated) for blowing conditioned air toward various locations in the vehicle cabin are formed in a portion of the air conditioning casing 51 on the most downstream side in the ventilation air flow. A blowing mode door (not illustrated) that opens and closes each opening hole is disposed in each of the plurality of opening holes. The operation of an actuator for driving the blowing mode door is controlled by a control signal output from the control device 60.

Therefore, in the inside air conditioning unit 50, the conditioned air regulated to an appropriate temperature can be blown to an appropriate location in the vehicle cabin by switching the opening holes in which the blowing mode door opens and closes.

Next, an electric control unit of the present embodiment will be described. The control device 60 includes a known microcomputer including a CPU, a ROM, a RAM, and the like, and peripheral circuits thereof. The control device 60 performs various calculations and processing on the basis of a control program stored in the ROM. The control device 60 then controls the operations of the various control target devices 11, 14*a* to 14*d*, 22*a*, 22*b*, 41, 52, 53, and the like connected to the output side on the basis of the calculation and processing results.

Figure 3:
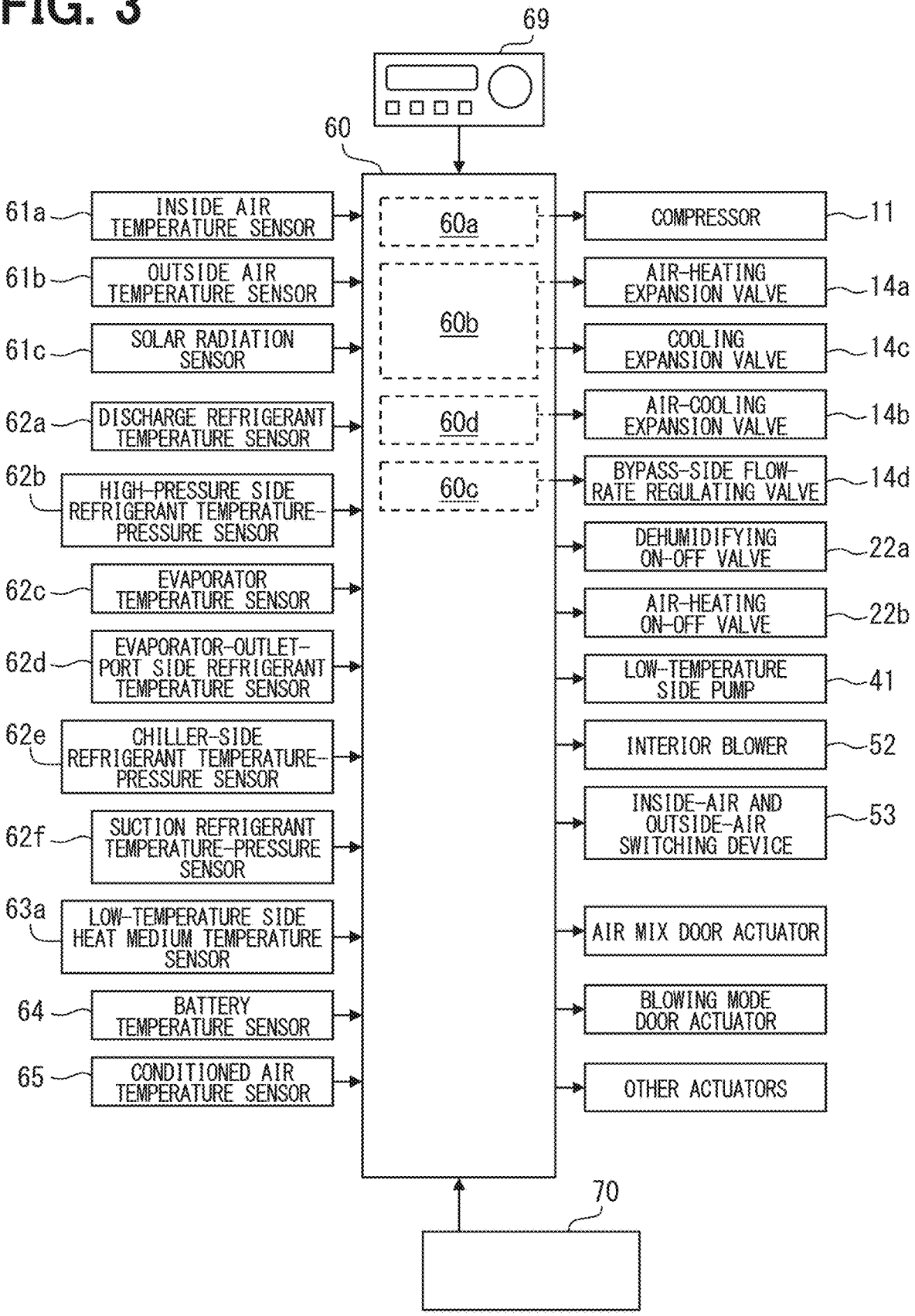
FIG. 3 is a block diagram illustrating an electric control unit of the vehicle air conditioner according to the first embodiment.

As illustrated in the block diagram of FIG. 3, a control sensor group including an inside air temperature sensor 61*a*, an outside air temperature sensor 61*b*, a solar radiation sensor 61*c*, a discharge refrigerant temperature sensor 62*a*, a high-pressure side refrigerant temperature-pressure sensor 62*b*, an evaporator temperature sensor 62*c*, an evaporator-outlet-port side refrigerant temperature sensor 62*d*, a chiller-side refrigerant temperature-pressure sensor 62*e*, a suction refrigerant temperature-pressure sensor 62*f*, a low-temperature side heat medium temperature sensor 63*a*, a battery temperature sensor 64, a conditioned air temperature sensor 65, and the like is connected to the input side of the control device 60.

The inside air temperature sensor 61*a* is an inside air temperature detection unit that detects a vehicle cabin temperature (inside air temperature) Tr. The outside air temperature sensor 61*b* is an outside air temperature detection unit that detects a temperature outside the vehicle cabin (outside air temperature) Tam. The solar radiation sensor 61*c* is a solar-radiation amount detection unit that detects a solar radiation amount As with which the vehicle cabin is irradiated.

The discharge refrigerant temperature sensor 62*a* is a discharge refrigerant temperature detection unit that detects a discharge refrigerant temperature Td of the discharge refrigerant discharged from the compressor 11.

The high-pressure side refrigerant temperature-pressure sensor 62*b* is a high-pressure side refrigerant temperature pressure detection unit that detects a high-pressure side refrigerant temperature T1, which is the temperature of the refrigerant flowing out of the inside condenser 13, and a discharge refrigerant pressure Pd, which is the pressure of the refrigerant flowing out of the inside condenser 13. The discharge refrigerant pressure Pd of the present embodiment is also used as the pressure of the discharge refrigerant discharged from the compressor 11.

The evaporator temperature sensor 62*c* is an evaporator temperature detection unit that detects a refrigerant evaporating temperature (evaporator temperature) Tefin in the inside evaporator 18. Specifically, the evaporator temperature sensor 62*c* detects a heat-exchange fin temperature of the inside evaporator 18.

The evaporator-outlet-port side refrigerant temperature sensor 62*d* is an evaporator-outlet-port side refrigerant temperature detection unit that detects an evaporator-side refrigerant temperature Teout that is the temperature of the refrigerant flowing out of the inside evaporator 18.

The chiller-side refrigerant temperature-pressure sensor 62*e* is a chiller-side refrigerant temperature pressure detection unit that detects a chiller-side refrigerant temperature Tc, which is the temperature of the refrigerant flowing out of the refrigerant passage of the chiller 20, and a chiller-side refrigerant pressure Pc, which is the pressure of the refrigerant flowing out of the refrigerant passage of the chiller 20.

The suction refrigerant temperature-pressure sensor 62*f* is a suction refrigerant temperature pressure detection unit that detects a suction refrigerant temperature Ts, which is the temperature of the suction refrigerant sucked into the compressor 11, and a suction refrigerant pressure Ps, which is the pressure of the suction refrigerant sucked into the compressor 11.

In the present embodiment, a detection unit in which a pressure detection unit and a temperature detection unit are integrated is used as a refrigerant temperature-pressure sensor, but it is needless to mention that a pressure detection unit and a temperature detection unit configured as separate units may be used.

The low-temperature side heat medium temperature sensor 63*a* is a low-temperature side heat medium temperature detection unit that detects a low-temperature side heat medium temperature TWL that is the temperature of the low-temperature side heat medium flowing into the cooling water passage 70*a* of the battery 70.

The battery temperature sensor 64 is a battery temperature detection unit that detects a battery temperature TB that is the temperature of the battery 70. The battery temperature sensor 64 includes a plurality of temperature sensors, and detects temperatures at a plurality of portions of the battery 70. Therefore, the control device 60 can detect a temperature difference between and a temperature distribution of the individual battery cells forming the battery 70. Furthermore, the average value of detection values of the plurality of temperature sensors is used as the battery temperature TB.

The conditioned air temperature sensor 65 is a conditioned air temperature detection unit that detects a ventilation air temperature TAV of the ventilation air supplied into the vehicle cabin from the mixing space 56. The ventilation air temperature TAV is an object temperature of the ventilation air as a heating object.

Furthermore, as illustrated in FIG. 3, an operation panel 69 disposed near the instrument panel at the front of the vehicle cabin is connected to the input side of the control device 60. Operation signals from various operation switches provided on the operation panel 69 are input to the control device 60.

Specific examples of the various operation switches provided on the operation panel 69 include an automatic switch, an air conditioner switch, an air volume setting switch, and a temperature setting switch.

The automatic switch is an automatic control setting unit that sets or cancels the automatic control operation of the vehicle air conditioner 1. The air conditioner switch is a cooling request unit that requests the inside evaporator 18 to cool ventilation air. The air volume setting switch is an air volume setting unit that manually sets the air volume of the interior blower 52. The temperature setting switch is a temperature setting unit that sets a set temperature Tset in the vehicle cabin.

The control device 60 of the present embodiment is integrally configured with a control unit that controls various control target devices connected to the output side of the control device. Therefore, a configuration (that is, hardware and software) that controls the operation of each control target device configures the control unit that controls the operation of each control target device.

For example, the configuration in the control device 60 that controls the refrigerant discharge performance of the compressor 11 configures a discharge performance control unit 60*a*. The configuration of controlling the operation of the heating-unit side decompression unit (in the present embodiment, the air-heating expansion valve 14*a* and the cooling expansion valve 14*c*) configures a heating-unit side control unit 60*b*. The configuration of controlling the operation of the bypass-side flow-rate regulating valve 14*d* configures a bypass-side control unit 60*c*. The configuration of controlling the operation of an auxiliary heating-unit side decompression unit (in the present embodiment, the air-cooling expansion valve 14*b*) configures an auxiliary heating-unit side control unit 60*d*.

Next, the operation of the vehicle air conditioner 1 of the present embodiment with the above configuration will be described. In the vehicle air conditioner 1 of the present embodiment, various operation modes are switched in order to perform air conditioning in the vehicle cabin and temperature regulation of the battery 70. These operation modes are switched by executing a control program stored in advance in the control device 60.

The control program is executed not only when the so-called IG switch is turned on (ON) and the vehicle system is activated, but also when the battery 70 is charged from an external power supply. A main routine of the control program will be described with reference to a flowchart of FIG. 4. The control steps illustrated in the flowchart of FIG. 4 and the like are function implementation units included in the control device 60.

Figure 4:
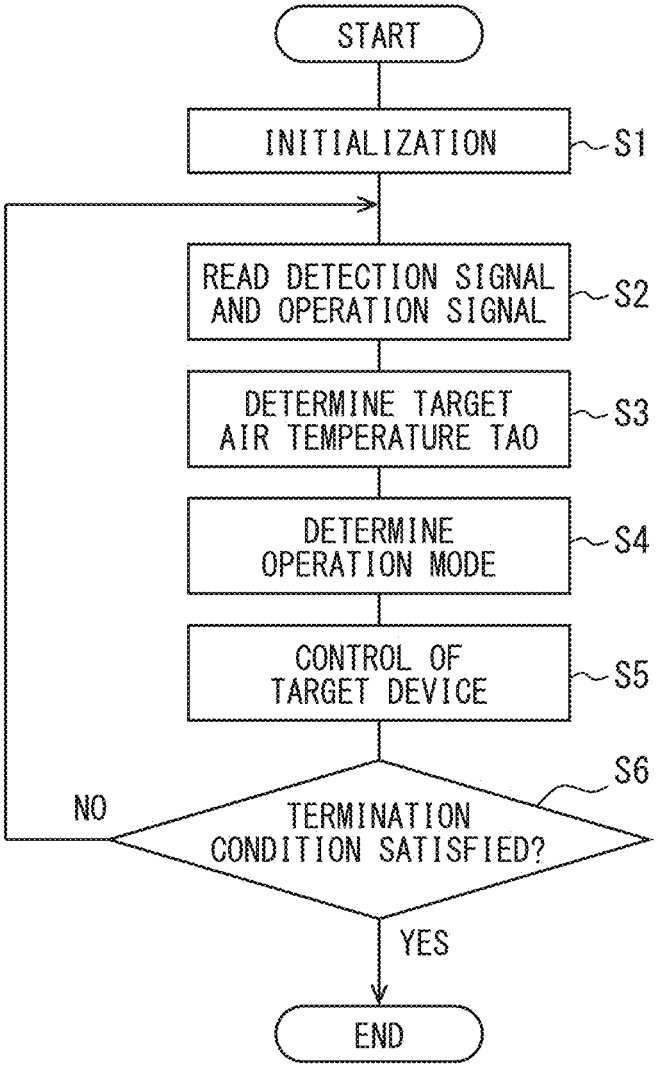
FIG. 4 is a flowchart of a main routine of a control program according to the first embodiment.

First, in step S1 of FIG. 4, initialization including initialization of a flag, a timer, and the like, and initial alignment of an electric actuator and the like is performed. Next, in step S2, a detection signal of a control sensor group and an operation signal of the operation panel 69 are read. Next, in step S3, a target air temperature (i.e., target blowing temperature) TAO is determined. The target air temperature TAO is a target value of the temperature of air to be blown into the vehicle cabin. Therefore, step S3 is a target temperature determination unit.

Specifically, in step S3, the target air temperature TAO is determined using the following Formula F1.

$$TAO = Kset \times Tset - Kr \times Tr - Kam \times Tam - Ks \times As + C \quad \text{(F1)}$$

Tset is a vehicle cabin target temperature set by the temperature setting switch. Tr is an inside air temperature detected by the inside air temperature sensor 61*a*. Tam is an outside air temperature detected by the outside air temperature sensor 61*b*. As is a solar radiation amount detected by the solar radiation sensor 61*c*. Kset, Kr, Kam, and Ks are control gains, and C is a correction constant.

Next, in step S4, an operation mode is selected on the basis of the detection signal and the operation signal read in step S2 and the target air temperature TAO determined in step S3. Next, in step S5, the operations of the various control target devices are controlled so as to perform the operation mode selected in step S4.

Next, in step S6, it is determined whether or not a predetermined condition of terminating the vehicle air conditioner 1 is satisfied. When it is determined in step S6 that the termination condition is not satisfied, the processing returns to step S2. As a result, control routines such as reading of the detection signal and the operation signal, determination of the target air temperature TAO, determination of the operation mode, and control of the control target device are repeated. When it is determined in step S6 that the termination condition is satisfied, the program is terminated.

The termination condition of the present embodiment is satisfied when the IG switch is turned off (OFF) in a state where the battery 70 is not charged from the external power supply. The condition is also satisfied when charging of the battery 70 from the external power supply is completed in a state where the IG switch is in a non-on state (OFF). Hereinafter, the detailed operation of each operation mode in step S5 will be described.

First, an operation mode in which the refrigerant does not flow through the bypass passage 21*c* will be described. Examples of the operation mode in which the refrigerant does not flow through the bypass passage 21*c* include (a) air-cooling mode, (b) series dehumidification and air-heating mode, and (c) outside-air heat-absorption and air-heating mode.

(a) Air-Cooling Mode

The air-cooling mode is an operation mode in which the air in the vehicle cabin is cooled by blowing cooled ventilation air into the vehicle cabin. In the control program, the air-cooling mode is selected mainly in summer when the outside air temperature Tam is relatively high (25° C. or higher in the present embodiment).

The air-cooling mode includes a single air-cooling mode and a cooling and air-cooling mode. The single air-cooling mode is an operation mode in which the air in the vehicle cabin is cooled without cooling the battery 70. The cooling and air-cooling mode is an operation mode in which the battery 70 is cooled and at the same time, the air in the vehicle cabin is cooled.

In the control program, the operation mode of cooling the battery 70 is performed when the battery temperature TB detected by the battery temperature sensor 64 is equal to or higher than a predetermined reference upper limit temperature KTBH. The same applies to other operation modes described below.

(a-1) Single Air-Cooling Mode

In the heat pump cycle 10 in the single air-cooling mode, the control device 60 brings the air-heating expansion valve 14*a* into a fully open state, brings the air-cooling expansion valve 14*b* into a throttled state where the refrigerant decompression action is exhibited, brings the cooling expansion valve 14*c* into a fully closed state, and brings the bypass-side flow-rate regulating valve 14*d* into the fully closed state. In addition, the control device 60 closes the dehumidifying on-off valve 22*a* and also closes the air-heating on-off valve 22*b*.

Therefore, in the heat pump cycle 10 in the single air-cooling mode, the refrigerant circuit is switched to a refrigerant circuit in which the refrigerant discharged from the compressor 11 circulates through the inside condenser 13, the air-heating expansion valve 14*a* in the fully open state, the outside heat exchanger 15, the air-cooling expansion valve 14*b* in the throttled state, the inside evaporator 18, the accumulator 23, and the suction port of the compressor 11 in this order.

In the inside air conditioning unit 50 in the single air-cooling mode, the control device 60 regulates the opening of the air mix door 54 in a manner that the ventilation air temperature TAV detected by the conditioned air temperature sensor 65 approaches the target air temperature TAO.

In addition, the control device 60 determines a control voltage to be output to the interior blower 52 on the basis of the target air temperature TAO with reference to a control map stored in advance in the control device 60. In the control map of the air-cooling mode, the control voltage is determined in a manner that the air volume of the interior blower 52 is maximized in the extremely-low temperature range (the maximum air-cooling range) and the extremely-high temperature range (the maximum air-heating range) of the target air temperature TAO, and the air volume decreases as the temperature approaches the intermediate temperature range.

Furthermore, the control device 60 controls the operations of the inside-air and outside-air switching device 53 and the blowing mode door on the basis of the target air temperature TAO with reference to the control map stored in advance in the control device 60. The control device 60 appropriately controls the operations of other control target devices.

Therefore, in the heat pump cycle 10 in the single air-cooling mode, a vapor compression refrigeration cycle is configured in which the inside condenser 13 and the outside heat exchanger 15 function as condensers that radiate heat of the refrigerant and condense the refrigerant, and the inside evaporator 18 functions as an evaporator that evaporates the refrigerant.

In the inside air conditioning unit 50 in the single air-cooling mode, the ventilation air supplied by the interior blower 52 is cooled by the inside evaporator 18. The ventilation air cooled by the inside evaporator 18 is reheated by the inside condenser 13 so as to approach the target air temperature TAO based on the opening of the air mix door 54. The ventilation air with a regulated temperature is blown into the vehicle cabin, so that the air in the vehicle cabin is cooled.

(a-2) Cooling and Air-Cooling Mode

In the heat pump cycle 10 in the cooling and air-cooling mode, the control device 60 brings the cooling expansion valve 14*c* into the throttled state as compared with the single air-cooling mode.

Therefore, in the heat pump cycle 10 in the cooling and air-cooling mode, the refrigerant discharged from the compressor 11 circulates similarly to the single air-cooling mode. At the same time, the refrigerant circuit is switched to a refrigerant circuit in which the refrigerant discharged from the compressor 11 circulates through the inside condenser 13, the air-heating expansion valve 14*a* in the fully open state, the outside heat exchanger 15, the cooling expansion valve 14*c* in the throttled state, the chiller 20, the accumulator 23, and the suction port of the compressor 11 in this order. That is, the refrigerant circuit is switched to a refrigerant circuit in which the inside evaporator 18 and the chiller 20 are connected in parallel to the refrigerant flow.

In the low-temperature side heat medium circuit 40 in the cooling and air-cooling mode, the control device 60 operates the low-temperature side pump 41 so as to exhibit the predetermined reference pumping performance. Therefore, in the low-temperature side heat medium circuit 40, the low-temperature side heat medium pumped from the low-temperature side pump 41 circulates through the heat medium passage of the chiller 20, the cooling water passage 70*a* of the battery 70, and the suction port of the low-temperature side pump 41 in this order.

In addition, in the inside air conditioning unit 50 in the cooling and air-cooling mode, the control device 60 controls the ventilation performance of the interior blower 52, the opening of the air mix door 54, and the operations of the inside-air and outside-air switching device 53 and the blowing mode door, as in the single air-cooling mode. The control device 60 appropriately controls the operations of other control target devices.

Therefore, in the heat pump cycle 10 in the cooling and air-cooling mode, a vapor compression refrigeration cycle is configured in which the inside condenser 13 and the outside heat exchanger 15 function as condensers, and the inside evaporator 18 and the chiller 20 function as evaporators.

In the low-temperature side heat medium circuit 40 in the cooling and air-cooling mode, the low-temperature side heat medium pumped from the low-temperature side pump 41 flows into the chiller 20, exchanges heat with the low-pressure refrigerant, and is cooled. The low-temperature side heat medium cooled by the chiller 20 flows through the cooling water passage 70*a* of the battery 70. As a result, the battery 70 is cooled. The low-temperature side heat medium flowing out of the cooling water passage 70*a* of the battery 70 is sucked into the low-temperature side pump 41 and pumped to the chiller 20 again.

In the inside air conditioning unit 50 in the cooling and air-cooling mode, the ventilation air with a regulated temperature is blown into the vehicle cabin, so that the air in the vehicle cabin is cooled, as in the single air-cooling mode.

(b) Series Dehumidification and Air-Heating Mode

The series dehumidification and air-heating mode is an operation mode in which the air in the vehicle cabin is dehumidified and heated by reheating cooled and dehumidified ventilation air and blowing the reheated ventilation air into the vehicle cabin. In the control program, the series dehumidification and air-heating mode is selected when the outside air temperature Tam is a temperature in a predetermined medium to high temperature range (equal to or higher than 10° C. and lower than 25° C. in the present embodiment).

Examples of the series dehumidification and air-heating mode include a single series dehumidification and air-heating mode and a cooling series dehumidification and air-heating mode. The single series dehumidification and air-heating mode is an operation mode in which the air in the vehicle cabin is dehumidified and heated without cooling the battery 70. The cooling series dehumidification and air-heating mode is an operation mode in which the battery 70 is cooled, and at the same time, the air in the vehicle cabin is dehumidified and heated.

(b-1) Single Series Dehumidification and Air-Heating Mode

In the heat pump cycle 10 in the single series dehumidification and air-heating mode, the control device 60 brings the air-heating expansion valve 14*a* into the throttled state, brings the air-cooling expansion valve 14*b* into the throttled state, brings the cooling expansion valve 14*c* into the fully closed state, and brings the bypass-side flow-rate regulating valve 14*d* into the fully closed state. In addition, the control device 60 closes the dehumidifying on-off valve 22*a* and also closes the air-heating on-off valve 22*b*.

Therefore, in the heat pump cycle 10 in the single series dehumidification and air-heating mode, the refrigerant circuit is switched to a refrigerant circuit in which the refrigerant discharged from the compressor 11 circulates through the inside condenser 13, the air-heating expansion valve 14*a* in the throttled state, the outside heat exchanger 15, the air-cooling expansion valve 14*b* in the throttled state, the inside evaporator 18, the accumulator 23, and the suction port of the compressor 11 in this order.

In addition, the control device 60 determines the throttle opening of the air-heating expansion valve 14*a* and the throttle opening of the air-cooling expansion valve 14*b* on the basis of the target air temperature TAO with reference to the control map stored in advance in the control device 60.

In the control map of the series dehumidification and air-heating mode, the control signal is determined in a manner that the throttle opening of the air-heating expansion valve 14*a* decreases and the throttle opening of the air-cooling expansion valve 14*b* increases as the target air temperature TAO increases. Furthermore, in the control map of the series dehumidification and air-heating mode, control signals output to the air-heating expansion valve 14*a* and the air-cooling expansion valve 14*b* are determined in a manner that frosting on the inside evaporator 18 can be suppressed.

In addition, in the inside air conditioning unit 50 in the single series dehumidification and air-heating mode, the control device 60 controls the ventilation performance of the interior blower 52, the opening of the air mix door 54, and the operations of the inside-air and outside-air switching device 53 and the blowing mode door, as in the single air-cooling mode. The control device 60 appropriately controls the operations of other control target devices.

Therefore, in the heat pump cycle 10 in the single series dehumidification and air-heating mode, a vapor compression refrigeration cycle is configured in which the inside condenser 13 functions as a condenser, and the inside evaporator 18 functions as an evaporator.

In addition, in the single series dehumidification and air-heating mode, in a case where the saturation temperature of the refrigerant in the outside heat exchanger 15 is higher than the outside air temperature Tam, the outside heat exchanger 15 functions as a condenser. In a case where the saturation temperature of the refrigerant in the outside heat exchanger 15 is lower than the outside air temperature Tam, the outside heat exchanger 15 functions as an evaporator.

In the inside air conditioning unit 50 in the single series dehumidification and air-heating mode, the ventilation air supplied by the interior blower 52 is cooled and dehumidified by the inside evaporator 18. The ventilation air cooled and dehumidified by the inside evaporator 18 is reheated by the inside condenser 13 so as to approach the target air temperature TAO based on the opening of the air mix door 54. The ventilation air with a regulated temperature is blown into the vehicle cabin, so that the air in the vehicle cabin is dehumidified and heated.

(b-2) Cooling Series Dehumidification and Air-Heating Mode

In the heat pump cycle 10 in the cooling series dehumidification and air-heating mode, the control device 60 brings the cooling expansion valve 14*c* into the throttled state as compared with the single series dehumidification and air-heating mode.

Therefore, in the heat pump cycle 10 in the cooling series dehumidification and air-heating mode, the refrigerant discharged from the compressor 11 circulates similarly to the single series dehumidification and air-heating mode. At the same time, the refrigerant circuit is switched to a refrigerant circuit in which the refrigerant discharged from the compressor 11 circulates through the inside condenser 13, the air-heating expansion valve 14*a* in the throttled state, the outside heat exchanger 15, the cooling expansion valve 14*c* in the throttled state, the chiller 20, the accumulator 23, and the suction port of the compressor 11 in this order. That is, the refrigerant circuit is switched to a refrigerant circuit in which the inside evaporator 18 and the chiller 20 are connected in parallel to the refrigerant flow.

In the low-temperature side heat medium circuit 40 in the cooling series dehumidification and air-heating mode, the control device 60 controls the operation of the low-temperature side pump 41 as in the cooling and air-cooling mode.

In addition, in the inside air conditioning unit 50 in the cooling series dehumidification and air-heating mode, the control device 60 controls the ventilation performance of the interior blower 52, the opening of the air mix door 54, and the operations of the inside-air and outside-air switching device 53 and the blowing mode door, as in the single air-cooling mode. The control device 60 appropriately controls the operations of other control target devices.

Therefore, in the heat pump cycle 10 in the cooling series dehumidification and air-heating mode, a vapor compression refrigeration cycle is configured in which the inside condenser 13 functions as a condenser, and the inside evaporator 18 and the chiller 20 function as evaporators.

In addition, in the cooling series dehumidification and air-heating mode, in a case where the saturation temperature of the refrigerant in the outside heat exchanger 15 is higher than the outside air temperature Tam, the outside heat exchanger 15 functions as a condenser as in the single series dehumidification and air-heating mode. In a case where the saturation temperature of the refrigerant in the outside heat exchanger 15 is lower than the outside air temperature Tam, the outside heat exchanger 15 functions as an evaporator.

In the low-temperature side heat medium circuit 40 in the cooling series dehumidification and air-heating mode, as in the cooling and air-cooling mode, the low-temperature side heat medium cooled by the chiller 20 flows through the cooling water passage 70*a* of the battery 70, so that the battery 70 is cooled.

In the inside air conditioning unit 50 in the cooling series dehumidification and air-heating mode, the ventilation air with a regulated temperature is blown into the vehicle cabin, so that the air in the vehicle cabin is dehumidified and heated, as in the single series dehumidification and air-heating mode.

(c) Outside-Air Heat-Absorption and Air-Heating Mode

The outside-air heat-absorption and air-heating mode is an operation mode in which the air in the vehicle cabin is heated by blowing heated ventilation air into the vehicle cabin. In the control program, the outside-air heat-absorption and air-heating mode is selected mainly in winter when the outside air temperature Tam is relatively low (equal to or higher than −10° C. and lower than 0° C. in the present embodiment).

Examples of the outside-air heat-absorption and air-heating mode include a single outside-air heat-absorption and air-heating mode and a cooling outside-air heat-absorption and air-heating mode. The single outside-air heat-absorption and air-heating mode is an operation mode in which the air in the vehicle cabin is heated without cooling the battery 70. The cooling outside-air heat-absorption and air-heating mode is an operation mode in which the battery 70 is cooled and at the same time, the air in the vehicle cabin is heated.

(c-1) Single Outside-Air Heat-Absorption and Air-Heating Mode

In the heat pump cycle 10 in the single outside-air heat-absorption and air-heating mode, the control device 60 brings the air-heating expansion valve 14*a* into the throttled state, brings the air-cooling expansion valve 14*b* into the fully closed state, brings the cooling expansion valve 14*c* into the fully closed state, and brings the bypass-side flow-rate regulating valve 14*d* into the fully closed state. The control device 60 closes the dehumidifying on-off valve 22*a* and opens the air-heating on-off valve 22*b*.

Therefore, in the heat pump cycle 10 in the single outside-air heat-absorption and air-heating mode, the refrigerant circuit is switched to a refrigerant circuit in which the refrigerant discharged from the compressor 11 circulates through the inside condenser 13, the air-heating expansion valve 14*a* in the throttled state, the outside heat exchanger 15, the air-heating passage 21*b*, the accumulator 23, and the suction port of the compressor 11 in this order.

In addition, in the inside air conditioning unit 50 in the single outside-air heat-absorption and air-heating mode, the control device 60 controls the ventilation performance of the interior blower 52, the opening of the air mix door 54, and the operations of the inside-air and outside-air switching device 53 and the blowing mode door, as in the single air-cooling mode. The control device 60 appropriately controls the operations of other control target devices.

Therefore, in the heat pump cycle 10 in the single outside-air heat-absorption and air-heating mode, a vapor compression refrigeration cycle is configured in which the inside condenser 13 functions as a condenser and the outside heat exchanger 15 functions as an evaporator.

In the inside air conditioning unit 50 in the single outside-air heat-absorption and air-heating mode, the ventilation air supplied by the interior blower 52 passes through the inside evaporator 18. The ventilation air having passed through the inside evaporator 18 is heated by the inside condenser 13 so as to approach the target air temperature TAO based on the opening of the air mix door 54. The ventilation air with a regulated temperature is blown into the vehicle cabin, so that the air in the vehicle cabin is heated.

(c-2) Cooling Outside-Air Heat-Absorption and Air-Heating Mode

In the heat pump cycle 10 in the cooling outside-air heat-absorption and air-heating mode, the control device 60 brings the cooling expansion valve 14*c* into the throttled state as compared with the single outside-air heat-absorption and air-heating mode. The control device 60 opens the dehumidifying on-off valve 22*a*.

Therefore, in the heat pump cycle 10 in the cooling outside-air heat-absorption and air-heating mode, the refrigerant discharged from the compressor 11 circulates similarly to the single outside-air heat-absorption and air-heating mode. At the same time, the refrigerant circuit is switched to a refrigerant circuit in which the refrigerant discharged from the compressor 11 circulates through the inside condenser 13, the dehumidifying passage 21*a*, the cooling expansion valve 14*c* in the throttled state, the chiller 20, the accumulator 23, and the suction port of the compressor 11 in this order. That is, the refrigerant circuit is switched to a refrigerant circuit in which the outside heat exchanger 15 and the chiller 20 are connected in parallel to the refrigerant flow.

In the low-temperature side heat medium circuit 40 in the cooling outside-air heat-absorption and air-heating mode, the control device 60 controls the operation of the low-temperature side pump 41 as in the cooling and air-cooling mode.

In addition, in the inside air conditioning unit 50 in the cooling outside-air heat-absorption and air-heating mode, the control device 60 controls the ventilation performance of the interior blower 52, the opening of the air mix door 54, and the operations of the inside-air and outside-air switching device 53 and the blowing mode door, as in the single air-cooling mode. The control device 60 appropriately controls the operations of other control target devices.

Therefore, in the heat pump cycle 10 in the cooling outside-air heat-absorption and air-heating mode, a vapor compression refrigeration cycle is configured in which the inside condenser 13 functions as a condenser, and the outside heat exchanger 15 and the chiller 20 function as evaporators.

In the low-temperature side heat medium circuit 40 in the cooling outside-air heat-absorption and air-heating mode, as in the cooling and air-cooling mode, the low-temperature side heat medium cooled by the chiller 20 flows through the cooling water passage 70*a* of the battery 70, so that the battery 70 is cooled.

In the inside air conditioning unit 50 in the cooling outside-air heat-absorption and air-heating mode, as in the single outside-air heat-absorption and air-heating mode, the ventilation air with a regulated temperature is blown into the vehicle cabin, so that the air in the vehicle cabin is heated.

Next, an operation mode in which the refrigerant flows through the bypass passage 21*c* will be described. Examples of the operation mode in which the refrigerant flows through the bypass passage 21*c* include (d) hot-gas air-heating mode, (e) hot-gas dehumidification and air-heating mode, and (f) hot-gas series dehumidification and air-heating mode.

(d) Hot-Gas Air-Heating Mode

The hot-gas air-heating mode is an operation mode in which the air in the vehicle cabin is heated. In the control program, the hot-gas air-heating mode is selected when the outside air temperature Tam is extremely low temperature (lower than −10° C. in the present embodiment) or when it is determined that the heating performance of the ventilation air in the inside condenser 13 is insufficient in the outside-air heat-absorption and air-heating mode.

In the control program, when the ventilation air temperature TAV is lower than the target air temperature TAO, it is determined that the heating performance of the ventilation air is insufficient. The same applies to other operation modes.

Examples of the hot-gas air-heating mode include a single hot-gas air-heating mode and a cooling hot-gas air-heating mode.

The single hot-gas air-heating mode is an operation mode in which the air in the vehicle cabin is heated without regulating the temperature of the battery 70. The cooling hot-gas air-heating mode is an operation mode in which the battery 70 is cooled during the hot-gas air-heating mode.

In the control program, the cooling hot-gas air-heating mode is selected when the battery temperature TB is equal to or higher than the reference upper limit temperature KTBH and the chiller-side refrigerant temperature Tc detected by the chiller-side refrigerant temperature-pressure sensor 62*e* is lower than the low-temperature side heat medium temperature TWL detected by the low-temperature side heat medium temperature sensor 63*a* during the hot-gas air-heating mode.

(d-1) Single Hot-Gas Air-Heating Mode

In the heat pump cycle 10 in the single hot-gas air-heating mode, the control device 60 brings the air-heating expansion valve 14*a* into the fully closed state, brings the air-cooling expansion valve 14*b* into the fully closed state, brings the cooling expansion valve 14*c* into the throttled state, and brings the bypass-side flow-rate regulating valve 14*d* into the throttled state. The control device 60 opens the dehumidifying on-off valve 22*a* and closes the air-heating on-off valve 22*b*.

Figure 5:
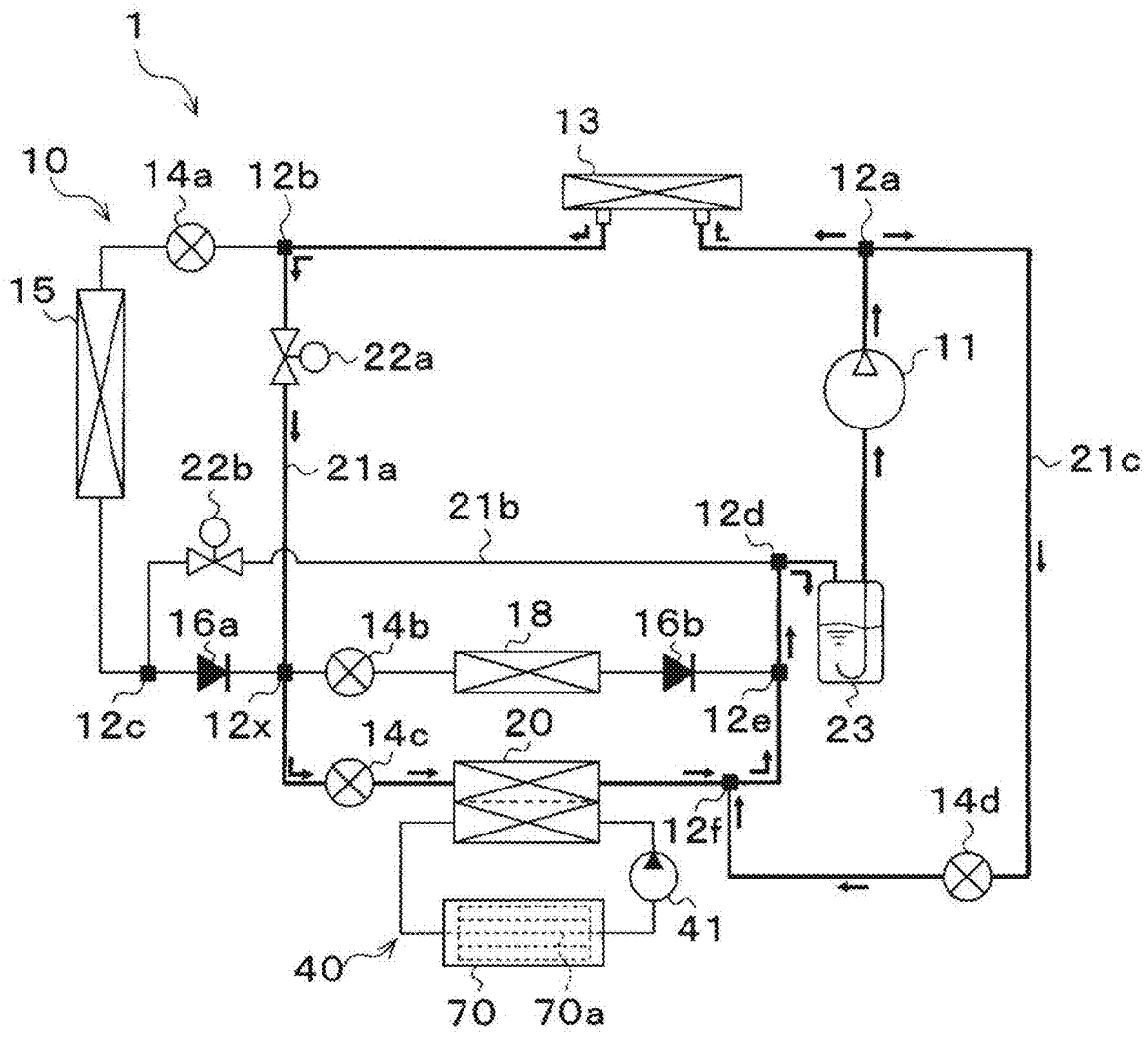
FIG. 5 is a schematic overall configuration diagram illustrating a flow of a refrigerant in a hot-gas air-heating mode of a heat pump cycle according to the first embodiment.

Therefore, in the heat pump cycle 10 in the single hot-gas air-heating mode, as indicated by solid arrows in FIG. 5, the refrigerant discharged from the compressor 11 circulates through the first three-way joint 12*a*, the inside condenser 13, the dehumidifying passage 21*a*, the four-way joint 12*x*, the cooling expansion valve 14*c* in the throttled state, the chiller 20, the sixth three-way joint 12*f*, the accumulator 23, and the suction port of the compressor 11 in this order. At the same time, the refrigerant circuit is switched to a refrigerant circuit in which the refrigerant discharged from the compressor 11 circulates through the first three-way joint 12*a*, the bypass-side flow-rate regulating valve 14*d* disposed in the bypass passage 21*c* and in the throttled state, the sixth three-way joint 12*f*, the accumulator 23, and the suction port of the compressor 11 in this order.

Furthermore, the control device 60 controls the refrigerant discharge performance of the compressor 11 in a manner that the suction refrigerant pressure Ps detected by the suction refrigerant temperature-pressure sensor 62*f* approaches a predetermined first target low pressure PSO1.

Controlling the suction refrigerant pressure Ps so as to approach a constant value is effective for stabilizing a discharge flow rate Gr (a mass flow rate) of the compressor 11. More specifically, by generating a saturated gas-phase refrigerant with a constant pressure as the suction refrigerant pressure Ps, the density of the suction refrigerant becomes constant. Therefore, when the suction refrigerant pressure Ps is controlled so as to approach a constant pressure, the discharge flow rate Gr of the compressor 11 at the same rotation speed is easily stabilized.

In addition, the control device 60 changes the throttle opening of the bypass-side flow-rate regulating valve 14*d* in a manner that the discharge refrigerant pressure Pd detected by the high-pressure side refrigerant temperature-pressure sensor 62*b* approaches a target high pressure PDO.

The target high pressure PDO is determined on the basis of the target air temperature TAO with reference to the control map stored in advance in the control device 60. In the control map of the hot-gas air-heating mode, the target high pressure PDO is determined to increase as the target air temperature TAO increases. Furthermore, in the control map of the hot-gas air-heating mode, the target high pressure PDO is determined in a manner that the ventilation air temperature TAV can be brought close to the target air temperature TAO.

The control device 60 changes the throttle opening of the cooling expansion valve 14*c* in a manner that the degree of subcooling SC1 of the refrigerant flowing out of the inside condenser 13 approaches a first target degree of subcooling SCO1. The degree of subcooling SC1 can be obtained using the high-pressure side refrigerant temperature T1 and the discharge refrigerant pressure Pd detected by the high-pressure side refrigerant temperature-pressure sensor 62*b*.

The first target degree of subcooling SCO1 is determined with reference to the control map stored in advance in the control device 60. In the control map of the hot-gas air-heating mode, the first target degree of subcooling SCO1 is determined in a manner that a quality Rx of the suction refrigerant approaches a predetermined reference quality KRx. The reference quality KRx is set to a relatively high value close to that of the saturated gas-phase refrigerant.

Furthermore, in the heat pump cycle 10 in the hot-gas air-heating mode, upper limit opening control is executed. The upper limit opening control is control in which when the flow rate regulating performance of one of the heating-unit side decompression unit and the bypass-side flow-rate regulating valve 14*d* is equal to or less than predetermined reference regulating performance, the throttle opening of the other of the heating-unit side decompression unit and the bypass-side flow-rate regulating valve 14*d* is set to be equal to or less than the upper limit opening.

The upper limit opening control will be described with reference to the flowchart of FIG. 6. The flowchart of FIG. 6 is control processing performed as a subroutine in step S5 when (d) hot-gas air-heating mode, (e) hot-gas dehumidification and air-heating mode, and (f) hot-gas series dehumidification and air-heating mode are selected in step S4 of the main routine in the control program.

Figure 6:
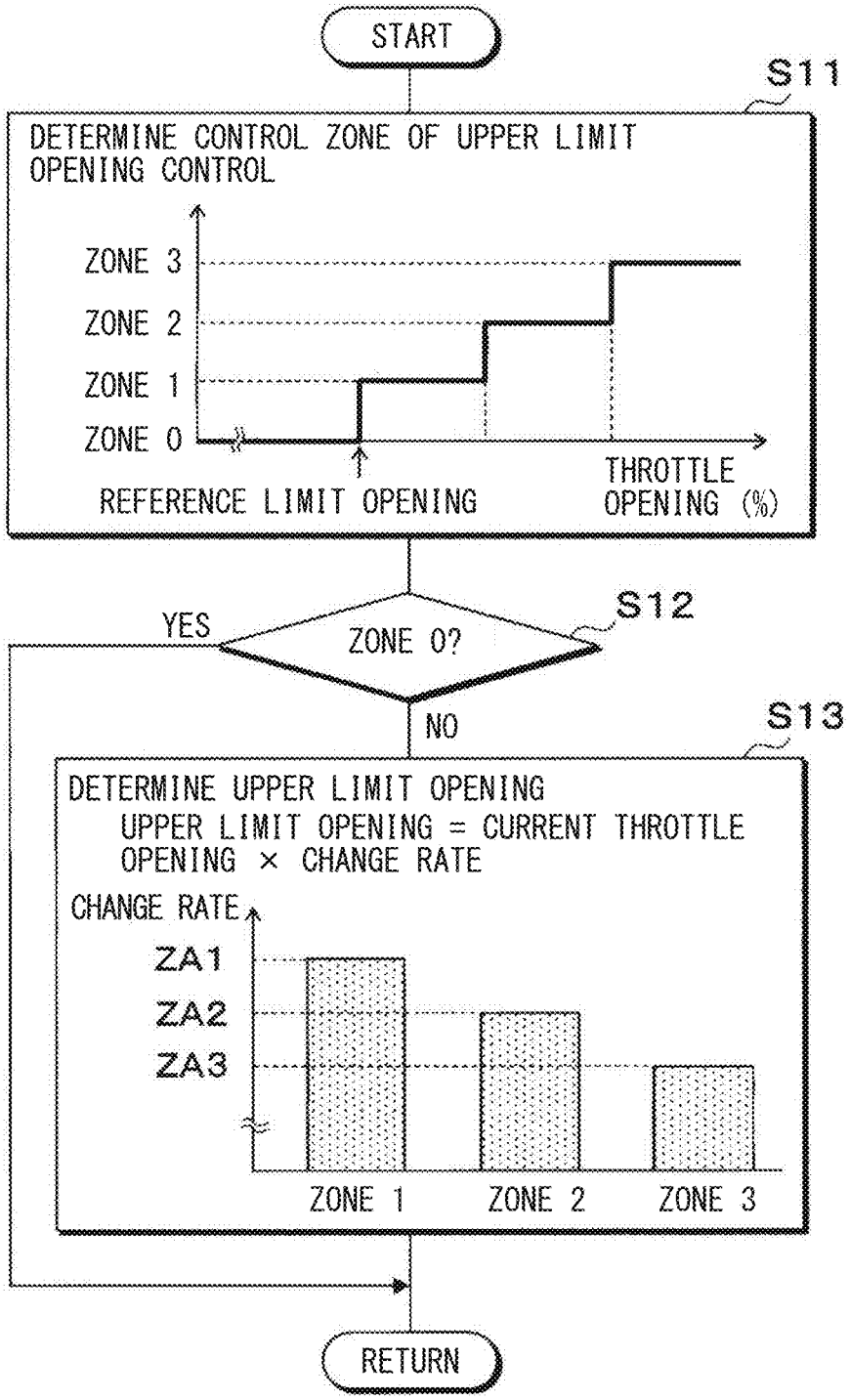
FIG. 6 is a flowchart of a subroutine of the control program according to the first embodiment.

First, in step S11 of FIG. 6, a control zone of the upper limit opening control is determined. Specifically, in step S11, one of the heating-unit side decompression unit and the bypass-side flow-rate regulating valve 14*d* that has a larger throttle opening is defined as one variable throttle mechanism, and the other that has a smaller throttle opening is defined as the other variable throttle mechanism. On the basis of the throttle opening of one variable throttle mechanism, as illustrated in the control characteristic diagram described in step S11 of FIG. 6, the control zone for determining the upper limit opening is determined.

In the control characteristic diagram of the present embodiment, when the throttle opening of one variable throttle mechanism is less than a reference limit opening (90% in the present embodiment), the control zone is determined to be zone 0. When the throttle opening of one variable throttle mechanism is equal to or larger than the reference limit opening, the control zone is determined in the order of zone 1, zone 2, and zone 3 as the throttle opening of one variable throttle mechanism increases.

Here, the throttle opening of the heating-unit side decompression unit in the hot-gas air-heating mode is the throttle opening of the cooling expansion valve 14*c*.

The throttle opening of the variable throttle mechanism can be defined by a ratio of the current area of a throttle passage to the area of the throttle passage in a fully open state. The area of the throttle passage in the fully open state is determined by product specifications. In a variable throttle mechanism having a stepping motor as a drive unit of displacing a valve body, the current throttle opening can be estimated using a control pulse transmitted from the control device 60.

Next, in step S12, it is determined whether or not the control zone determined in step S11 is zone 0. When it is determined in step S12 that the control zone is zone 0, the processing returns to the main routine. Therefore, when it is determined in step S12 that the control zone is zone 0, the upper limit opening is not set. When it is determined in step S12 that the control zone is not zone 0, the processing proceeds to step S13.

In step S13, the upper limit throttle opening of the other variable throttle mechanism is determined for each control zone, and the processing returns to the main routine. Therefore, step S13 is an upper limit opening determination unit. In step S13, specifically, as illustrated in the control characteristic diagram described in step S13 of FIG. 6, the upper limit opening is determined using the change rate determined for each control zone.

A change rate ZA1 in the control characteristic diagram illustrated in step S13 is a value of 1 or less. A change rate ZA2 is a value smaller than the change rate ZA1. A change rate ZA3 is a value smaller than the change rate ZA2.

In zone 1, the opening ZA1 times of the throttle opening of the other variable throttle mechanism in the previous control routine is determined as the upper limit opening. Therefore, when the control zone is zone 1, it is prohibited to increase the throttle opening of the other variable throttle mechanism in the current control routine. Furthermore, when ZA1 is a value smaller than 1, the throttle opening of the other variable throttle mechanism may be reduced in the current control routine.

In zone 2, the opening ZA2 times of the throttle opening of the other variable throttle mechanism in the previous control routine is determined as the upper limit opening. Therefore, when the control zone is zone 2, the throttle opening degree of the other variable throttle mechanism may be reduced in the current control routine. Furthermore, when the control zone is zone 2, the reduction amount of the throttle opening of the other variable throttle mechanism can be increased as compared with the case where the control zone is zone 1.

In zone 3, the opening ZA3 times of the throttle opening of the other variable throttle mechanism in the previous control routine is determined as the upper limit opening. Therefore, when the control zone is zone 2, the throttle opening degree of the other variable throttle mechanism may be reduced in the current control routine. Furthermore, when the control zone is zone 3, the reduction amount of the throttle opening of the other variable throttle mechanism can be increased as compared with the case where the control zone is zone 2.

Here, in the variable throttle mechanism such as the cooling expansion valve 14*c* and the bypass-side flow-rate regulating valve 14*d*, the flow rate regulating performance decreases as the throttle opening increases. This is because, as the throttle opening increases, the longitudinal differential pressure obtained by subtracting the refrigerant pressure on the downstream side of the variable throttle mechanism from the refrigerant pressure on the upstream side thereof decreases, and the flow rate change amount decreases accordingly. That is, the longitudinal differential pressure corresponds to the amount of decompression of the refrigerant in the variable throttle mechanism.

Therefore, in the upper limit opening control of the present embodiment, when the throttle opening of one variable throttle mechanism is equal to or larger than the reference limit opening, it is determined that the flow rate regulating performance of the one variable throttle mechanism is equal to or less than the reference regulating performance. Therefore, step S12 is a regulating performance determination unit. Furthermore, in step S13, which is the upper limit opening determination unit of the present embodiment, the upper limit opening is determined to be a low value as the throttle opening of one variable throttle mechanism increases.

In the low-temperature side heat medium circuit 40 in the single hot-gas air-heating mode, the control device 60 stops the low-temperature side pump 41.

In the inside air conditioning unit 50 in the single hot-gas air-heating mode, the control device 60 controls the opening of the air mix door 54 as in the single air-cooling mode. In the hot-gas air-heating mode, the control device 60 often controls the opening of the air mix door 54 in a manner that almost the entire volume of ventilation air supplied by the interior blower 52 passes through the inside condenser 13.

The control device 60 controls the operation of the inside-air and outside-air switching device 53 to introduce the inside air into the air conditioning casing 51. The control device 60 controls the ventilation performance of the interior blower 52 and the operation of the blowing mode door as in the single air-cooling mode. The control device 60 appropriately controls the operations of other control target devices.

Figure 7:
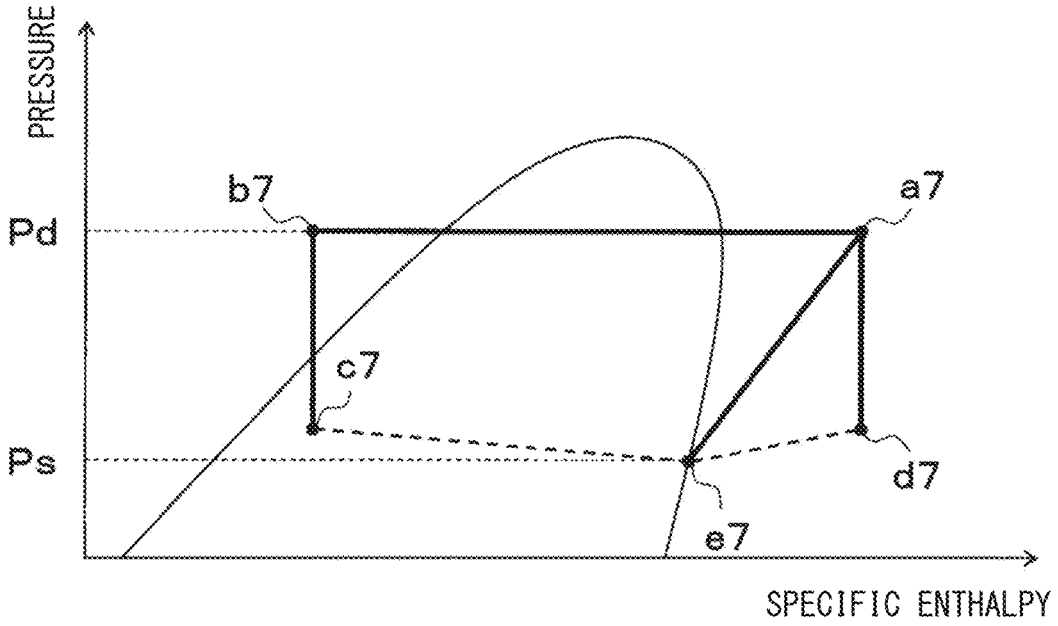
FIG. 7 is a Mollier chart showing a change in the state of the refrigerant in the hot-gas air-heating mode of the heat pump cycle according to the first embodiment.

Therefore, in the heat pump cycle 10 in the single hot-gas air-heating mode, the state of the refrigerant changes as illustrated in the Mollier chart of FIG. 7.

First, the flow of the discharge refrigerant (point a7 in FIG. 7) discharged from compressor 11 is branched at the first three-way joint 12*a*. One refrigerant branched at the first three-way joint 12*a* flows into the inside condenser 13 and radiates heat to the ventilation air (from point a7 to point b7 in FIG. 7). As a result, the ventilation air is heated.

The refrigerant flowing out of the inside condenser 13 flows into the dehumidifying passage 21*a*. The refrigerant flown into the dehumidifying passage 21*a* flows into the cooling expansion valve 14*c* and is decompressed (from point b7 to point c7 in FIG. 7).

The refrigerant decompressed by the cooling expansion valve 14*c* flows into the chiller 20. In the hot-gas air-heating mode, since the low-temperature side pump 41 is stopped, the chiller 20 does not exchange heat between the refrigerant and the low-temperature side heat medium. The refrigerant flowing out of the chiller 20 flows into the other inlet port of the sixth three-way joint 12*f*.

The other refrigerant branched at the first three-way joint 12*a* flows into the bypass passage 21*c*. The refrigerant flowing into the bypass passage 21*c* undergoes flow rate regulation and is decompressed by the bypass-side flow-rate regulating valve 14*d* (from point a7 to point d7 in FIG. 7). The refrigerant decompressed by the bypass-side flow-rate regulating valve 14*d* flows into one inlet port of the sixth three-way joint 12*f*.

The refrigerant flowing out of the chiller 20 and the refrigerant flowing out of the bypass-side flow-rate regulating valve 14*d* are joined and mixed at the sixth three-way joint 12*f*. The refrigerant flowing out of the sixth three-way joint 12*f* flows into the accumulator 23 via the fifth three-way joint 12*e* and the fourth three-way joint 12*d*.

The refrigerant flowing into the accumulator 23 is more homogeneously mixed (point e7 in FIG. 7). As a result, the quality Rx of the suction refrigerant approaches the reference quality KRx. The refrigerant flowing out of the accumulator 23 is sucked into the compressor 11 and compressed again.

As described above, in the heat pump cycle 10 in the hot-gas air-heating mode, refrigerants with different enthalpies, such as the low-enthalpy refrigerant flowing out of the chiller 20 (point c7 in FIG. 7) and the high-enthalpy refrigerant flowing out of the bypass passage 21*c* (point d7 in FIG. 7), are mixed and sucked into the compressor 11.

Therefore, in the heat pump cycle 10 in the hot-gas air-heating mode, the cooling expansion valve 14*c* serves as the heating-unit side decompression unit, and the sixth three-way joint 12*f* serves as the mixing portion.

In the heat pump cycle 10 in the hot-gas air-heating mode, regulating the throttle opening of the cooling expansion valve 14*c* in a manner that the degree of subcooling SC1 approaches the first target degree of subcooling SCO1 means controlling the cycle balance.

That is, in the hot-gas air-heating mode, by regulating the throttle opening of the cooling expansion valve 14*c* in a manner that the degree of subcooling SC1 approaches the first target degree of subcooling SCO1, the quality Rx of the suction refrigerant approaches the reference quality KRx. In other words, the state of the suction refrigerant is brought close to the gas-liquid two-phase refrigerant appropriately containing the liquid-phase refrigerant in which the refrigerant oil is dissolved.

In the hot-gas air-heating mode, the refrigerant discharge performance of the compressor 11 is controlled in a manner that the suction refrigerant pressure Ps approaches the first target low pressure PSO1. The workload of the compressor 11 is determined by the refrigerant discharge performance of the compressor 11. The discharge refrigerant pressure Pd is balanced with a pressure at which heat generated by the workload of the compressor 11 can be radiated by the inside condenser 13.

That is, in the heat pump cycle 10 in the hot-gas air-heating mode, the suction refrigerant pressure Ps is controlled by regulating the refrigerant discharge performance of the compressor 11. Furthermore, the discharge refrigerant pressure Pd is controlled by regulating the throttle opening of the cooling expansion valve 14*c* and the bypass-side flow-rate regulating valve 14*d*.

Therefore, in the hot-gas air-heating mode, the operation of at least one of the compressor 11, the cooling expansion valve 14*c*, or the bypass-side flow-rate regulating valve 14*d* is controlled in a manner that the ventilation air temperature TAV approaches the target air temperature TAO and the quality Rx of the suction refrigerant approaches the reference quality KRx.

In the inside air conditioning unit 50 in the single hot-gas air-heating mode, the ventilation air having passed through the inside evaporator 18 is heated by the inside condenser 13 and blown into the vehicle cabin. As a result, the air in the vehicle cabin is heated.

Here, the single hot-gas air-heating mode is an operation mode performed when the outside air temperature Tam is extremely low. Therefore, when the refrigerant flowing out of the inside condenser 13 flows into the outside heat exchanger 15, the refrigerant may radiate heat to the outside air in the outside heat exchanger 15. When the refrigerant radiates heat to the outside air in the outside heat exchanger 15, the amount of heat by which the refrigerant radiates to the ventilation air in the inside condenser 13 decreases, and the heating performance of the ventilation air decreases accordingly.

In the single hot-gas air-heating mode of the present embodiment, since the refrigerant circuit is switched to the refrigerant circuit that does not allow the refrigerant flowing out of the inside condenser 13 to flow into the outside heat exchanger 15, it is possible to prevent the refrigerant from radiating heat to the outside air in the outside heat exchanger 15.

In addition, the throttle opening of the cooling expansion valve 14*c* is changed in a manner that the degree of subcooling SC1 of the refrigerant flowing out of the inside condenser 13 approaches the first target degree of subcooling SCO1. As a result, even when the refrigerant discharge performance of the compressor 11 is increased and the amount of heat radiated from the discharge refrigerant to the ventilation air in the inside condenser 13 is increased, the state of the suction refrigerant can be brought close to an appropriate state.

Therefore, in the single hot-gas air-heating mode, even when the outside air temperature Tam is extremely low, the heat generated by the workload of the compressor 11 can be effectively used to heat the ventilation air, and the air in the vehicle cabin can be heated.

(d-2) Cooling Hot-Gas Air-Heating Mode

In the cooling hot-gas air-heating mode, the control device 60 operates the low-temperature side pump 41 of the low-temperature side heat medium circuit 40 so as to exhibit the predetermined reference pumping performance, as compared with the single hot-gas air-heating mode. Therefore, in the heat pump cycle 10 in the cooling hot-gas air-heating mode, the refrigerant flowing into the chiller 20 absorbs heat from the low-temperature side heat medium. As a result, the low-temperature side heat medium is cooled. The other operations are similar to those in the single hot-gas air-heating mode.

Therefore, in the cooling hot-gas air-heating mode, the heat generated by the workload of the compressor 11 can be effectively used to heat the ventilation air, and the air in the vehicle cabin can be heated, as in the single hot-gas air-heating mode. In the low-temperature side heat medium circuit 40 in the cooling hot-gas air-heating mode, the low-temperature side heat medium cooled by the chiller 20 flows through the cooling water passage 70*a* of the battery 70. As a result, the battery 70 can be cooled.

(e) Hot-Gas Dehumidification and Air-Heating Mode

The hot-gas dehumidification and air-heating mode is an operation mode in which the air in the vehicle cabin is dehumidified and heated. In the control program, the hot-gas dehumidification and air-heating mode is selected when the outside air temperature Tam is a temperature in a predetermined low to medium temperature range (equal to or higher than 0° C. and lower than 10° C. in the present embodiment).

Examples of the hot-gas dehumidification and air-heating mode include a single hot-gas dehumidification and air-heating mode and a cooling hot-gas dehumidification and air-heating mode. The single hot-gas dehumidification and air-heating mode is an operation mode in which the air in the vehicle cabin is dehumidified and heated without cooling the battery 70. The cooling hot-gas dehumidification and air-heating mode is an operation mode in which the battery 70 is cooled, and at the same time, the air in the vehicle cabin is dehumidified and heated.

(e-1) Single Hot-Gas Dehumidification and Air-Heating Mode

In the heat pump cycle 10 in the single hot-gas dehumidification and air-heating mode, the control device 60 brings the air-heating expansion valve 14*a* into the fully closed state, brings the air-cooling expansion valve 14*b* into the throttled state, brings the cooling expansion valve 14*c* into the throttled state, and brings the bypass-side flow-rate regulating valve 14*d* into the throttled state. The control device 60 opens the dehumidifying on-off valve 22*a* and closes the air-heating on-off valve 22*b*.

Figure 8:
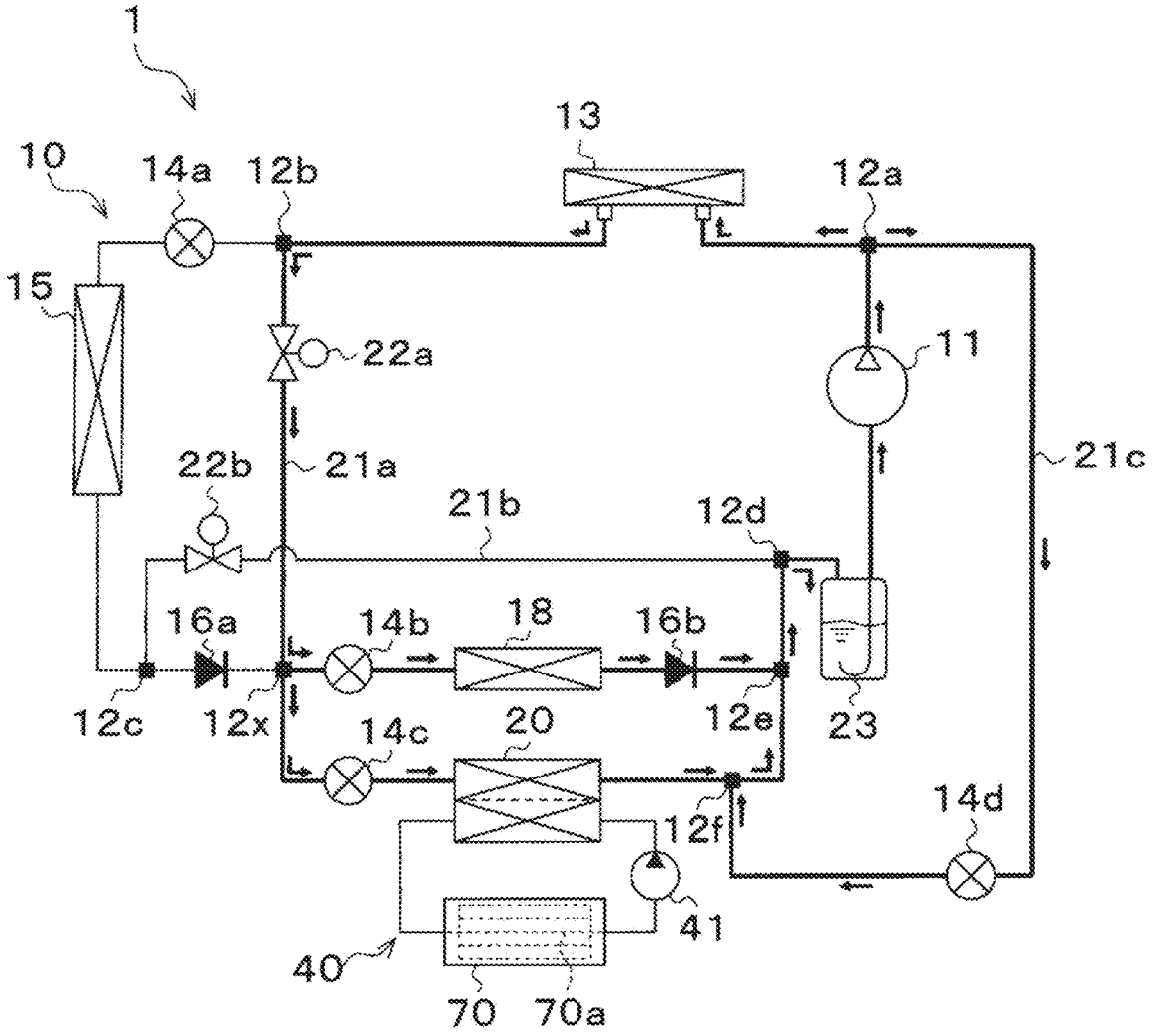
FIG. 8 is a schematic overall configuration diagram illustrating a flow of the refrigerant in a hot-gas dehumidification and air-heating mode of the heat pump cycle according to the first embodiment.

Therefore, in the heat pump cycle 10 in the single hot-gas dehumidification and air-heating mode, as indicated by the solid arrows in FIG. 8, the refrigerant discharged from the compressor 11 circulates similarly to the single hot-gas air-heating mode. At the same time, the refrigerant circuit is switched to a refrigerant circuit in which the refrigerant discharged from the compressor 11 circulates through the first three-way joint 12*a*, the inside condenser 13, the dehumidifying passage 21*a*, the four-way joint 12*x*, the air-cooling expansion valve 14*b* in the throttled state, the inside evaporator 18, the accumulator 23, and the suction port of the compressor 11 in this order. That is, the refrigerant circuit is switched to a refrigerant circuit in which the inside evaporator 18 and the chiller 20 are connected in parallel to the refrigerant flow.

Furthermore, the control device 60 controls the refrigerant discharge performance of the compressor 11 in a manner that the suction refrigerant pressure Ps approaches a predetermined second target low pressure PSO2. The second target low pressure PSO2 is determined in a manner that the refrigerant evaporating temperature in the inside evaporator 18 is a temperature at which the ventilation air can be dehumidified without causing frosting on the inside evaporator 18.

In addition, the control device 60 changes the throttle opening of the bypass-side flow-rate regulating valve 14*d* in a manner that the discharge refrigerant pressure Pd approaches the target high pressure PDO, as in the hot-gas air-heating mode.

The control device 60 changes the throttle opening of the air-cooling expansion valve 14*b* in a manner that the degree of subcooling SC1 of the refrigerant flowing out of the inside condenser 13 approaches the second target degree of subcooling SCO2. The second target degree of subcooling SCO2 is determined with reference to the control map stored in advance in the control device 60.

The control device 60 changes the throttle opening of the cooling expansion valve 14*c* in a manner that the quality Rx of the suction refrigerant approaches the reference quality KRx. The quality Rx of the suction refrigerant can be estimated using the evaporator temperature Tefin detected by the evaporator temperature sensor 62*c*, the evaporator-side refrigerant temperature Teout detected by the evaporator-outlet-port side refrigerant temperature sensor 62*d*, the suction refrigerant temperature Ts, the suction refrigerant pressure Ps, and the like.

Furthermore, in the heat pump cycle 10 in the hot-gas dehumidification and air-heating mode, the upper limit opening control is executed as in the hot-gas air-heating mode. Here, the throttle opening of the heating-unit side decompression unit in the hot-gas dehumidification and air-heating mode is the throttle opening of the cooling expansion valve 14*c*.

Furthermore, in the heat pump cycle 10 in the hot-gas dehumidification and air-heating mode, opening increase control is executed. The opening increase control is control of increasing the throttle opening of the air-cooling expansion valve 14*b* when the throttle opening of the cooling expansion valve 14*c* is equal to or larger than a predetermined reference increased opening (90% with respect to full open in the present embodiment) and the degree of superheating SH is equal to or larger than the upper limit degree of superheating KSHM (15° C. in the present embodiment).

The opening increase control will be described with reference to the flowchart of FIG. 9. The flowchart of FIG. 9 is control processing performed as a subroutine in step S5 when (e) hot-gas dehumidification and air-heating mode and (f) hot-gas series dehumidification and air-heating mode are selected in step S4 of the main routine in the control program.

Figure 9:
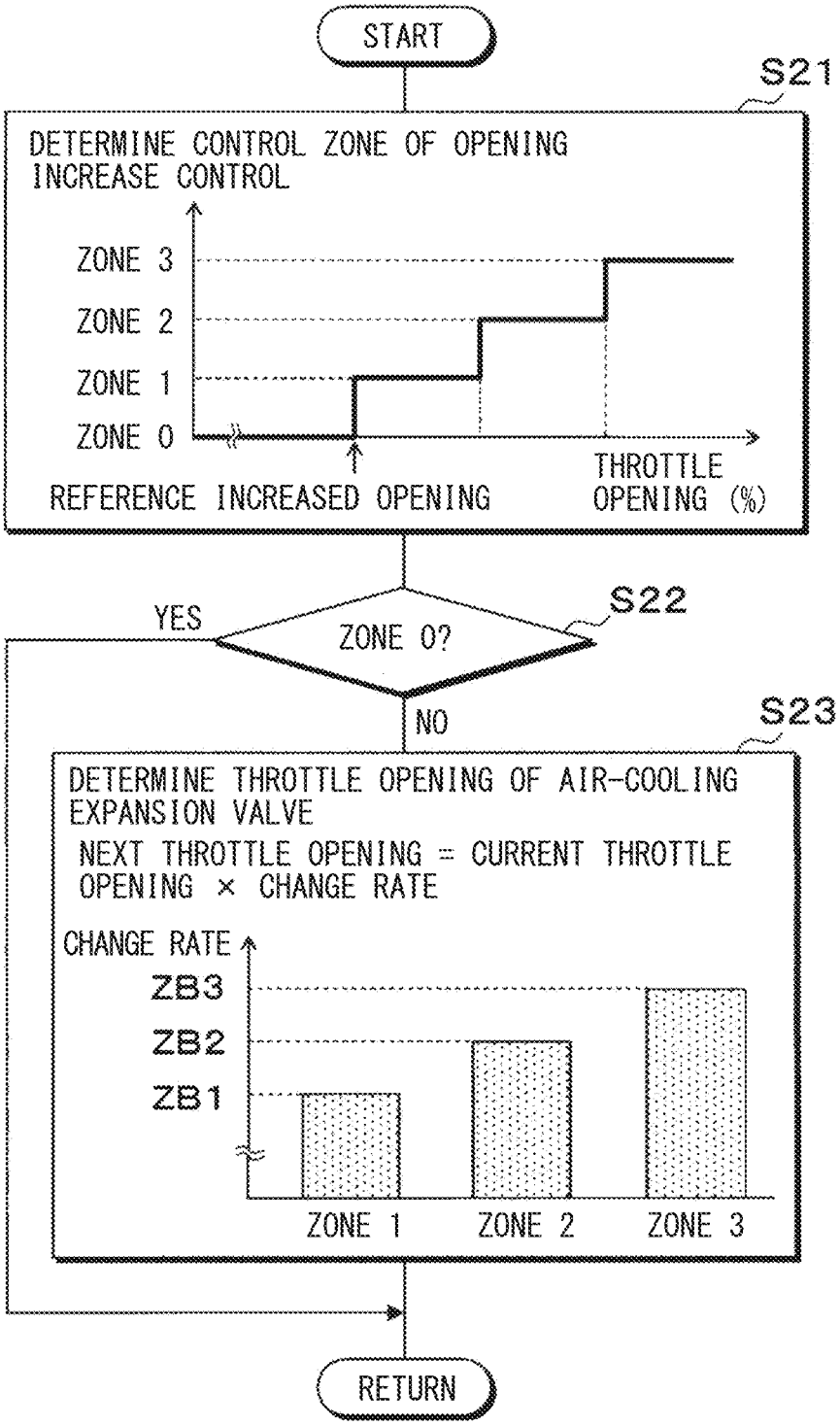
FIG. 9 is a flowchart of another subroutine of the control program according to the first embodiment.

First, in step S21 of FIG. 9, as illustrated in the control characteristic diagram described in step S21 of FIG. 9, a control zone of the opening increase control is determined.

Specifically, in the control characteristic diagram of the present embodiment, when the throttle opening of the cooling expansion valve 14*c* is less than the reference increased opening (90% in the present embodiment), the control zone is determined to be zone 0. When the throttle opening of the cooling expansion valve 14*c* is equal to or larger than the reference increased opening and the degree of superheating SH is equal to or larger than the upper limit degree of superheating KSHM, the control zone is determined in the order of zone 1, zone 2, and zone 3 as the throttle opening of the cooling expansion valve 14*c* increases.

Next, in step S22, it is determined whether or not the control zone determined in step S21 is zone 0. When it is determined in step S22 that the control zone is zone 0, the processing returns to the main routine. Therefore, when it is determined in step S22 that the control zone is zone 0, the throttle opening of the heating-unit side decompression unit is not increased. When it is determined in step S22 that the control zone is not zone 0, the processing proceeds to step S23.

In step S23, as illustrated in the control characteristic diagram described in step S23 of FIG. 9, the throttle opening of the air-cooling expansion valve 14*b* in the current control routine is determined using the change rate determined for each control zone.

A change rate ZB1 in the control characteristic diagram illustrated in step S23 is a value of 1 or more. A change rate ZB2 is a value larger than the change rate ZB1. A change rate ZB3 is a value larger than the change rate ZB2.

In zone 1, the throttle opening of the air-cooling expansion valve 14*b* is determined to be ZB1 times the throttle opening of the air-cooling expansion valve 14*b* in the previous control routine. Therefore, when the control zone is zone 1, it is prohibited to reduce the throttle opening of the air-cooling expansion valve 14*b* in the current control routine. When ZB1 is a value larger than 1, the throttle opening of the air-cooling expansion valve 14*b* is increased in the current control routine.

In zone 2, the throttle opening of the air-cooling expansion valve 14*b* is determined to be ZB2 times the throttle opening of the air-cooling expansion valve 14*b* in the previous control routine. Therefore, when the control zone is zone 2, the throttle opening of the air-cooling expansion valve 14*b* is increased in the current control routine. Furthermore, when the control zone is zone 2, the increase amount of the throttle opening of the air-cooling expansion valve 14*b* can be increased as compared with the case where the control zone is zone 1.

In zone 3, the throttle opening of the air-cooling expansion valve 14*b* is determined to be ZB3 times the throttle opening of the air-cooling expansion valve 14*b* in the previous control routine. Therefore, when the control zone is zone 3, the throttle opening of the air-cooling expansion valve 14*b* is increased in the current control routine. Furthermore, when the control zone is zone 3, the increase amount of the throttle opening of the air-cooling expansion valve 14*b* can be increased as compared with the case where the control zone is zone 2.

Therefore, in the opening increase control, when the throttle opening of the cooling expansion valve 14*c* is equal to or larger than the reference increased opening and the degree of superheating SH is equal to or larger than the upper limit degree of superheating KSHM, it is prohibited to reduce the throttle opening of the air-cooling expansion valve 14*b*.

In the low-temperature side heat medium circuit 40 in the single hot-gas dehumidification and air-heating mode, the control device 60 stops the low-temperature side pump 41.

In addition, in the inside air conditioning unit 50 in the single hot-gas dehumidification and air-heating mode, the control device 60 controls the ventilation performance of the interior blower 52, the opening of the air mix door 54, and the operations of the inside-air and outside-air switching device 53 and the blowing mode door, as in the single air-cooling mode. The control device 60 appropriately controls the operations of other control target devices.

Figure 10:
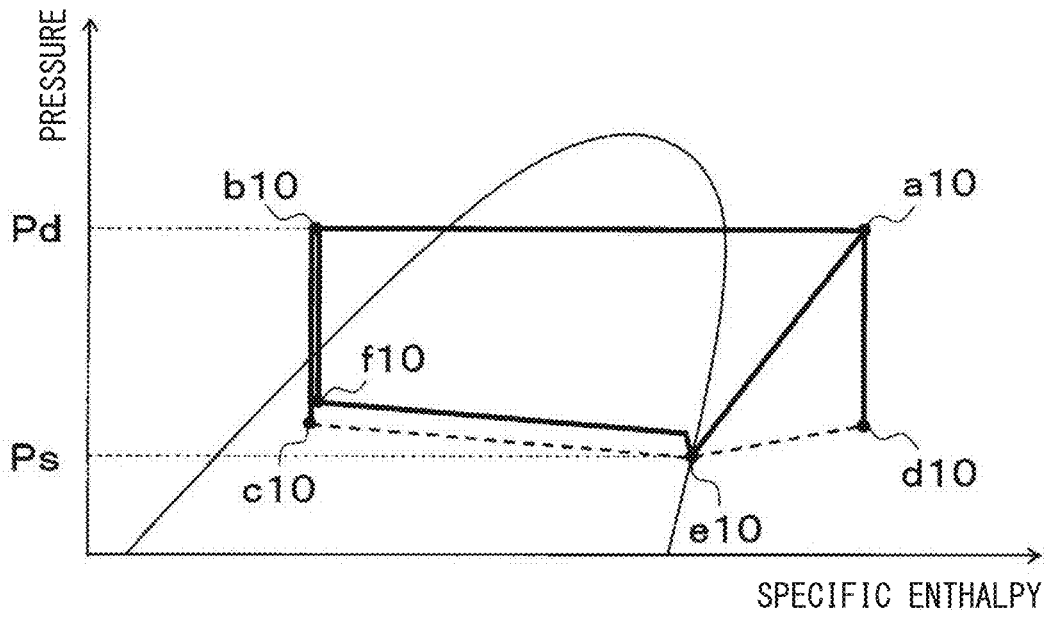
FIG. 10 is a Mollier chart showing a change in the state of the refrigerant in the hot-gas dehumidification and air-heating mode of the heat pump cycle according to the first embodiment.

Therefore, in the heat pump cycle 10 in the single hot-gas dehumidification and air-heating mode, the state of the refrigerant changes as illustrated in the Mollier chart of FIG. 10.

The flow of the discharge refrigerant (point a10 in FIG. 10) discharged from compressor 11 is branched at the first three-way joint 12*a*. One refrigerant branched at the first three-way joint 12*a* flows into the inside condenser 13 and radiates heat to the ventilation air (from point a10 to point b10 in FIG. 10). As a result, the ventilation air cooled and dehumidified by the inside evaporator 18 is reheated.

The refrigerant flowing out of the inside condenser 13 flows into the dehumidifying passage 21*a*. The flow of the refrigerant flowing into the dehumidifying passage 21*a* is branched at the four-way joint 12*x*. One refrigerant branched at the four-way joint 12*x* flows into the air-cooling expansion valve 14*b* and is decompressed (from point b10 to point f10 in FIG. 10).

The refrigerant decompressed by the air-cooling expansion valve 14*b* flows into the inside evaporator 18. The refrigerant flowing into the inside evaporator 18 exchanges heat with the ventilation air supplied by the interior blower 52 and evaporates. As a result, the ventilation air is cooled and dehumidified. The refrigerant flowing out of the inside evaporator 18 flows into one inlet port of the fifth three-way joint 12*e* via the second check valve 16*b*.

The other refrigerant branched at the four-way joint 12*x* flows into the cooling expansion valve 14*c* and is decompressed (from point b10 to point c10 in FIG. 10). The refrigerant decompressed by the cooling expansion valve 14*c* flows into the other inlet port of the sixth three-way joint 12*f* as in the hot-gas air-heating mode.

The other refrigerant branched at the first three-way joint 12*a* flows into the bypass passage 21*c*. The refrigerant flowing into the bypass passage 21*c* undergoes flow rate regulation and is decompressed by the bypass-side flow-rate regulating valve 14*d* (from point a10 to point d10 in FIG. 10), and flows into one inlet port of the sixth three-way joint 12*f*, as in the hot-gas air-heating mode.

The refrigerant flowing out of the chiller 20 and the refrigerant flowing out of the bypass-side flow-rate regulating valve 14*d* are joined and mixed at the sixth three-way joint 12*f*. The refrigerant flowing out of the sixth three-way joint 12*f* and the refrigerant flowing out of the inside evaporator 18 are joined and mixed at the fifth three-way joint 12*e*. The refrigerant flowing out of the fifth three-way joint 12*e* flows into the accumulator 23 via the fourth three-way joint 12*d*.

The refrigerant flowing into the accumulator 23 is more homogeneously mixed (point e10 in FIG. 10). As a result, the quality Rx of the suction refrigerant approaches the reference quality KRx. The refrigerant flowing out of the accumulator 23 is sucked into the compressor 11 and compressed again.

Here, in FIG. 10, the pressure of the refrigerant decompressed by the cooling expansion valve 14*c* (point c10 in FIG. 10) is indicated by a value lower than the pressure of the refrigerant decompressed by the air-cooling expansion valve 14*b* (point f10 in FIG. 10), but it is not limited thereto. The pressure of the refrigerant decompressed by the cooling expansion valve 14*c* may be higher than or equal to the pressure of the refrigerant decompressed by the air-cooling expansion valve 14*b*.

As described above, in the heat pump cycle 10 in the hot-gas dehumidification and air-heating mode, the refrigerant circuit is switched to a refrigerant circuit in which refrigerants with different enthalpies, such as the low-enthalpy refrigerant flowing out of the chiller 20 (point c12 in FIG. 10), the high-enthalpy refrigerant flowing out of the bypass passage 21*c* (point d12 in FIG. 10), and the refrigerant flowing out of the inside evaporator 18, are mixed and sucked into the compressor 11.

Therefore, in the heat pump cycle 10 in the hot-gas dehumidification and air-heating mode, the cooling expansion valve 14*c* serves as the heating-unit side decompression unit, and the sixth three-way joint 12*f* serves as the mixing portion. Furthermore, the four-way joint 12*x* serves as an auxiliary branch portion, the air-cooling expansion valve 14*b* serves as the auxiliary heating-unit side decompression unit, and the inside evaporator 18 serves as an evaporation unit.

In the heat pump cycle 10 in the hot-gas dehumidification and air-heating mode, by regulating the throttle opening of the air-cooling expansion valve 14*b* in a manner that the degree of subcooling SC1 approaches the second target degree of subcooling SCO2, the cycle balance is controlled. By regulating the throttle opening of the cooling expansion valve 14*c* in a manner that the quality Rx approaches the reference quality KRx, the state of the suction refrigerant is brought close to the gas-liquid two-phase refrigerant appropriately containing the liquid-phase refrigerant in which the refrigerant oil is dissolved.

In the hot-gas dehumidification and air-heating mode, the refrigerant discharge performance of the compressor 11 is controlled in a manner that the suction refrigerant pressure Ps approaches the second target low pressure PSO2. At this time, the refrigerant discharge performance of the compressor 11 is refrigerant discharge performance that allows the total flow rate (the mass flow rate) of the refrigerant flowing out of the inside evaporator 18, the refrigerant flowing out of the chiller 20, and the refrigerant flowing through the bypass passage 21*c* to flow.

The workload of the compressor 11 is determined by the refrigerant discharge performance of the compressor 11. The discharge refrigerant pressure Pd is balanced with a pressure at which both heat absorbed by the refrigerant in the inside evaporator 18 and heat generated by the workload of the compressor 11 can be radiated by the inside condenser 13.

That is, in the heat pump cycle 10 in the hot-gas dehumidification and air-heating mode, by regulating the refrigerant discharge performance of the compressor 11, the suction refrigerant pressure Ps is controlled. Furthermore, the discharge refrigerant pressure Pd is controlled by regulating throttle opening of the cooling expansion valve 14*c* and the bypass-side flow-rate regulating valve 14*d*.

Therefore, in the hot-gas dehumidification and air-heating mode, the operation of at least one of the compressor 11, the cooling expansion valve 14*c*, or the bypass-side flow-rate regulating valve 14*d* is controlled in a manner that the ventilation air temperature TAV approaches the target air temperature TAO and the quality Rx of the suction refrigerant approaches the reference quality KRx.

In the inside air conditioning unit 50 in the single hot-gas dehumidification and air-heating mode, the ventilation air cooled and dehumidified by the inside evaporator 18 is reheated by the inside condenser 13 and blown into the vehicle cabin. As a result, the air in the vehicle cabin is dehumidified and heated.

Here, the single hot-gas dehumidification and air-heating mode is an operation mode in which the ventilation air is cooled and dehumidified, and the dehumidified ventilation air is reheated to a desired temperature and blown into the vehicle cabin. For this reason, in the single hot-gas dehumidification and air-heating mode, it is necessary to regulate the workload of the compressor 11 in a manner that the temperature of the ventilation air can be reheated to a desired temperature by the heating unit without causing frosting on the inside evaporator 18.

In the single hot-gas dehumidification and air-heating mode of the present embodiment, the refrigerant with relatively high enthalpy flows into the mixing portion via the bypass passage 21*c*. Even when the refrigerant discharge performance of the compressor 11 is increased, it is possible to prevent the pressure of the suction refrigerant from decreasing. As a result, it is possible to increase the amount of heat radiated from the discharge refrigerant to the ventilation air in the inside condenser 13 without causing frosting on the inside evaporator 18.

Therefore, in the single hot-gas dehumidification and air-heating mode, the ventilation air can be heated with higher heating performance than in the series dehumidification and air-heating mode.

(e-2) Cooling Hot-Gas Dehumidification and Air-Heating Mode

In the cooling hot-gas dehumidification and air-heating mode, the control device 60 operates the low-temperature side pump 41 so as to exhibit the predetermined reference pumping performance, as compared with the single hot-gas dehumidification and air-heating mode. Therefore, in the heat pump cycle 10 in the cooling hot-gas dehumidification and air-heating mode, the refrigerant flowing into the chiller 20 absorbs heat from the low-temperature side heat medium. As a result, the low-temperature side heat medium is cooled. The other operations are similar to those in the single hot-gas dehumidification and air-heating mode.

Therefore, in the cooling hot-gas dehumidification and air-heating mode, the ventilation air is heated with higher heating performance than in the series dehumidification and air-heating mode, and the air in the vehicle cabin can be dehumidified and heated, as in the single hot-gas dehumidification and air-heating mode. In the low-temperature side heat medium circuit 40 in the cooling hot-gas dehumidification and air-heating mode, the low-temperature side heat medium cooled by the chiller 20 flows through the cooling water passage 70*a* of the battery 70. As a result, the battery 70 can be cooled.

(f) Hot-Gas Series Dehumidification and Air-Heating Mode

The hot-gas series dehumidification and air-heating mode is an operation mode in which the air in the vehicle cabin is dehumidified and heated. In the control program, the hot-gas series dehumidification and air-heating mode is selected when it is determined that the heating performance of the ventilation air in the inside condenser 13 is insufficient in the series dehumidification and air-heating mode.

Examples of the hot-gas series dehumidification and air-heating mode include a single hot-gas series dehumidification and air-heating mode and a cooling hot-gas series dehumidification and air-heating mode. The single hot-gas series dehumidification and air-heating mode is an operation mode in which the air in the vehicle cabin is dehumidified and heated without cooling the battery 70. The cooling hot-gas series dehumidification and air-heating mode is an operation mode in which the battery 70 is cooled, and at the same time, the air in the vehicle cabin is dehumidified and heated.

(f-1) Single Hot-Gas Series Dehumidification and Air-Heating Mode

In the heat pump cycle 10 in the single hot-gas series dehumidification and air-heating mode, the control device 60 brings the air-heating expansion valve 14*a* into the throttled state, brings the air-cooling expansion valve 14*b* into the throttled state, brings the cooling expansion valve 14*c* into the throttled state, and brings the bypass-side flow-rate regulating valve 14*d* into the throttled state. In addition, the control device 60 closes the dehumidifying on-off valve 22*a* and also closes the air-heating on-off valve 22*b*.

Figure 11:
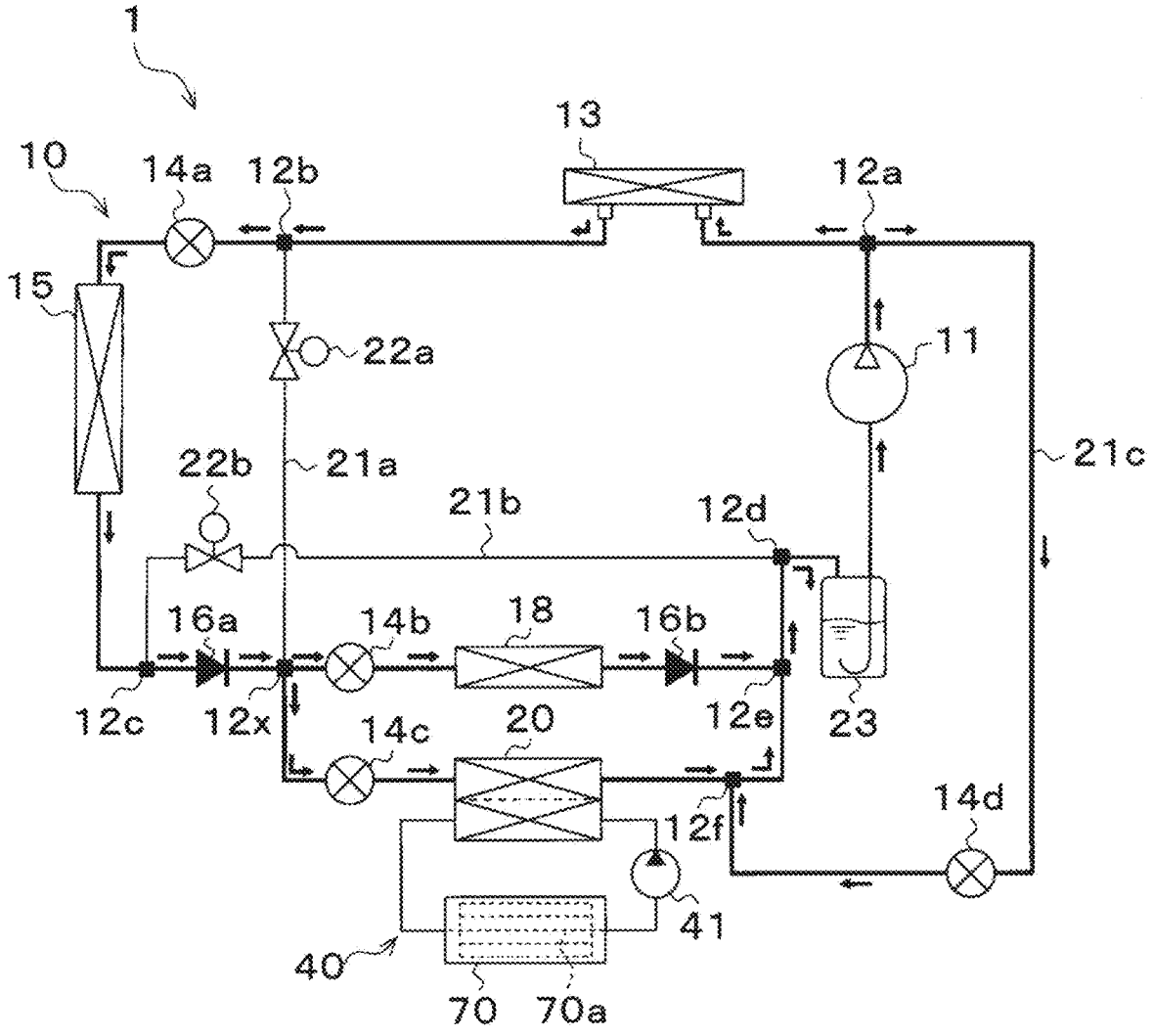
FIG. 11 is a schematic overall configuration diagram illustrating a flow of the refrigerant in a hot-gas series dehumidification and air-heating mode of the heat pump cycle according to the first embodiment.

Therefore, in the heat pump cycle 10 in the single hot-gas series dehumidification and air-heating mode, as indicated by the solid arrows in FIG. 11, the refrigerant discharged from the compressor 11 circulates similarly to the cooling series dehumidification and air-heating mode. At the same time, the refrigerant circuit is switched to a refrigerant circuit in which the refrigerant discharged from the compressor 11 circulates through the first three-way joint 12*a*, the bypass-side flow-rate regulating valve 14*d* in the throttled state, which is disposed in the bypass passage 21*c*, the sixth three-way joint 12*f*, the accumulator 23, and the suction port of the compressor 11 in this order.

Furthermore, the control device 60 controls the refrigerant discharge performance of the compressor 11 in a manner that the suction refrigerant pressure Ps approaches the predetermined second target low pressure PSO2, as in the hot-gas dehumidification and air-heating mode.

In addition, the control device 60 changes the throttle opening of the bypass-side flow-rate regulating valve 14*d* in a manner that the discharge refrigerant pressure Pd approaches the target high pressure PDO, as in the hot-gas air-heating mode.

The control device 60 changes the throttle opening of the air-heating expansion valve 14*a* and the air-cooling expansion valve 14*b*, as in the series dehumidification and air-heating mode.

The control device 60 changes the throttle opening of the cooling expansion valve 14*c* in a manner that the quality Rx of the suction refrigerant approaches the reference quality KRx, as in the hot-gas dehumidification and air-heating mode.

Furthermore, in the heat pump cycle 10 in the hot-gas series dehumidification and air-heating mode, the upper limit opening control is executed as in the hot-gas air-heating mode. The throttle opening of the heating-unit side decompression unit in the hot-gas series dehumidification and air-heating mode is the total throttle opening calculated from the sum of the passage resistance in the air-heating expansion valve 14*a* and the passage resistance in the cooling expansion valve 14*c*.

In addition, in the heat pump cycle 10 in the hot-gas series dehumidification and air-heating mode, the opening increase control is executed as in the hot-gas dehumidification and air-heating mode.

In the low-temperature side heat medium circuit 40 in the single hot-gas dehumidification and air-heating mode, the control device 60 stops the low-temperature side pump 41.

In addition, in the inside air conditioning unit 50 in the single hot-gas dehumidification and air-heating mode, the control device 60 controls the ventilation performance of the interior blower 52, the opening of the air mix door 54, and the operations of the inside-air and outside-air switching device 53 and the blowing mode door, as in the single air-cooling mode. The control device 60 appropriately controls the operations of other control target devices.

Figure 12:
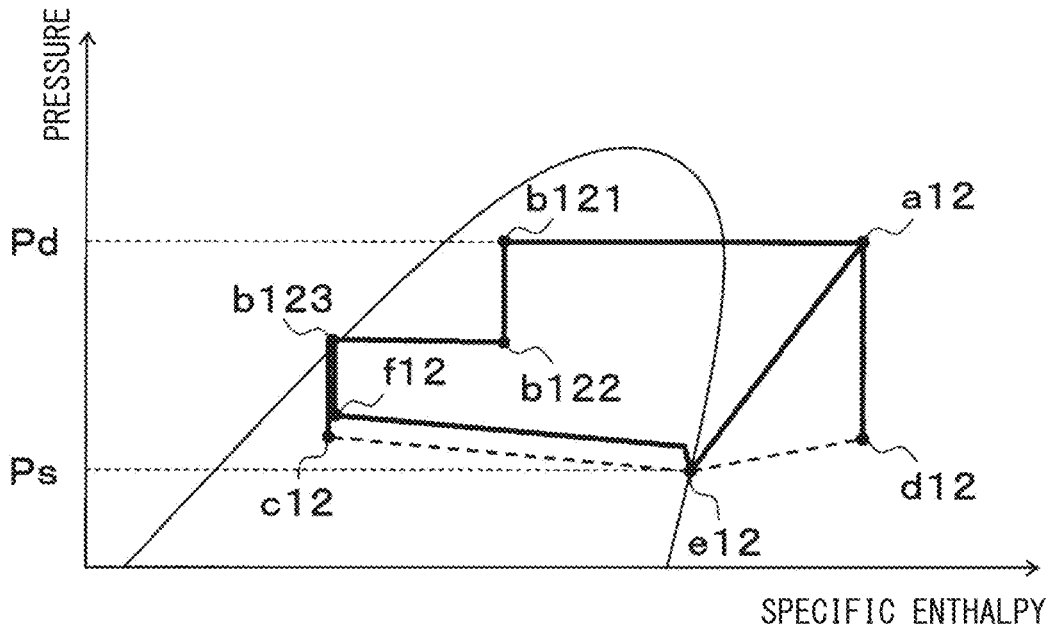
FIG. 12 is a Mollier chart showing a change in the state of the refrigerant in the hot-gas series dehumidification and air-heating mode of the heat pump cycle according to the first embodiment.

Therefore, in the heat pump cycle 10 in the single hot-gas series dehumidification and air-heating mode, the state of the refrigerant changes as illustrated in the Mollier chart of FIG. 12. FIG. 12 illustrates an example in which the saturation temperature of the refrigerant in the outside heat exchanger 15 is higher than the outside air temperature Tam.

The flow of the discharge refrigerant (point a12 in FIG. 12) discharged from compressor 11 is branched at the first three-way joint 12*a*. One refrigerant branched at the first three-way joint 12*a* flows into the inside condenser 13 and radiates heat to the ventilation air (from point a12 to point b121 in FIG. 12). As a result, the ventilation air cooled and dehumidified by the inside evaporator 18 is reheated.

The refrigerant flowing out of the inside condenser 13 flows into the air-heating expansion valve 14*a* and is decompressed (from point b121 to point b122 in FIG. 12). The refrigerant decompressed by the air-heating expansion valve 14*a* flows into the outside heat exchanger 15. In the example illustrated in FIG. 12, the refrigerant flowing into the outside heat exchanger 15 exchanges heat with the outside air to reduce the enthalpy (from point b122 to point b123 in FIG. 12).

The flow of the refrigerant flowing from the outside heat exchanger 15 is branched at the four-way joint 12*x*. One refrigerant branched at the four-way joint 12*x* flows into the air-cooling expansion valve 14*b* and is decompressed (from point b123 to point f12 in FIG. 12).

The refrigerant decompressed by the air-cooling expansion valve 14*b* flows into the inside evaporator 18, exchanges heat with the ventilation air supplied by the interior blower 52, and evaporates (from point f12 to point e12 in FIG. 12), as in the hot-gas dehumidification and air-heating mode. As a result, the ventilation air is cooled and dehumidified. The refrigerant flowing out of the inside evaporator 18 flows into one inlet port of the fifth three-way joint 12*e* via the second check valve 16*b*.

The other refrigerant branched at the four-way joint 12*x* flows into the cooling expansion valve 14*c*, is decompressed (from point b123 to point c12 in FIG. 12), and flows into the other inlet port of the sixth three-way joint 12*f*, as in the hot-gas air-heating mode.

The other refrigerant branched at the first three-way joint 12*a* flows into the bypass passage 21*c*. The refrigerant flowing into the bypass passage 21*c* undergoes flow rate regulation and is decompressed by the bypass-side flow-rate regulating valve 14*d* (from point a12 to point d12 in FIG. 12), as in the hot-gas air-heating mode. The refrigerant decompressed by the bypass-side flow-rate regulating valve 14*d* flows into one inlet port of the sixth three-way joint 12*f*.

The refrigerant flowing out of the sixth three-way joint 12*f* flows into the other inlet port of the fifth three-way joint 12*e*. The refrigerant flowing out of the fifth three-way joint 12*e* flows into the accumulator 23. The refrigerant flowing into the accumulator 23 is more homogeneously mixed (point e12 in FIG. 12). The refrigerant flowing out of the accumulator 23 is sucked into the compressor 11 and compressed again.

Here, in FIG. 12, the pressure of the refrigerant decompressed by the cooling expansion valve 14*c* (point c12 in FIG. 12) is indicated by a value lower than the pressure of the refrigerant decompressed by the air-cooling expansion valve 14*b* (point f12 in FIG. 12), but it is not limited thereto. The pressure of the refrigerant decompressed by the cooling expansion valve 14*c* may be higher than or equal to the pressure of the refrigerant decompressed by the air-cooling expansion valve 14*b*.

As described above, in the heat pump cycle 10 in the hot-gas series dehumidification and air-heating mode, the refrigerant circuit is switched to a refrigerant circuit in which refrigerants with different enthalpies, such as the low-enthalpy refrigerant flowing out of the chiller 20 (point c12 in FIG. 12), the high-enthalpy refrigerant flowing out of the bypass passage 21*c* (point d12 in FIG. 12), and the refrigerant flowing out of the inside evaporator 18, are mixed and sucked into the compressor 11.

Therefore, in the hot-gas series dehumidification and air-heating mode, the air-heating expansion valve 14*a* and the cooling expansion valve 14*c* serve as the heating-unit side decompression unit, and the sixth three-way joint 12*f* serves as the mixing portion. Furthermore, the four-way joint 12*x* serves as the auxiliary branch portion, the air-cooling expansion valve 14*b* serves as the auxiliary heating-unit side decompression unit, and the inside evaporator 18 serves as the evaporation unit.

In the heat pump cycle 10 in the hot-gas series dehumidification and air-heating mode, the cycle balance is controlled by regulating the throttle opening of the air-heating expansion valve 14*a* and the cooling expansion valve 14*c*. The other configurations are similar to those in the hot-gas dehumidification and air-heating mode.

That is, in the hot-gas series dehumidification and air-heating mode of the present embodiment, by regulating the refrigerant discharge performance of the compressor 11, the suction refrigerant pressure Ps is controlled. Furthermore, the discharge refrigerant pressure Pd is controlled by regulating the throttle opening of the air-heating expansion valve 14*a*, the cooling expansion valve 14*c*, and the bypass-side flow-rate regulating valve 14*d*.

Therefore, in the hot-gas series dehumidification and air-heating mode, the operation of at least one of the compressor 11, the cooling expansion valve 14*c*, or the bypass-side flow-rate regulating valve 14*d* is controlled in a manner that the ventilation air temperature TAV approaches the target air temperature TAO and the quality Rx of the suction refrigerant approaches the reference quality KRx.

In the inside air conditioning unit 50 in the single hot-gas series dehumidification and air-heating mode, the ventilation air cooled and dehumidified by the inside evaporator 18 is reheated by the inside condenser 13 and blown into the vehicle cabin. As a result, the air in the vehicle cabin is dehumidified and heated.

In the hot-gas series dehumidification and air-heating mode, it is necessary to regulate the refrigerant discharge performance of the compressor 11 in a manner that the heating unit can reheat the ventilation air to a desired temperature without causing frosting on the inside evaporator 18, as in the hot-gas dehumidification and air-heating mode.

In the single hot-gas series dehumidification and air-heating mode of the present embodiment, the refrigerant with relatively high enthalpy flows into the mixing portion via the bypass passage 21*c*. Therefore, it is possible to increase the amount of heat radiated from the discharge refrigerant to the ventilation air in the inside condenser 13 without causing frosting on the inside evaporator 18, as in the single hot-gas series dehumidification and air-heating mode.

As a result, in the single hot-gas series dehumidification and air-heating mode, the ventilation air can be heated with higher heating performance than in the series dehumidification and air-heating mode.

(f-2) Cooling Hot-Gas Series Dehumidification and Air-Heating Mode

In the cooling hot-gas series dehumidification and air-heating mode, the control device 60 operates the low-temperature side pump 41 so as to exhibit the predetermined reference pumping performance, as compared with the single hot-gas series dehumidification and air-heating mode. Therefore, in the heat pump cycle 10 in the cooling hot-gas series dehumidification and air-heating mode, the refrigerant flowing into the chiller 20 absorbs heat from the low-temperature side heat medium. As a result, the low-temperature side heat medium is cooled. The other operations are similar to those in the single hot-gas series dehumidification and air-heating mode.

Therefore, in the cooling hot-gas series dehumidification and air-heating mode, the ventilation air is heated with higher heating performance than in the series dehumidification and air-heating mode, and the air in the vehicle cabin can be dehumidified and heated, as in the single hot-gas series dehumidification and air-heating mode. In the low-temperature side heat medium circuit 40 in the cooling hot-gas dehumidification and air-heating mode, the low-temperature side heat medium cooled by the chiller 20 flows through the cooling water passage 70*a* of the battery 70. As a result, the battery 70 can be cooled.

As described above, in the vehicle air conditioner 1 of the present embodiment, by switching the operation mode, comfortable air conditioning in the vehicle cabin and appropriate temperature regulation of the battery 70, which is an in-vehicle device, can be performed.

In the heat pump cycle 10 in (d) hot-gas air-heating mode, (e) hot-gas dehumidification and air-heating mode, and (f) hot-gas series dehumidification and air-heating mode, the refrigerant circuit is switched to a refrigerant circuit in which refrigerants with different enthalpies are mixed and sucked into the compressor 11.

In these operation modes, it is necessary to appropriately regulate the workload of the compressor in a manner that the ventilation air can be appropriately heated. At the same time, it is necessary to appropriately regulate the throttle opening of the heating-unit side decompression unit and the bypass-side flow-rate regulating valve in a manner that the state of the suction refrigerant sucked into the compressor 11 is in an appropriate state.

This is because if the state of the suction refrigerant is not maintained in an appropriate state, the durable life of the compressor 11 is adversely affected. For example, if the suction refrigerant is a gas-liquid two-phase refrigerant with a quality Rx lower than necessary, liquid compression of the compressor 11 may be caused. If the suction refrigerant is a gas-phase refrigerant with a degree of superheating SH higher than necessary, the temperature of the compressor 11 may abnormally increase.

Therefore, in the vehicle air conditioner 1 of the present embodiment, in the operation modes described above, the operations of the compressor 11, the cooling expansion valve 14*c*, and the bypass-side flow-rate regulating valve 14*d* are controlled in a manner that the ventilation air temperature TAV approaches the target air temperature TAO and the quality Rx of the suction refrigerant approaches the reference quality KRx.

However, in the actual heat pump cycle 10, the flow rate regulation range of the refrigerant in the heating-unit side decompression unit is different from the flow rate regulation range of the refrigerant in the bypass-side flow-rate regulating valve 14*d*. Therefore, if the throttle opening of one of the heating-unit side decompression unit and the bypass-side flow-rate regulating valve 14*d* approaches a fully open state and the flow rate regulating performance decreases, there is a possibility that the state of the suction refrigerant cannot be maintained in an appropriate state.

For example, the refrigerant path from the first three-way joint 12*a* via the inside condenser 13, the dehumidifying on-off valve 22*a*, the cooling expansion valve 14*c*, and the chiller 20 to the sixth three-way joint 12*f* is defined as a first refrigerant path. The refrigerant path from the first three-way joint 12*a* via the bypass-side flow-rate regulating valve 14*d* disposed in the bypass passage 21*c* to the sixth three-way joint 12*f* is defined as a second refrigerant path. In addition, the refrigerant path from the first three-way joint 12*a* via the inside condenser 13, the air-heating expansion valve 14*a*, the outside heat exchanger 15, the first check valve 16*a*, and the chiller 20 to the sixth three-way joint 12*f* is defined as a third refrigerant path.

The inside condenser 13 and the chiller 20 are arranged in the first refrigerant path. Therefore, as the pressure loss generated in the refrigerant flowing through the inside condenser 13 and the chiller 20 increases, the heating-unit side longitudinal differential pressure obtained by subtracting the refrigerant pressure on the downstream side of the heating-unit side decompression unit from the refrigerant pressure on the upstream side of the heating-unit side decompression unit decreases. On the other hand, the second refrigerant path does not include a configuration of reducing the bypass-side longitudinal differential pressure obtained by subtracting the refrigerant pressure on the downstream side of the bypass-side flow-rate regulating valve 14*d* from the refrigerant pressure on the upstream side of the bypass-side flow-rate regulating valve 14*d*.

Therefore, in (d) hot-gas air-heating mode, the flow rate regulation range of the refrigerant in the heating-unit side decompression unit tends to be narrower than the flow rate regulation range of the refrigerant in the bypass-side flow-rate regulating valve 14*d*. As a result, the flow rate regulating performance of the heating-unit side decompression unit may be lower than the flow rate regulating performance of the bypass-side flow-rate regulating valve 14*d*.

In the operation mode of dehumidifying the ventilation air, a part of the refrigerant flowing out of the inside condenser 13 needs to flow from the four-way joint 12*x* to the side of the inside evaporator 18. At this time, the flow rate of the refrigerant flowing into the inside evaporator 18 is determined by a heat exchange load with the ventilation air. Therefore, the flow rate of the refrigerant flowing from the four-way joint 12*x* to the side of the chiller 20 is limited.

Therefore, in (e) hot-gas dehumidification and air-heating mode and (f) hot-gas series dehumidification and air-heating mode, the flow rate regulation range of the refrigerant in the heating-unit side decompression unit is narrower than the flow rate regulation range of the refrigerant in the bypass-side flow-rate regulating valve 14*d*. As a result, the flow rate regulating performance of the heating-unit side decompression unit may be lower than the flow rate regulating performance of the bypass-side flow-rate regulating valve 14*d*.

The inside condenser 13, the outside heat exchanger 15, the first check valve 16*a*, and the chiller 20 are arranged in the third refrigerant path. Therefore, as the pressure loss generated in the refrigerant flowing through the inside condenser 13, the outside heat exchanger 15, the first check valve 16*a*, and the chiller 20 increases, the heating-unit side longitudinal differential pressure decreases. On the other hand, the second refrigerant path does not include a configuration for reducing the bypass-side longitudinal differential pressure.

Furthermore, in (f) hot-gas series dehumidification and air-heating mode, the pressure of the refrigerant in the outside heat exchanger 15 is regulated to regulate the heating performance of the ventilation air in the inside condenser 13. That is, in (f) hot-gas series dehumidification and air-heating mode, the pressure of the refrigerant in the outside heat exchanger 15 is lower than the pressure of the refrigerant in the inside condenser 13.

Therefore, in (f) hot-gas series dehumidification and air-heating mode, the longitudinal differential pressure of the air-cooling expansion valve 14*b* is smaller and the flow rate regulation range of the air-cooling expansion valve 14*b* is narrower than those in (d) hot-gas air-heating mode and (e) hot-gas dehumidification and air-heating mode.

Therefore, in (f) hot-gas series dehumidification and air-heating mode, the flow rate regulation range of the refrigerant in the heating-unit side decompression unit is narrower than the flow rate regulation range of the refrigerant in the bypass-side flow-rate regulating valve 14*d*. As a result, the flow rate regulating performance of the heating-unit side decompression unit may be lower than the flow rate regulating performance of the bypass-side flow-rate regulating valve 14*d*.

Furthermore, according to the study of the present inventors, in order to regulate the heating performance of the ventilation air while changing the refrigerant discharge performance of the compressor 11, it may be necessary to simultaneously increase the throttle opening of both the cooling expansion valve 14*c* and the bypass-side flow-rate regulating valve 14*d*.

That is, in (d) hot-gas air-heating mode, (e) hot-gas dehumidification and air-heating mode, and (f) hot-gas series dehumidification and air-heating mode of the present embodiment, the throttle opening of the bypass-side flow-rate regulating valve 14*d* may be increased even when it is difficult to increase the flow rate of the refrigerant flowing from the heating-unit side decompression unit side into the sixth three-way joint 12*f*. As a result, the suction refrigerant may become a gas-phase refrigerant with a degree of superheating SH higher than necessary.

In (d) hot-gas air-heating mode, (e) hot-gas dehumidification and air-heating mode, and (f) hot-gas series dehumidification and air-heating mode of the present embodiment, the upper limit opening control is executed.

According to this, when the throttle opening of the heating-unit side decompression unit is equal to or larger than the reference limit opening, the throttle opening of the bypass-side flow-rate regulating valve 14*d* can be made equal to or less than the upper limit opening. That is, when it is difficult to increase the flow rate of the refrigerant with a lower enthalpy flowing from the heating-unit side decompression unit side into the sixth three-way joint 12*f*, it is possible to limit the flow rate of the refrigerant with a higher enthalpy flowing from the side of the bypass-side flow-rate regulating valve 14*d* into the sixth three-way joint 12*f*.

It is thus possible to prevent the suction refrigerant from becoming a gas-phase refrigerant with a degree of superheating SH higher than necessary. As a result, even in a heat pump cycle device in which refrigerants with different enthalpies are mixed and sucked into the compressor 11, the compressor 11 can be reliably protected.

Since the refrigerant flowing through the second refrigerant path is in the gas phase, the pressure loss generated in the refrigerant flowing through the second refrigerant path may be larger than the pressure loss generated in the refrigerant flowing through the first refrigerant path. For example, in a heat pump cycle device employing a pipe thinner than other pipes as the bypass passage 21*c*, the pressure loss generated in the refrigerant flowing through the second refrigerant path tends to be larger than the pressure loss generated in the refrigerant flowing through the first refrigerant path.

Similarly, the pressure loss generated in the refrigerant flowing through the second refrigerant path may be larger than the pressure loss generated in the refrigerant flowing through the third refrigerant path.

In this case, the flow rate regulating performance of the bypass-side flow-rate regulating valve 14*d* may be lower than the flow rate regulating performance of the heating-unit side decompression unit. That is, even when it is difficult to increase the flow rate of the refrigerant flowing from the side of the bypass-side flow-rate regulating valve 14*d* into the sixth three-way joint 12*f*, there is a possibility that the throttle opening of the heating-unit side decompression unit may be increased. As a result, the suction refrigerant may become a gas-liquid two-phase refrigerant with a degree of quality Rx lower than necessary.

In (d) hot-gas air-heating mode, (e) hot-gas dehumidification and air-heating mode, and (f) hot-gas series dehumidification and air-heating mode of the present embodiment, the upper limit opening control is executed.

According to this, when the throttle opening of the bypass-side flow-rate regulating valve 14*d* is equal to or larger than the reference limit opening, the throttle opening of the heating-unit side decompression unit can be made equal to or less than the upper limit opening. That is, when it is difficult to increase the flow rate of the refrigerant with a higher enthalpy flowing from the side of the bypass-side flow-rate regulating valve 14*d* into the sixth three-way joint 12*f*, it is possible to limit the flow rate of the refrigerant with a lower enthalpy flowing from the heating-unit side decompression unit side into the sixth three-way joint 12*f*.

As a result, it is possible to prevent the suction refrigerant from becoming a gas-liquid two-phase refrigerant with a quality Rx lower than necessary. As a result, even in the heat pump cycle device in which refrigerants with different enthalpies are mixed and sucked into the compressor 11, the compressor 11 can be reliably protected.

That is, in the vehicle air conditioner 1 of the present embodiment, by executing the upper limit opening control, even when refrigerants with different enthalpies are mixed and sucked into the compressor 11, the state of the suction refrigerant can be maintained in an appropriate state, and the compressor 11 can be reliably protected.

Furthermore, in the upper limit opening control of the present embodiment, when the throttle opening of one of the heating-unit side decompression unit and the bypass-side flow-rate regulating valve 14*d* is equal to or larger than the reference limit opening, it is determined that the flow rate regulating performance of the one is equal to or less than the reference regulating performance. According to this, it is possible to easily and accurately estimate the flow rate regulating performance of one variable throttle mechanism using the throttle opening.

In the upper limit opening control of the present embodiment, as the throttle opening of one of the heating-unit side decompression unit and the bypass-side flow-rate regulating valve 14*d* increases, the upper limit opening of the other throttle opening is set to a low value. According to this, as it becomes difficult to increase the flow rate of the refrigerant flowing from one variable throttle mechanism into the sixth three-way joint 12*f*, the upper limit opening of the other variable throttle mechanism can be set to a low value. Therefore, the compressor 11 can be more reliably protected.

In (e) hot-gas dehumidification and air-heating mode and (f) hot-gas series dehumidification and air-heating mode of the present embodiment, the opening increase control is executed.

According to this, when it is difficult to increase the flow rate of the refrigerant with low enthalpy flowing from the side of the cooling expansion valve 14*c* into the sixth three-way joint 12*f*, the flow rate of the refrigerant with relatively low enthalpy can be joined to the suction refrigerant via the air-cooling expansion valve 14*b* and the inside evaporator 18. As a result, it is possible to effectively prevent the degree of superheating SH of the suction refrigerant from becoming higher than necessary.

Here, in the vehicle air conditioner 1 of the present embodiment, the example has been described in which the first target degree of subcooling SCO1 is determined in a manner that the quality Rx of the suction refrigerant approaches the reference quality KRx in (d) hot-gas air-heating mode, but it is not limited thereto. In (d) hot-gas air-heating mode, the first target degree of subcooling SCO1 may be determined in a manner that the degree of superheating SH of the suction refrigerant approaches a predetermined reference degree of superheating KSH.

Similarly, in (e) hot-gas dehumidification and air-heating mode and (f) hot-gas series dehumidification and air-heating mode, the throttle opening of the cooling expansion valve 14*c* may be changed in a manner that the degree of superheating SH of the suction refrigerant approaches the reference degree of superheating KSH.

Therefore, in the vehicle air conditioner 1 of the present embodiment, the compressor 11 can be reliably protected even when the operation of at least one of the compressor 11, the heating-unit side decompression unit, or the bypass-side flow-rate regulating valve 14*d* is controlled in a manner that the ventilation air temperature TAV approaches the target air temperature TAO and the degree of superheating SH of the suction refrigerant approaches the reference degree of superheating KSH.

Second Embodiment

Figure 13:
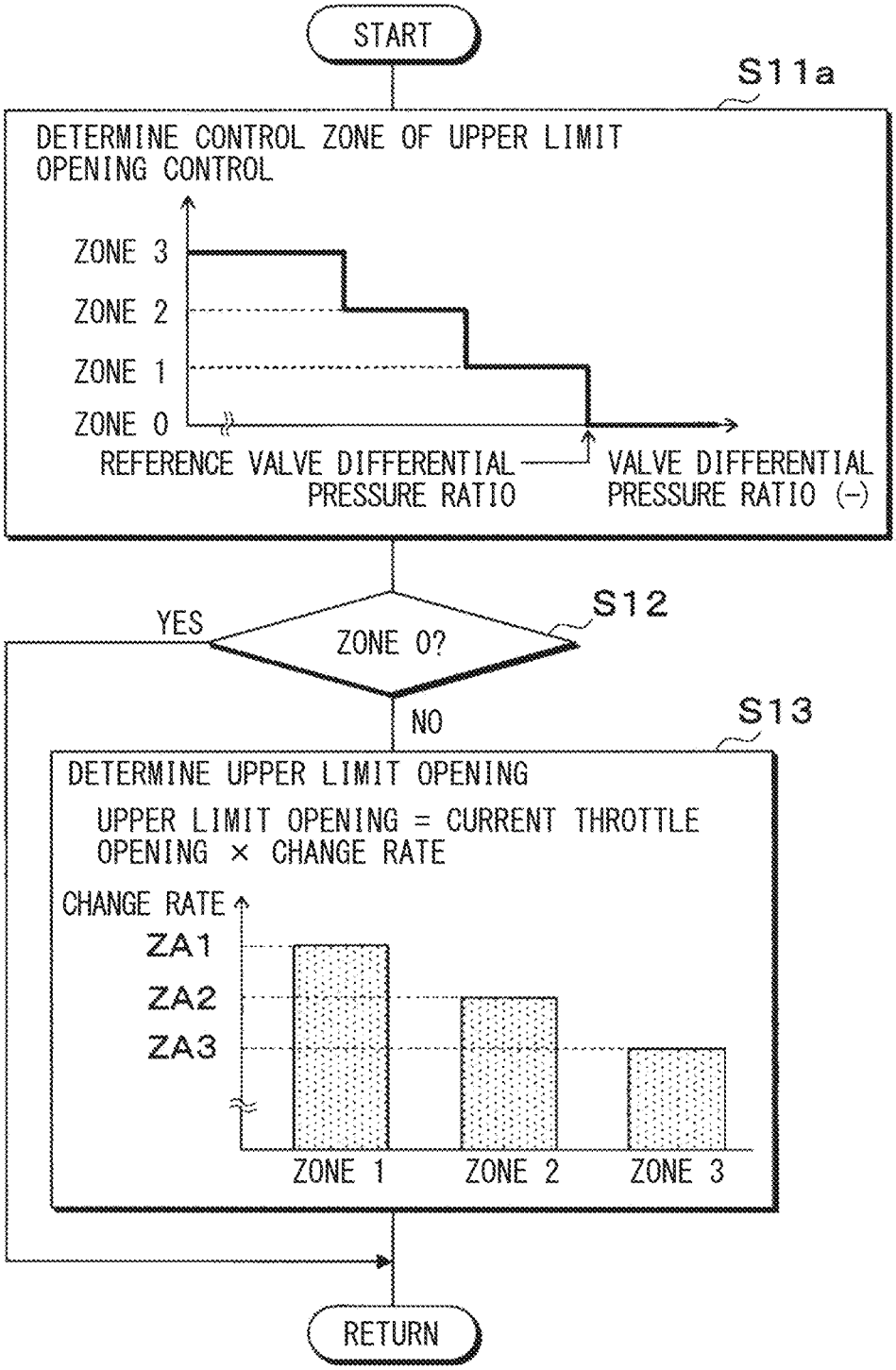
FIG. 13 is a flowchart of a subroutine of a control program according to a second embodiment.

In the present embodiment, an example in which the control mode of the upper limit opening control is changed from that of the first embodiment will be described. The upper limit opening control of the present embodiment will be described with reference to the flowchart of FIG. 13. FIG. 13 illustrates control processing corresponding to FIG. 6 described in the first embodiment.

First, in step S11*a* of the present embodiment, a control zone of the upper limit opening control is determined using a valve differential pressure ratio. The valve differential pressure ratio is a ratio of a smaller longitudinal differential pressure to a larger one of the heating-unit side longitudinal differential pressure and the bypass-side longitudinal differential pressure.

Specifically, as illustrated in the control characteristic diagram described in step S11*a* of FIG. 13, when the valve differential pressure ratio is larger than a predetermined reference valve differential pressure ratio (90% in the present embodiment), the control zone is determined to be zone 0. When the valve differential pressure ratio is equal to or larger than the reference valve differential pressure ratio, the control zone is determined in the order of zone 1, zone 2, and zone 3 as the valve differential pressure ratio decreases. The control mode of the subsequent upper limit opening control is similar to that of the first embodiment.

As described above, in the variable throttle mechanism, the flow rate regulating performance decreases as the longitudinal differential pressure decreases. Therefore, in the upper limit opening control of the present embodiment, when the valve differential pressure ratio is equal to or less than the reference valve differential pressure ratio, it is determined that the flow rate regulating performance of a variable throttle mechanism with a smaller one of the heating-unit side longitudinal differential pressure and the bypass-side longitudinal differential pressure is equal to or less than the reference regulating performance.

Furthermore, in step S13, which is the upper limit opening determination unit of the present embodiment, the upper limit opening is determined to be a low value as the valve differential pressure ratio decreases. Other configurations and operations of the vehicle air conditioner 1 are similar to those in the first embodiment.

Therefore, the vehicle air conditioner 1 of the present embodiment can also achieve effects similar to those of the first embodiment. That is, by switching the operation mode, comfortable air conditioning in the vehicle cabin and appropriate temperature regulation of the battery 70, which is an in-vehicle device, can be performed. At this time, even when refrigerants with different enthalpies are mixed and sucked into the compressor 11, the state of the suction refrigerant can be maintained in an appropriate state and the compressor 11 can be reliably protected.

In the upper limit opening control of the present embodiment, when the valve differential pressure ratio is equal to or less than the reference valve differential pressure ratio, it is determined that the flow rate regulating performance of a variable throttle mechanism with a smaller one of the heating-unit side longitudinal differential pressure and the bypass-side longitudinal differential pressure is equal to or less than the reference regulating performance. According to this, by relatively comparing the heating-unit side longitudinal differential pressure and the bypass-side longitudinal differential pressure, the flow rate regulating performance of the variable throttle mechanism with a smaller longitudinal differential pressure can be easily and accurately estimated.

Furthermore, since the opening ratio is used to grasp the flow rate regulating performance of the variable throttle mechanism with a smaller longitudinal differential pressure, it is not necessary to detect or estimate the throttle opening of each variable throttle mechanism. Therefore, the heating-unit side decompression unit or the bypass-side flow-rate regulating valve 14*d* is not limited to the variable throttle mechanism having a stepping motor as the drive unit, and for example, a variable throttle mechanism having a brushless DC motor as the drive unit or the like may be used.

In the upper limit opening control of the present embodiment, the upper limit opening is determined to be a low value as the valve differential pressure ratio decreases. According to this, as it becomes difficult to increase the flow rate of the refrigerant flowing from one variable throttle mechanism into the sixth three-way joint 12*f*, the upper limit opening of the other variable throttle mechanism can be set to a low value. Therefore, the compressor 11 can be more reliably protected.

It is needless to mention that, in the vehicle air conditioner 1 of the present embodiment, the compressor 11 can be reliably protected even when the operation of at least one of the compressor 11, the heating-unit side decompression unit, or the bypass-side flow-rate regulating valve 14*d* is controlled in a manner that the ventilation air temperature TAV approaches the target air temperature TAO and the degree of superheating SH of the suction refrigerant approaches the reference degree of superheating KSH, as in the first embodiment.

Third Embodiment

In the present embodiment, an example will be described in which operation modes in (d) hot-gas air-heating mode, (e) hot-gas dehumidification and air-heating mode, and (f) hot-gas series dehumidification and air-heating mode are changed from that of the first embodiment. Hereinafter, the detailed operation of each operation mode will be described.

(d) Hot-Gas Air-Heating Mode

In the hot-gas air-heating mode of the present embodiment, the control device 60 regulates the opening ratio of the throttle opening of the heating-unit side decompression unit to the throttle opening of the bypass-side flow-rate regulating valve 14*d* in a manner that the quality Rx of the suction refrigerant approaches the reference quality KRx. Specifically, the opening ratio is regulated on the basis of the quality Rx of the suction refrigerant with reference to a control map stored in advance in the control device 60. The throttle opening of the heating-unit side decompression unit in the hot-gas air-heating mode is the throttle opening of the cooling expansion valve 14*c*.

Figure 14:
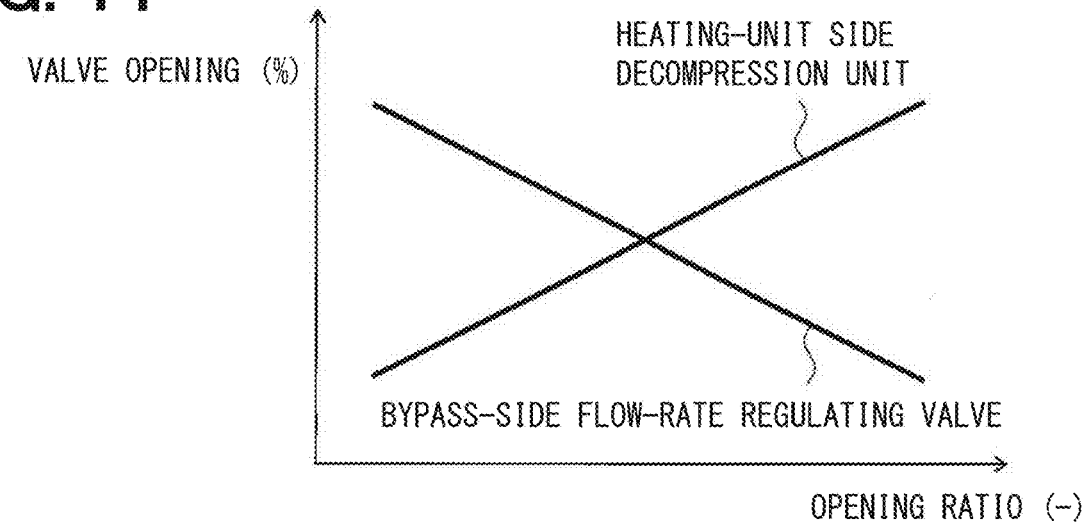
FIG. 14 is a control characteristic diagram for controlling an opening ratio according to a third embodiment.
Figure 15:
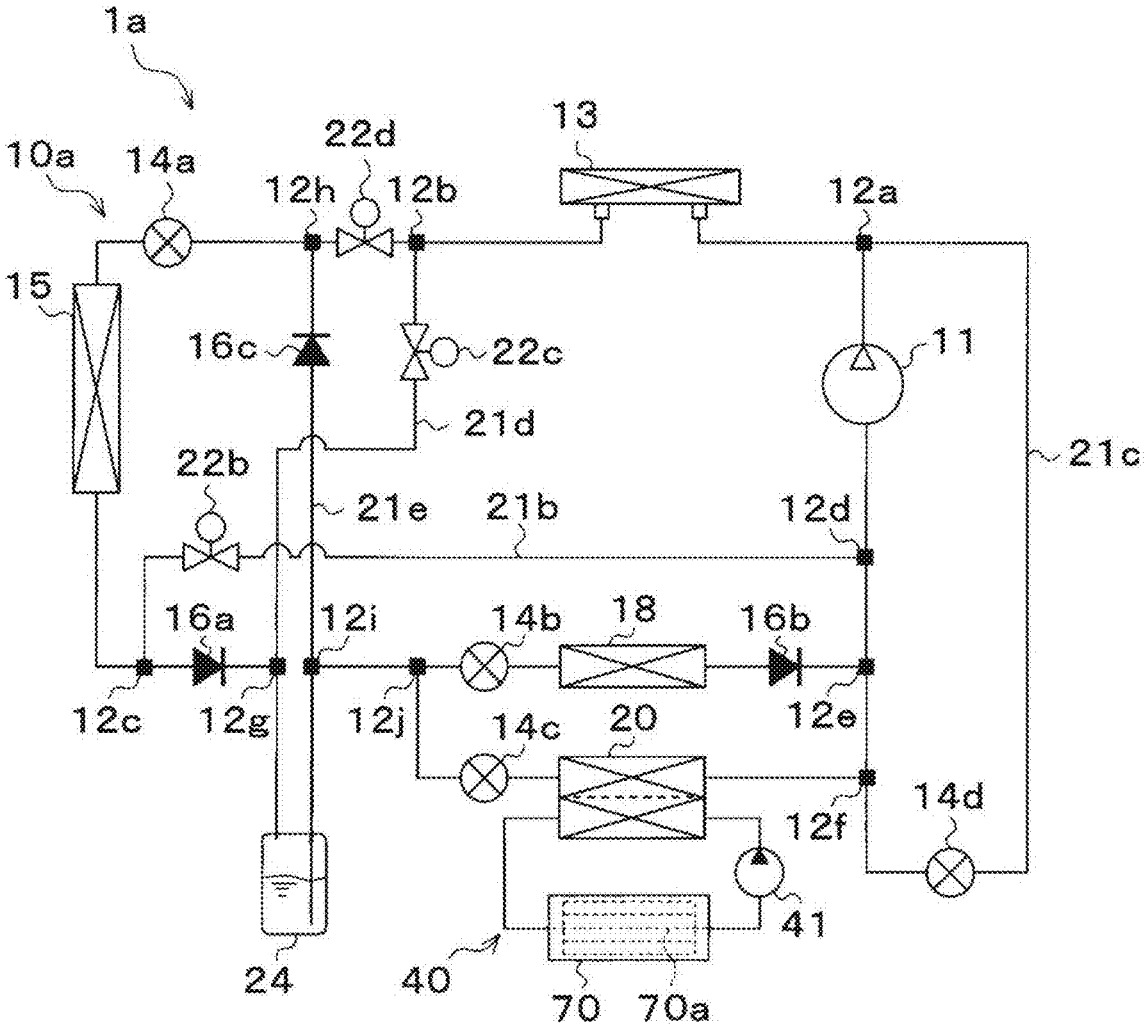
FIG. 15 is a schematic overall configuration diagram of a vehicle air conditioner according to a fourth embodiment.

In the control map of the present embodiment, as illustrated in the control characteristic diagram of FIG. 14, an opening ratio that achieves an appropriate flow rate ratio is stored in advance. The control device 60 increases the opening ratio when the quality Rx of the suction refrigerant is larger than the reference quality KRx. The control device reduces the opening ratio when the quality Rx of the suction refrigerant is smaller than the reference quality KRx.

Furthermore, the control device 60 controls the refrigerant discharge performance of the compressor 11 in a manner that the discharge refrigerant pressure Pd approaches the target high pressure PDO. Other operations are similar to those in the first embodiment.

Therefore, also in the hot-gas air-heating mode of the present embodiment, the heat generated by the workload of the compressor 11 can be effectively used to heat the ventilation air, and the air in the vehicle cabin can be heated, as in the first embodiment. Also in the hot-gas air-heating mode of the present embodiment, the single hot-gas air-heating mode, the cooling hot-gas air-heating mode, and a warm-up hot-gas air-heating mode can be performed, as in the first embodiment.

(e) Hot-Gas Dehumidification and Air-Heating Mode

In the hot-gas dehumidification and air-heating mode, the control device 60 regulates the opening ratio as in the hot-gas air-heating mode. Here, the throttle opening of the heating-unit side decompression unit in the hot-gas dehumidification and air-heating mode is the throttle opening of the cooling expansion valve 14*c*.

Furthermore, the control device 60 controls the refrigerant discharge performance of the compressor 11 in a manner that the suction refrigerant pressure Ps approaches the predetermined second target low pressure PSO2, as in the hot-gas dehumidification and air-heating mode of the first embodiment. The control device 60 changes the throttle opening of the air-cooling expansion valve 14*b* in a manner that the discharge refrigerant pressure Pd approaches the target high pressure PDO. Other operations are similar to those in the first embodiment.

Therefore, also in the hot-gas dehumidification and air-heating mode of the present embodiment, the ventilation air is heated with higher heating performance than in the series dehumidification and air-heating mode, and the air in the vehicle cabin can be dehumidified and heated, as in the first embodiment. Also in the hot-gas dehumidification and air-heating mode of the present embodiment, the single hot-gas dehumidification and air-heating mode and the cooling hot-gas dehumidification and air-heating mode can be performed, as in the first embodiment.

(f) Hot-Gas Series Dehumidification and Air-Heating Mode

In the hot-gas series dehumidification and air-heating mode, the control device 60 regulates the opening ratio as in the hot-gas air-heating mode. The throttle opening of the heating-unit side decompression unit in the hot-gas series dehumidification and air-heating mode is the total of the throttle opening of the air-heating expansion valve 14*a* and the throttle opening of the cooling expansion valve 14*c*, as in the first embodiment.

Furthermore, the control device 60 controls the refrigerant discharge performance of the compressor 11 in a manner that the suction refrigerant pressure Ps approaches the predetermined second target low pressure PSO2, as in the hot-gas series dehumidification and air-heating mode of the first embodiment.

The control device 60 determines the throttle opening of the air-heating expansion valve 14*a* and the air-cooling expansion valve 14*b*, as in the series dehumidification and air-heating mode. In the present embodiment, the total of the throttle opening of the air-heating expansion valve 14*a* and the air-cooling expansion valve 14*b* is changed in a manner that the discharge refrigerant pressure Pd approaches the target high pressure PDO. Other operations are similar to those in the first embodiment.

Therefore, also in the hot-gas series dehumidification and air-heating mode of the present embodiment, the ventilation air is heated with higher heating performance than in the series dehumidification and air-heating mode, and the air in the vehicle cabin can be dehumidified and heated, as in the first embodiment. Also in the hot-gas series dehumidification and air-heating mode of the present embodiment, the single hot-gas series dehumidification and air-heating mode and the cooling hot-gas series dehumidification and air-heating mode can be performed, as in the first embodiment.

The operations of (a) air-cooling mode, (b) series dehumidification and air-heating mode, and (c) outside-air heat-absorption and air-heating mode are similar to those in the first embodiment. Therefore, in the vehicle air conditioner 1 of the present embodiment, by switching the operation mode, comfortable air conditioning in the vehicle cabin and appropriate temperature regulation of the battery 70, which is an in-vehicle device, can be performed.

Furthermore, in (d) hot-gas air-heating mode, (e) hot-gas dehumidification and air-heating mode, and (f) hot-gas series dehumidification and air-heating mode of the present embodiment, the opening ratio is regulated in a manner that the quality Rx of the suction refrigerant approaches the reference quality KRx. According to this, the throttle opening of the heating-unit side decompression unit and the throttle opening of the bypass-side flow-rate regulating valve 14*d* can be changed within the range in which the state of the suction refrigerant is in an appropriate state regardless of the refrigerant discharge performance of the compressor 11.

It is possible to prevent the quality Rx of the suction refrigerant from becoming lower than necessary. As a result, even in the heat pump cycle device in which refrigerants with different enthalpies are mixed and flown into the compressor 11, the compressor 11 can be reliably protected.

In the vehicle air conditioner 1 of the present embodiment, the opening ratio is regulated in a manner that the quality Rx of the suction refrigerant approaches the reference quality KRx in (d) hot-gas air-heating mode. However, it is not limited to thereto. For example, in (d) hot-gas air-heating mode, the first target degree of subcooling SCO1 may be determined in a manner that the degree of superheating SH of the suction refrigerant approaches the reference degree of superheating KSH.

In this case, the control device 60 may increase the opening ratio when the degree of superheating SH of the suction refrigerant is larger than the reference degree of superheating KSH. When the degree of superheating SH of the suction refrigerant is less than the reference degree of superheating KSH, the opening ratio may be reduced. The same applies to (e) hot-gas dehumidification and air-heating mode and (f) hot-gas series dehumidification and air-heating mode.

Fourth Embodiment

In the present embodiment, the heat pump cycle device of the present disclosure is applied to a vehicle air conditioner 1*a*. The vehicle air conditioner 1*a* includes a heat pump cycle 10*a*. In the heat pump cycle 10*a*, the accumulator 23 and the like are eliminated from the heat pump cycle 10 described in the first embodiment, and a receiver 24 and the like are used.

In the heat pump cycle 10*a*, an inlet port side of the receiver 24 is connected to the other outlet port of the second three-way joint 12*b*. The refrigerant passage from the other outlet port of the second three-way joint 12*b* to an inlet port of the receiver 24 is an inlet-port side passage 21*d*. A first inlet-port side on-off valve 22*c* and a seventh three-way joint 12*g* are arranged in the inlet-port side passage 21*d*. The receiver 24 is a high-pressure side gas-liquid separating unit that separates a refrigerant flowing into the receiver into gas and liquid and stores the separated liquid-phase refrigerant as an excess refrigerant in the cycle. The receiver 24 causes the separated liquid-phase refrigerant to flow downstream from a liquid-phase refrigerant outlet port.

The first inlet-port side on-off valve 22*c* is an on-off valve that opens and closes the inlet-port side passage 21*d*. More specifically, the first inlet-port side on-off valve 22*c* opens and closes a refrigerant passage from the other outlet port of the second three-way joint 12*b* to one inlet port of the seventh three-way joint 12*g* in the inlet-port side passage 21*d*. The first inlet-port side on-off valve 22*c* is a refrigerant circuit switching unit.

One inlet port side of an eighth three-way joint 12*h* is connected to one outlet port of the second three-way joint 12*b*. A second inlet-port side on-off valve 22*d* is disposed in a refrigerant passage from one outlet port of the second three-way joint 12*b* to one inlet port of the eighth three-way joint 12*h*. The second inlet-port side on-off valve 22*d* opens and closes the refrigerant passage from one outlet port of the second three-way joint 12*b* to one inlet port of the eighth three-way joint 12*h*. The second inlet-port side on-off valve 22*d* is the refrigerant circuit switching unit.

An inlet port side of the air-heating expansion valve 14*a* is connected to an outlet port of the eighth three-way joint 12*h*. The other inlet port of the seventh three-way joint 12*g* disposed in the inlet-port side passage 21*d* is connected to one outlet port of the third three-way joint 12*c* connected to the outlet port side of the outside heat exchanger 15 via the first check valve 16*a*.

The other inlet port side of the eighth three-way joint 12*h* is connected to a liquid-phase refrigerant outlet port of the receiver 24. The refrigerant passage from the outlet port of the receiver 24 to the other inlet port of the eighth three-way joint 12*h* is an outlet-port side passage 21*e*. A ninth three-way joint 12*i* and a third check valve 16*c* are arranged in the outlet-port side passage 21*e*.

The third check valve 16*c* allows the refrigerant to flow from the side of the ninth three-way joint 12*i* to the side of the eighth three-way joint 12*h*, and prohibits the refrigerant from flowing from the side of the eighth three-way joint 12*h* to the side of the ninth three-way joint 12*i*.

An inlet port side of a tenth three-way joint 12*j* is connected to the other outlet port of the ninth three-way joint 12*i*. A refrigerant inlet port side of the inside evaporator 18 is connected to one outlet port of the tenth three-way joint 12*j* via the air-cooling expansion valve 14*b*. An inlet port side of a refrigerant passage in the chiller 20 is connected to the other outlet port of the tenth three-way joint 12*j* via the cooling expansion valve 14*c*.

In the heat pump cycle 10*a*, a suction port side of the compressor 11 is connected to the outlet port of the fourth three-way joint 12*d*. Other configurations of the vehicle air conditioner 1*a* are similar to the vehicle air conditioner 1 described in the first embodiment.

Next, the operation of the vehicle air conditioner 1*a* with the above configuration of the present embodiment will be described. In the vehicle air conditioner 1*a* of the present embodiment, various operation modes are switched in order to perform air conditioning in the vehicle cabin and temperature regulation of the battery 70, as in the first embodiment. Hereinafter, the detailed operation of each operation mode will be described.

(a-1) Single Air-Cooling Mode

In the heat pump cycle 10*a* in the single air-cooling mode, the control device 60 brings the air-heating expansion valve 14*a* into a fully open state, brings the air-cooling expansion valve 14*b* into a throttled state, brings the cooling expansion valve 14*c* into a fully closed state, and brings the bypass-side flow-rate regulating valve 14*d* into the fully closed state. In addition, the control device 60 closes the air-heating on-off valve 22*b*, closes the first inlet-port side on-off valve 22*c*, and opens the second inlet-port side on-off valve 22*d*.

Therefore, in the heat pump cycle 10*a* in the single air-cooling mode, the refrigerant circuit is switched to a refrigerant circuit in which the refrigerant discharged from the compressor 11 circulates through the inside condenser 13, the air-heating expansion valve 14*a* in the fully open state, the outside heat exchanger 15, the receiver 24, the air-cooling expansion valve 14*b* in the throttled state, the inside evaporator 18, and the suction port of the compressor 11 in this order. The control device 60 appropriately controls the operations of other control target devices.

Therefore, in the heat pump cycle 10*a* in the single air-cooling mode, a vapor compression refrigeration cycle is configured in which the inside condenser 13 and the outside heat exchanger 15 function as condensers, and the inside evaporator 18 function as an evaporator. The inside air conditioning unit 50 operates similarly to the single air-cooling mode of the first embodiment.

As a result, in the single air-cooling mode, the air in the vehicle cabin is cooled as in the single air-cooling mode of the first embodiment.

(a-2) Cooling and Air-Cooling Mode

In the heat pump cycle 10*a* in the cooling and air-cooling mode, the control device 60 brings the cooling expansion valve 14*c* into the throttled state as compared with the single air-cooling mode.

Therefore, in the heat pump cycle 10*a* in the cooling and air-cooling mode, the refrigerant discharged from the compressor 11 circulates similarly to the single air-cooling mode. At the same time, the refrigerant circuit is switched to a refrigerant circuit in which the refrigerant discharged from the compressor 11 circulates through the inside condenser 13, the air-heating expansion valve 14*a* in the fully open state, the outside heat exchanger 15, the receiver 24, the cooling expansion valve 14*c* in the throttled state, the chiller 20, and the suction port of the compressor 11 in this order. That is, the refrigerant circuit is switched to a refrigerant circuit in which the inside evaporator 18 and the chiller 20 are connected in parallel to the refrigerant flow. The control device 60 appropriately controls the operations of other control target devices.

Therefore, in the heat pump cycle 10*a* in the cooling and air-cooling mode, a vapor compression refrigeration cycle is configured in which the inside condenser 13 and the outside heat exchanger 15 function as condensers, and the inside evaporator 18 and the chiller 20 function as evaporators. The low-temperature side heat medium circuit 40 and the inside air conditioning unit 50 operate similarly to the single air-cooling mode of the first embodiment.

As a result, in the cooling and air-cooling mode, the battery 70 is cooled and the air in the vehicle cabin is cooled as in the cooling and air-cooling mode of the first embodiment.

(b-1) Single Series Dehumidification and Air-Heating Mode

In the heat pump cycle 10*a* in the single series dehumidification and air-heating mode, the control device 60 brings the air-heating expansion valve 14*a* into the throttled state, brings the air-cooling expansion valve 14*b* into the throttled state, brings the cooling expansion valve 14*c* into the fully closed state, and brings the bypass-side flow-rate regulating valve 14*d* into the fully closed state. In addition, the control device 60 closes the air-heating on-off valve 22*b*, closes the first inlet-port side on-off valve 22*c*, and opens the second inlet-port side on-off valve 22*d*.

Therefore, in the heat pump cycle 10*a* in the single series dehumidification and air-heating mode, the refrigerant circuit is switched to a refrigerant circuit in which the refrigerant discharged from the compressor 11 circulates through the inside condenser 13, the air-heating expansion valve 14*a* in the throttled state, the outside heat exchanger 15, the receiver 24, the air-cooling expansion valve 14*b* in the throttled state, the inside evaporator 18, and the suction port of the compressor 11 in this order. The control device 60 appropriately controls the operations of other control target devices.

Therefore, in the heat pump cycle 10*a* in the single series dehumidification and air-heating mode, a vapor compression refrigeration cycle is configured in which the inside condenser 13 and the outside heat exchanger 15 function as condensers, and the inside evaporator 18 function as an evaporator. The inside air conditioning unit 50 operates similarly to the single air-cooling mode of the first embodiment.

As a result, in the single series dehumidification and air-heating mode, the air in the vehicle cabin is heated as in the single series dehumidification and air-heating mode of the first embodiment. Since the heat pump cycle 10*a* includes the receiver 24, the single series dehumidification and air-heating mode is performed in the temperature range in which the saturation temperature of the refrigerant in the outside heat exchanger 15 is higher than the outside air temperature Tam.

(b-2) Cooling Series Dehumidification and Air-Heating Mode

In the heat pump cycle 10*a* in the cooling series dehumidification and air-heating mode, the control device 60 brings the cooling expansion valve 14*c* into the throttled state as compared with the single series dehumidification and air-heating mode.

Therefore, in the heat pump cycle 10*a* in the cooling series dehumidification and air-heating mode, the refrigerant discharged from the compressor 11 circulates similarly to the single series dehumidification and air-heating mode. At the same time, the refrigerant circuit is switched to a refrigerant circuit in which the refrigerant discharged from the compressor 11 circulates through the inside condenser 13, the air-heating expansion valve 14*a* in the fully open state, the outside heat exchanger 15, the receiver 24, the cooling expansion valve 14*c* in the throttled state, the chiller 20, and the suction port of the compressor 11 in this order. That is, the refrigerant circuit is switched to a refrigerant circuit in which the inside evaporator 18 and the chiller 20 are connected in parallel to the refrigerant flow. The control device 60 appropriately controls the operations of other control target devices.

Therefore, in the heat pump cycle 10*a* in the cooling series dehumidification and air-heating mode, a vapor compression refrigeration cycle is configured in which the inside condenser 13 and the outside heat exchanger 15 function as condensers, and the inside evaporator 18 and the chiller 20 function as evaporators. The low-temperature side heat medium circuit 40 and the inside air conditioning unit 50 operate similarly to the cooling series dehumidification and air-heating mode of the first embodiment.

As a result, in the cooling series dehumidification and air-heating mode, the battery 70 is cooled and the air in the vehicle cabin is dehumidified and heated as in the cooling series dehumidification and air-heating mode of the first embodiment. Since the heat pump cycle 10*a* includes the receiver 24, the cooling series dehumidification and air-heating mode is performed in the temperature range in which the saturation temperature of the refrigerant in the outside heat exchanger 15 is higher than the outside air temperature Tam.

(c-1) Single Outside-Air Heat-Absorption and Air-Heating Mode

In the heat pump cycle 10*a* in the single outside-air heat-absorption and air-heating mode, the control device 60 brings the air-heating expansion valve 14*a* into the throttled state, brings the air-cooling expansion valve 14*b* into the fully closed state, brings the cooling expansion valve 14*c* into the fully closed state, and brings the bypass-side flow-rate regulating valve 14*d* into the fully closed state. In addition, the control device 60 opens the air-heating on-off valve 22*b*, opens the first inlet-port side on-off valve 22*c*, and closes the second inlet-port side on-off valve 22*d*.

Therefore, in the heat pump cycle 10*a* in the single outside-air heat-absorption and air-heating mode, the refrigerant circuit is switched to a refrigerant circuit in which the refrigerant discharged from the compressor 11 circulates through the inside condenser 13, the receiver 24, the air-heating expansion valve 14*a* in the throttled state, the outside heat exchanger 15, the air-heating passage 21*b*, and the suction port of the compressor 11 in this order. The control device 60 appropriately controls the operations of other control target devices.

Therefore, in the heat pump cycle 10*a* in the single outside-air heat-absorption and air-heating mode, a vapor compression refrigeration cycle is configured in which the inside condenser 13 functions as a condenser and the outside heat exchanger 15 functions as an evaporator. The inside air conditioning unit 50 operates similarly to the single outside-air heat-absorption and air-heating mode of the first embodiment.

As a result, in the single outside-air heat-absorption and air-heating mode, the air in the vehicle cabin is heated as in the single outside-air heat-absorption and air-heating mode of the first embodiment.

(c-2) Cooling Outside-Air Heat-Absorption and Air-Heating Mode

In the heat pump cycle 10*a* in the cooling outside-air heat-absorption and air-heating mode, the control device 60 brings the cooling expansion valve 14*c* into the throttled state as compared with the single outside-air heat-absorption and air-heating mode.

Therefore, in the heat pump cycle 10*a* in the cooling outside-air heat-absorption and air-heating mode, the refrigerant discharged from the compressor 11 circulates similarly to the single outside-air heat-absorption and air-heating mode. At the same time, the refrigerant circuit is switched to a refrigerant circuit in which the refrigerant discharged from the compressor 11 circulates through the inside condenser 13, the receiver 24, the cooling expansion valve 14*c* in the throttled state, the chiller 20, and the suction port of the compressor 11 in this order. That is, the refrigerant circuit is switched to a refrigerant circuit in which the outside heat exchanger 15 and the chiller 20 are connected in parallel to the refrigerant flow. The control device 60 appropriately controls the operations of other control target devices.

Therefore, in the heat pump cycle 10*a* in the cooling outside-air heat-absorption and air-heating mode, a vapor compression refrigeration cycle is configured in which the inside condenser 13 functions as a condenser, and the outside heat exchanger 15 and the chiller 20 function as evaporators. The low-temperature side heat medium circuit 40 and the inside air conditioning unit 50 operate similarly to the cooling outside-air heat-absorption and air-heating mode of the first embodiment.

As a result, in the cooling outside-air heat-absorption and air-heating mode, the battery 70 is cooled and the air in the vehicle cabin is heated as in the cooling outside-air heat-absorption and air-heating mode of the first embodiment.

(d-1) Single Hot-Gas Air-Heating Mode

In the heat pump cycle 10*a* in the single hot-gas air-heating mode, the control device 60 brings the air-heating expansion valve 14*a* into the fully closed state, brings the air-cooling expansion valve 14*b* into the fully closed state, brings the cooling expansion valve 14*c* into the throttled state, and brings the bypass-side flow-rate regulating valve 14*d* into the throttled state. In addition, the control device 60 closes the air-heating on-off valve 22*b*, opens the first inlet-port side on-off valve 22*c*, and closes the second inlet-port side on-off valve 22*d*.

Therefore, in the heat pump cycle 10*a* in the single hot-gas air-heating mode, the refrigerant discharged from the compressor 11 circulates through the first three-way joint 12*a*, the inside condenser 13, the receiver 24, the cooling expansion valve 14*c* in the throttled state, the chiller 20, the sixth three-way joint 12*f*, and the suction port of the compressor 11 in this order. At the same time, the refrigerant circuit is switched to a refrigerant circuit in which the refrigerant discharged from the compressor 11 circulates through the first three-way joint 12*a*, the bypass-side flow-rate regulating valve 14*d* in the throttled state, which is disposed in the bypass passage 21*c*, the sixth three-way joint 12*f*, and the suction port of the compressor 11 in this order.

The control device 60 changes the throttle opening of the cooling expansion valve 14*c* in a manner that the degree of superheating SH of the suction refrigerant approaches the reference degree of superheating KSH. The control device 60 appropriately controls the operations of other control target devices as in the single hot-gas air-heating mode of the first embodiment. Also in the hot-gas air-heating mode of the present embodiment, the upper limit opening control is executed as in the first embodiment.

Therefore, in the hot-gas air-heating mode, the cooling expansion valve 14*c* serves as the heating-unit side decompression unit, and the sixth three-way joint 12*f* serves as the mixing portion, as in the first embodiment. In the hot-gas air-heating mode, the operation of at least one of the compressor 11, the cooling expansion valve 14*c*, or the bypass-side flow-rate regulating valve 14*d* is controlled in a manner that the ventilation air temperature TAV approaches the target air temperature TAO and the degree of superheating SH of the suction refrigerant approaches the reference degree of superheating KSH.

As a result, in the single hot-gas air-heating mode of the present embodiment, even when the outside air temperature Tam is extremely low, the heat generated by the workload of the compressor 11 can be effectively used to heat the ventilation air, and the air in the vehicle cabin can be heated, as in the first embodiment. Furthermore, the compressor 11 can be protected by executing the upper limit opening control.

(d-2) Cooling Hot-Gas Air-Heating Mode

In the cooling hot-gas air-heating mode, the control device 60 operates the low-temperature side pump 41 so as to exhibit the predetermined reference pumping performance, as compared with the single hot-gas air-heating mode. The other operations are similar to those in the single hot-gas air-heating mode.

Therefore, in the cooling hot-gas air-heating mode, the heat generated by the workload of the compressor 11 can be effectively used to heat the ventilation air, and the air in the vehicle cabin can be heated. The battery 70 can be cooled similarly to the cooling hot-gas air-heating mode of the first embodiment. Furthermore, the compressor 11 can be protected by executing the upper limit opening control.

(d-3) Warm-up Hot-Gas Air-Heating Mode

In the warm-up hot-gas air-heating mode, the control device 60 operates the low-temperature side pump 41 so as to exhibit the predetermined reference pumping performance, as compared with the single hot-gas air-heating mode. The other operations are similar to those in the single hot-gas air-heating mode.

Therefore, in the warm-up hot-gas air-heating mode, the heat generated by the workload of the compressor 11 can be effectively used to heat the ventilation air, and the air in the vehicle cabin can be heated. The battery 70 can be warmed up similarly to the warm-up hot-gas air-heating mode of the first embodiment. Furthermore, the compressor 11 can be protected by executing the upper limit opening control.

(e-1) Single Hot-Gas Dehumidification and Air-Heating Mode

In the heat pump cycle 10*a* in the single hot-gas dehumidification and air-heating mode, the control device 60 brings the air-heating expansion valve 14*a* into the fully closed state, brings the air-cooling expansion valve 14*b* into the throttled state, brings the cooling expansion valve 14*c* into the throttled state, and brings the bypass-side flow-rate regulating valve 14*d* into the throttled state. In addition, the control device 60 closes the air-heating on-off valve 22*b*, opens the first inlet-port side on-off valve 22*c*, and closes the second inlet-port side on-off valve 22*d*.

Therefore, in the heat pump cycle 10*a* in the single hot-gas dehumidification and air-heating mode, the refrigerant discharged from the compressor 11 circulates similarly to the hot-gas air-heating mode. At the same time, the refrigerant circuit is switched to a refrigerant circuit in which the refrigerant discharged from the compressor 11 circulates through the first three-way joint 12*a*, the inside condenser 13, the receiver 24, the air-cooling expansion valve 14*b* in the throttled state, the inside evaporator 18, and the suction port of the compressor 11 in this order.

The control device 60 changes the throttle opening of the cooling expansion valve 14*c* in a manner that the degree of superheating SH of the suction refrigerant approaches the reference degree of superheating KSH. The control device 60 appropriately controls the operations of other control target devices as in the single hot-gas dehumidification and air-heating mode of the first embodiment. Also in the hot-gas dehumidification and air-heating mode of the present embodiment, the upper limit opening control and the opening increase control are executed as in the first embodiment.

Therefore, in the hot-gas dehumidification and air-heating mode, the cooling expansion valve 14*c* serves as the heating-unit side decompression unit, and the sixth three-way joint 12*f* serves as the mixing portion, as in the first embodiment. Furthermore, the tenth three-way joint 12*j* serves as the auxiliary branch portion, the air-cooling expansion valve 14*b* serves as the auxiliary heating-unit side decompression unit, and the inside evaporator 18 serves as the evaporation unit.

In the hot-gas dehumidification and air-heating mode, the operation of at least one of the compressor 11, the cooling expansion valve 14*c*, or the bypass-side flow-rate regulating valve 14*d* is controlled in a manner that the ventilation air temperature TAV approaches the target air temperature TAO and the degree of superheating SH of the suction refrigerant approaches the reference degree of superheating KSH.

As a result, in the single hot-gas dehumidification and air-heating mode of the present embodiment, the ventilation air is heated with higher heating performance than in the series dehumidification and air-heating mode, and the air in the vehicle cabin can be dehumidified and heated, as in the first embodiment. Furthermore, the compressor 11 can be protected by executing the upper limit opening control and the opening increase control.

(e-2) Cooling Hot-Gas Dehumidification and Air-Heating Mode

In the cooling hot-gas dehumidification and air-heating mode, the control device 60 operates the low-temperature side pump 41 so as to exhibit the predetermined reference pumping performance, as compared with the single hot-gas dehumidification and air-heating mode. The other operations are similar to those in the single hot-gas dehumidification and air-heating mode.

Therefore, in the cooling hot-gas dehumidification and air-heating mode, the ventilation air is heated with higher heating performance than in the series dehumidification and air-heating mode, and the air in the vehicle cabin can be dehumidified and heated, as in the single hot-gas dehumidification and air-heating mode. The battery 70 can be cooled similarly to the cooling hot-gas dehumidification and air-heating mode of the first embodiment. Furthermore, the compressor 11 can be protected by executing the upper limit opening control and the opening increase control.

(f-1) Single Hot-Gas Series Dehumidification and Air-Heating Mode

In the heat pump cycle 10*a* in the single hot-gas series dehumidification and air-heating mode, the control device 60 brings the air-heating expansion valve 14*a* into the throttled state, brings the air-cooling expansion valve 14*b* into the throttled state, brings the cooling expansion valve 14*c* into the throttled state, and brings the bypass-side flow-rate regulating valve 14*d* into the throttled state. In addition, the control device 60 closes the air-heating on-off valve 22*b*, closes the first inlet-port side on-off valve 22*c*, and opens the second inlet-port side on-off valve 22*d*.

Therefore, in the heat pump cycle 10*a* in the single hot-gas series dehumidification and air-heating mode, the refrigerant discharged from the compressor 11 circulates similarly to the cooling series dehumidification and air-heating mode. At the same time, the refrigerant circuit is switched to a refrigerant circuit in which the refrigerant discharged from the compressor 11 circulates through the first three-way joint 12*a*, the bypass-side flow-rate regulating valve 14*d* in the throttled state, which is disposed in the bypass passage 21*c*, the sixth three-way joint 12*f*, and the suction port of the compressor 11 in this order.

The control device 60 changes the throttle opening of the cooling expansion valve 14*c* in a manner that the degree of superheating SH of the suction refrigerant approaches the reference degree of superheating KSH. The control device 60 appropriately controls the operations of other control target devices as in the single hot-gas series dehumidification and air-heating mode of the first embodiment. Also in the hot-gas series dehumidification and air-heating mode of the present embodiment, the upper limit opening control and the opening increase control are executed as in the first embodiment.

Therefore, in the hot-gas series dehumidification and air-heating mode, the air-heating expansion valve 14*a* and the cooling expansion valve 14*c* serve as the heating-unit side decompression unit, and the sixth three-way joint 12*f* serves as the mixing portion, as in the first embodiment. Furthermore, the tenth three-way joint 12*j* serves as the auxiliary branch portion, the air-cooling expansion valve 14*b* serves as the auxiliary heating-unit side decompression unit, and the inside evaporator 18 serves as the evaporation unit.

In the hot-gas series dehumidification and air-heating mode, the operation of at least one of the compressor 11, the cooling expansion valve 14*c*, or the bypass-side flow-rate regulating valve 14*d* is controlled in a manner that the ventilation air temperature TAV approaches the target air temperature TAO and the degree of superheating SH of the suction refrigerant approaches the reference degree of superheating KSH.

As a result, in the single hot-gas series dehumidification and air-heating mode of the present embodiment, the ventilation air is heated with higher heating performance than in the series dehumidification and air-heating mode, and the air in the vehicle cabin can be dehumidified and heated, as in the first embodiment. Furthermore, the compressor 11 can be protected by executing the upper limit opening control and the opening increase control.

(f-2) Cooling Hot-Gas Series Dehumidification and Air-Heating Mode

In the cooling hot-gas series dehumidification and air-heating mode, the control device 60 operates the low-temperature side pump 41 so as to exhibit the predetermined reference pumping performance, as compared with the single hot-gas series dehumidification and air-heating mode. The other operations are similar to those in the single hot-gas series dehumidification and air-heating mode.

Therefore, in the cooling hot-gas series dehumidification and air-heating mode, the ventilation air is heated with higher heating performance than in the series dehumidification and air-heating mode, and the air in the vehicle cabin can be dehumidified and heated, as in the single hot-gas series dehumidification and air-heating mode. The battery 70 can be cooled similarly to the cooling hot-gas series dehumidification and air-heating mode of the first embodiment. Furthermore, the compressor 11 can be protected by executing the upper limit opening control and the opening increase control.

As described above, the vehicle air conditioner 1*a* of the present embodiment can also achieve effects similar to those of the first embodiment. That is, by switching the operation mode, comfortable air conditioning in the vehicle cabin and appropriate temperature regulation of the battery 70, which is an in-vehicle device, can be performed. At this time, even when refrigerants with different enthalpies are mixed and sucked into the compressor 11, the state of the suction refrigerant can be maintained in an appropriate state and the compressor 11 can be reliably protected. Furthermore, since the heat pump cycle 10*a* of the present embodiment includes the receiver 24, the high-pressure side liquid-phase refrigerant can be stored in the receiver 24 as an excess refrigerant in the cycle.

According to this, the refrigerant on the outlet port side of the heat exchange unit functioning as an evaporator can have a degree of superheating. Therefore, it is possible to increase the enthalpy difference obtained by subtracting the enthalpy of the inlet-port side refrigerant from the enthalpy of the outlet-port side refrigerant in the heat exchange unit functioning as an evaporator. As a result, in the heat pump cycle 10*a*, the amount of heat absorption of the refrigerant in the heat exchange unit functioning as an evaporator can be increased to improve COP.

It is needless to mention that, in the vehicle air conditioner 1 of the present embodiment, the compressor 11 can be reliably protected even when the operation of at least one of the compressor 11, the heating-unit side decompression unit, or the bypass-side flow-rate regulating valve 14*d* is controlled in a manner that the ventilation air temperature TAV approaches the target air temperature TAO and the quality Rx of the suction refrigerant approaches the reference quality KRx, as in the first embodiment.

The present disclosure is not limited to the embodiments described above, and can be variously modified as follows without departing from the gist of the present disclosure.

In the embodiments described above, the example in which the heat pump cycle device according to the present disclosure is applied to an air conditioner has been described, but the application target of the heat pump cycle device is not limited to the air conditioner. For example, it may be applied to a water heater that heats domestic water or the like as a heating object. The heating object is not limited to a fluid. For example, the heating object may be a heat generating device in which a heat medium passage for circulating a high-temperature side heat medium for warm-up or the like is formed.

The configuration of the heat pump cycle device according to the present disclosure is not limited to the configurations disclosed in the embodiments described above.

In the above embodiments, the example in which the inside condenser 13 is used as the heating unit has been described, but the heating unit is not limited to the inside condenser 13. For example, a heating unit in which a high-temperature side pump, a water-refrigerant heat exchanger, a heater core, and the like are arranged in a high-temperature side heat medium circulation circuit for circulating a high-temperature side heat medium may be used as the heating unit.

The high-temperature side pump is a pump that pumps the high-temperature side heat medium to a water passage in the water-refrigerant heat exchanger. As the high-temperature side heat medium, a fluid of the same type as a low-temperature side heat medium can be used. The water-refrigerant heat exchanger is a heat exchanger that exchanges heat between the high-pressure refrigerant discharged from the compressor 11 and the high-temperature side heat medium pumped from the high-temperature side pump. The heater core is a heating heat exchanger that exchanges heat between the high-temperature side heat medium heated by the water-refrigerant heat exchanger and the ventilation air.

The heater core is disposed in the air passage of the inside air conditioning unit 50 like the inside condenser 13. According to this, the ventilation air as the heating object can be indirectly heated through the high-temperature side heat medium using the discharge refrigerant as a heat source in the hot-gas air-heating mode or the like.

In the above embodiments, the example in which the sixth three-way joint 12*f* as the mixing portion is disposed in the refrigerant path from the refrigerant outlet port of the chiller 20 to the other inlet port of the fifth three-way joint 12*e* has been described, but the arrangement of the sixth three-way joint 12*f* is not limited thereto.

For example, the sixth three-way joint 12*f* may be disposed in a refrigerant path from the outlet port of the cooling expansion valve 14*c* to the refrigerant inlet port of the chiller 20, or in a refrigerant path from the outlet port of the fifth three-way joint 12*e* to the other inlet port of the fourth three-way joint 12*d*. Alternatively, the sixth three-way joint 12*f* may be disposed in a refrigerant path from the outlet port of the fourth three-way joint 12*d* to the inlet port of the accumulator 23.

In the above embodiments, the example in which the second check valve 16*b* is used has been described, but an evaporation pressure regulating valve may be used instead of the second check valve 16*b*. The evaporation pressure regulating valve is a variable throttle mechanism that maintains a refrigerant evaporating temperature in the inside evaporator 18 at a predetermined temperature (for example, a temperature at which the inside evaporator 18 can be suppressed) or higher.

As the evaporation pressure regulating valve, a variable throttle mechanism including a mechanical mechanism that increases the valve opening as the pressure of the refrigerant on the refrigerant outlet-port side of the inside evaporator 18 increases may be used. As the evaporation pressure regulating valve, a variable throttle mechanism including an electric mechanism similar to that of the air-heating expansion valve 14*a* or the like may be used.

A subcooling expansion valve that decompresses the refrigerant flowing into the receiver 24 may be disposed in the heat pump cycle 10*a* of the fourth embodiment described above. More specifically, as the subcooling expansion valve, a fixed throttle may be used, or a variable throttle mechanism may be used. The subcooling expansion valve is desirably disposed in a refrigerant path from the outlet port of the seventh three-way joint 12*g* to the inlet port of the receiver 24.

According to this, the degree of subcooling of the refrigerant flowing out of the inside condenser 13 can be increased to increase the refrigerant pressure (that is, the discharge refrigerant pressure Pd) in the inside condenser 13. As a result, the heating performance of the ventilation air in the inside condenser 13 can be improved.

Furthermore, the control sensor group connected to the input side of the control device 60 is not limited to the detection unit disclosed in the embodiments described above. Various detection units may be added as necessary. For example, a quality sensor capable of directly detecting the quality of the suction refrigerant may be added.

In the above embodiments, the example of using R1234yf as the refrigerant of the heat pump cycles 10 and 10*a* has been described, but it is not limited thereto. For example, R134a, R600a, R410A, R404A, R32, R407C, and the like may be used. Alternatively, a mixed refrigerant obtained by mixing a plurality of types of these refrigerants or the like may be used. Furthermore, carbon dioxide may be used as a refrigerant, and a supercritical refrigeration cycle in which the high-pressure side refrigerant pressure is equal to or higher than the critical pressure of the refrigerant may be configured.

The example of using an ethylene glycol aqueous solution as the low-temperature side heat medium and the high-temperature side heat medium of the embodiments described above has been described, but it is not limited thereto. As the high-temperature side heat medium and the low-temperature side heat medium, for example, a solution containing dimethylpolysiloxan, nanofluid, or the like, an antifreeze liquid, an aqueous liquid refrigerant containing alcohol or the like, or a liquid medium containing oil or the like may be used.

The control mode of the heat pump cycle device according to the present disclosure is not limited to the control modes disclosed in the embodiments described above.

In the above embodiments, the vehicle air conditioner 1 capable of performing various operation modes has been described, but it is not necessary to be capable of performing all the operation modes described above. If at least any one of the hot-gas air-heating mode, the hot-gas defrosting air-heating mode, or the hot-gas series dehumidification and air-heating mode can be performed, the compressor can be reliably protected even when refrigerants with different enthalpies are mixed and sucked into the compressor.

In the above embodiments, the example in which step S12 is used as the regulating performance determination unit has been described, but the regulating performance determination unit is not limited thereto. For example, step S12 may be eliminated, and control processing of not setting the upper limit opening when the control zone is zone 0 may be added to the control map of step S13. That is, if it can be substantially determined that the flow rate regulating performance of one of the heating-unit side decompression unit and the bypass-side flow-rate regulating valve 14*d* is equal to or less than the reference regulating performance, it is included in the regulating performance determination unit.

In the above embodiments, the example in which the upper limit opening is changed based on a change in the throttle opening of one of the heating-unit side decompression unit and the bypass-side flow-rate regulating valve 14*d* or a change in the valve differential pressure ratio, but it is not limited thereto. For example, the upper limit opening may be a predetermined fixed value.

In the above embodiments, the example in which, for (d) hot-gas air-heating mode performed when the outside air temperature Tam is extremely low, (d-3) warm-up hot-gas air-heating mode of warming up the battery 70 can be performed has been described, but it is not limited thereto. In other operation modes, an operation mode of warming up the battery 70 may be added.

In the second embodiment, the example in which the control zone of the upper limit opening control is determined using the valve differential pressure ratio has been described, but it is not limited thereto. For example, the control zone may be determined using the smaller one of the heating-unit side longitudinal differential pressure and the bypass-side longitudinal differential pressure.

When the smaller longitudinal differential pressure is larger than the predetermined reference longitudinal differential pressure, the control zone may be determined to be zone 0. When the smaller longitudinal differential pressure is equal to or larger than the reference longitudinal differential pressure, the control zone may be determined in the order of zone 1, zone 2, and zone 3 as the smaller longitudinal differential pressure decreases.

Furthermore, in the hot-gas air-heating mode of the first, second and fourth embodiments, the refrigerant discharge performance of the compressor 11 is controlled in a manner that the suction refrigerant pressure Ps approaches the predetermined first target low pressure PSO1. The example in which the operation of the bypass-side flow-rate regulating valve 14*d* is controlled in a manner that the discharge refrigerant pressure Pd approaches the target high pressure PDO has been described, but it is not limited thereto.

For example, the control device 60 may control the refrigerant discharge performance of the compressor 11 in a manner that the discharge refrigerant pressure Pd approaches the target high pressure PDO. In this case, the control device 60 may control the operation of the bypass-side flow-rate regulating valve 14*d* in a manner that the suction refrigerant pressure Ps approaches the first target low pressure PSO1. In addition, the control device may control the operation of the cooling expansion valve 14*c* in a manner that the degree of subcooling SC1 approaches the first target degree of subcooling SCO1.

For example, the control device 60 may control the refrigerant discharge performance of the compressor 11 in a manner that the discharge refrigerant pressure Pd approaches the target high pressure PDO. In this case, the control device 60 may control the refrigerant discharge performance of the compressor 11 in a manner that the suction refrigerant pressure Ps approaches the first target low pressure PSO1. In addition, the control device may control the operation of the bypass-side flow-rate regulating valve 14*d* in a manner that the degree of subcooling SC1 approaches the first target degree of subcooling SCO1.

That is, in the hot-gas air-heating mode, by controlling the operation of at least one of the compressor 11, the cooling expansion valve 14*c*, or the bypass-side flow-rate regulating valve 14*d* in a manner that the ventilation air temperature TAV approaches the target air temperature TAO and the quality Rx of the suction refrigerant approaches the reference quality KRx, the effects of the upper limit opening control described above can be obtained.

Similarly, in the hot-gas air-heating mode, by controlling the operation of at least one of the compressor 11, the cooling expansion valve 14*c*, or the bypass-side flow-rate regulating valve 14*d* in a manner that the ventilation air temperature TAV approaches the target air temperature TAO and the degree of superheating SH of the suction refrigerant approaches the predetermined reference degree of superheating KSH, the effects of the upper limit opening control described above can be obtained.

The same applies to the hot-gas dehumidification and air-heating mode and the hot-gas series dehumidification and air-heating mode.

The means disclosed in the individual embodiments may be appropriately combined within a feasible range. For example, in the vehicle air conditioner 1*a* of the fourth embodiment, the control zone of the upper limit opening control may be determined using the valve differential pressure ratio as in the second embodiment. For example, in the vehicle air conditioner 1*a* of the fourth embodiment, the operations of the heating-unit side decompression unit and the bypass-side flow-rate regulating unit may be controlled using the opening ratio, as in the third embodiment.

Although the present disclosure has been described in accordance with examples, it is understood that the present disclosure is not limited to the examples and structures. The present disclosure also includes various modifications and modifications within an equivalent range. In addition, various combinations and modes, and other combinations and modes including only one element, more elements, or less elements are also within the scope and idea of the present disclosure.

What is claimed is:

1. A heat pump cycle device comprising:

a compressor configured to compress and discharge a refrigerant;

a branch portion configured to branch a flow of the refrigerant discharged from the compressor;

a heating unit configured to heat a heating object using one refrigerant branched at the branch portion as a heat source;

a heating-unit side decompression unit configured to decompress the refrigerant flowing out of the heating unit and before flowing into a mixing portion;

a bypass passage that guides the other refrigerant branched at the branch portion to a suction port side of the compressor;

a bypass-side flow-rate regulating unit configured to regulate a flow rate of the refrigerant flowing through the bypass passage;

the mixing portion configured to mix the refrigerant flowing out of the bypass-side flow-rate regulating unit with the refrigerant flowing out of the heating-unit side decompression unit, and to cause a mixed refrigerant to flow to the suction port side of the compressor;

a target temperature determination unit configured to determine a target temperature based on a result of sensor data, from a control sensor group, the target temperature being a target value of an object temperature of the heating object to be heated by the heating unit;

a regulating performance determination unit configured to determine that a flow rate regulating performance of one of the heating-unit side decompression unit or the bypass-side flow-rate regulating unit becomes equal to or less than a predetermined reference regulating performance; and a controller configured to control an operation of at least one of the heating-unit side decompression unit or the bypass-side flow-rate regulating unit in a manner that the object temperature approaches the target temperature and a quality of a suction refrigerant sucked into the compressor approaches a predetermined reference quality, or the object temperature approaches the target temperature and a degree of superheating of the suction refrigerant approaches a predetermined reference degree of superheating, wherein the controller controls a throttle opening of the other of the heating-unit side decompression unit or the bypass-side flow-rate regulating unit, to be equal to or less than an upper limit opening, when the regulating performance determination unit determines that the flow rate regulating performance of one of the heating-unit side decompression unit or the bypass-side flow-rate regulating unit is reduced.

2. The heat pump cycle device according to claim 1, wherein the regulating performance determination unit determines that the flow rate regulating performance of one of the heating-unit side decompression unit or the bypass-side flow-rate regulating unit is equal to or less than the reference regulating performance, when a throttle opening of one of the heating-unit side decompression unit or the bypass-side flow-rate regulating unit is equal to or larger than a predetermined reference limit opening.

3. The heat pump cycle device according to claim 2, further comprising an opening determination unit configured to determine a reduction amount of the throttle opening of the other of the heating-unit side decompression unit or the bypass-side flow-rate regulating unit, when the regulating performance determination unit determines that the throttle opening of the one of the heating-unit side decompression unit or the bypass-side flow-rate regulating unit is smaller than the predetermined reference limit opening, wherein the opening determination unit increases the reduction amount of the throttle opening of the other of the heating-unit side decompression unit or the bypass-side flow-rate regulating unit, as the throttle opening of the one of the heating-unit side decompression unit or the bypass-side flow-rate regulating unit increases.

4. The heat pump cycle device according to claim 1, wherein assuming that (i) a longitudinal differential pressure obtained by subtracting a refrigerant pressure on a downstream side of the heating-unit side decompression unit from a refrigerant pressure on an upstream side of the heating-unit side decompression unit is defined as a heating-unit side longitudinal differential pressure;

assuming that (ii) a longitudinal differential pressure obtained by subtracting a refrigerant pressure on a downstream side of the bypass-side flow-rate regulating unit from a refrigerant pressure on an upstream side of the bypass-side flow-rate regulating unit is defined as a bypass-side longitudinal differential pressure; and assuming that (iii) a ratio of a smaller one of the heating-unit side longitudinal differential pressure or the bypass-side longitudinal differential pressure to a larger one of the heating-unit side longitudinal differential pressure or the bypass-side longitudinal differential pressure is defined as a valve differential pressure ratio, one of the heating-unit side decompression unit or the bypass-side flow-rate regulating unit has a smaller value of the heating-unit side longitudinal differential pressure and the bypass-side longitudinal differential pressure, and the regulating performance determination unit determines that the flow rate regulating performance of one of the heating-unit side decompression unit or the bypass-side flow-rate regulating unit is equal to or less than the reference regulating performance, when the valve differential pressure ratio is equal to or less than a predetermined reference valve differential pressure ratio.

5. The heat pump cycle device according to claim 4, further comprising an opening determination unit configured to determine a reduction amount of the throttle opening of the other of the heating-unit side decompression unit or the bypass-side flow-rate regulating unit, when the regulating performance determination unit determines that the throttle opening of the one of the heating-unit side decompression unit or the bypass-side flow-rate regulating unit is smaller than a predetermined reference limit opening, wherein the opening determination unit increases the reduction amount of the throttle opening of the other of the heating-unit side decompression unit or the bypass-side flow-rate regulating unit, as the valve differential pressure ratio decreases.

6. The heat pump cycle device according to claim 1, further comprising:

an auxiliary branch portion configured to branch a flow of the refrigerant flowing out of the heating unit;

an auxiliary heating-unit side decompression unit configured to decompress one refrigerant branched at the auxiliary branch portion; and an evaporation unit configured to evaporate the refrigerant decompressed by the auxiliary heating-unit side decompression unit and to cause the refrigerant to flow to the suction port side of the compressor, wherein when the throttle opening of the heating-unit side decompression unit is equal to or larger than a predetermined reference increased opening in a case where the refrigerant flows through the evaporation unit, the controller prohibits a reduced throttle opening of the auxiliary heating-unit side decompression unit.

7. A heat pump cycle device comprising:

a compressor configured to compress and discharge a refrigerant;

a branch portion configured to branch a flow of a discharge refrigerant discharged from the compressor;

a heating unit configured to heat a heating object using one discharge refrigerant branched at the branch portion as a heat source;

a heating-unit side decompression unit configured to decompress the refrigerant flowing out of the heating unit and before flowing into a mixing portion;

a bypass passage that guides other discharge refrigerant branched at the branch portion to a suction port side of the compressor;

a bypass-side flow-rate regulating unit configured to regulate a flow rate of the refrigerant flowing through the bypass passage;

the mixing portion configured to mix the refrigerant flowing out of the bypass-side flow-rate regulating unit with the refrigerant flowing out of the heating-unit side decompression unit, and to cause a mixed refrigerant to flow to the suction port side of the compressor; and a controller configured to regulate an opening ratio of a throttle opening of the heating-unit side decompression unit to a throttle opening of the bypass-side flow-rate regulating unit in a manner that a quality of a suction refrigerant sucked into the compressor approaches a predetermined reference quality or a degree of superheating of the suction refrigerant approaches a predetermined reference degree of superheating.

8. A heat pump cycle device comprising:

a compressor configured to compress and discharge a refrigerant;

a branch joint configured to branch a flow of the refrigerant discharged from the compressor;

a heating heat exchanger configured to heat a heating object using one refrigerant branched at the branch joint as a heat source;

a decompression valve configured to decompress the refrigerant flowing out of the heating heat exchanger and before flowing into a mixing portion;

a bypass passage that guides the other refrigerant branched at the branch joint to a suction port side of the compressor;

a bypass regulating valve configured to regulate a flow rate of the refrigerant flowing through the bypass passage;

the mixing joint configured to mix the refrigerant flowing out of the bypass regulating valve with the refrigerant flowing out of the decompression valve, and to cause a mixed refrigerant to flow to the suction port side of the compressor; and a controller including at least one of (i) a circuit or (ii) a processor having a memory storing computer program code, wherein the at least one of the circuit or the processor having the memory is configured to:

determine a target temperature based on sensor data, from a control sensor group, the target temperature being a target value of an object temperature of the heating object to be heated by the heating heat exchanger;

determine whether a flow rate regulating performance of one of the decompression valve or the bypass regulating valve becomes equal to or less than a predetermined reference value;

control an operation of at least one of the decompression valve or the bypass regulating valve, to cause the object temperature to approach the target temperature and to cause a quality of a suction refrigerant sucked into the compressor to approach a predetermined reference quality, or to cause the object temperature to approach the target temperature and to cause a degree of superheating of the suction refrigerant to approach a predetermined reference degree of superheating; and reduce a throttle opening of the other of the decompression valve or the bypass regulating valve, when the flow rate regulating performance of one of the decompression valve or the bypass regulating valve is equal to or less than the predetermined reference value.

* * * * *